United States Patent [19]

Yagasaki

[11] Patent Number: 4,763,162

[45] Date of Patent: Aug. 9, 1988

[54] COPY SHEET FEED CONTROLLER FOR AN ELECTROSTATIC COPIER

[75] Inventor: Toshiaki Yagasaki, Hino, Japan

[73] Assignee: Canon Kabushiki Kaisha, Japan

[21] Appl. No.: 796,538

[22] Filed: Nov. 12, 1985

Related U.S. Application Data

[63] Continuation of Ser. No. 350,608, Feb. 22, 1982, abandoned.

[30] Foreign Application Priority Data

| | | | |
|---|---|---|---|
| Feb. 27, 1981 | [JP] | Japan | 61-27758 |
| Mar. 3, 1981 | [JP] | Japan | 61-30354 |
| Mar. 5, 1981 | [JP] | Japan | 61-31889 |
| Mar. 12, 1981 | [JP] | Japan | 61-36259 |
| Mar. 13, 1981 | [JP] | Japan | 61-36927 |
| Mar. 18, 1981 | [JP] | Japan | 61-38889 |
| Mar. 25, 1981 | [JP] | Japan | 61-43441 |
| Mar. 27, 1981 | [JP] | Japan | 61-45967 |
| Apr. 7, 1981 | [JP] | Japan | 61-52217 |
| Apr. 7, 1981 | [JP] | Japan | 61-52218 |

[51] Int. Cl.[4] ..... G03G 21/00

[52] U.S. Cl. ..... 355/14 SH; 271/263

[58] Field of Search ..... 355/3 R, 3 SH, 14 R, 355/14 SH; 271/263

[56] References Cited

U.S. PATENT DOCUMENTS

| | | | |
|---|---|---|---|
| 3,249,354 | 5/1966 | Egnaczak et al. | 271/263 |
| 3,288,462 | 11/1966 | Liva | 271/263 |
| 3,778,051 | 12/1973 | Allen et al. | 271/57 |
| 3,851,966 | 12/1974 | Reehil et al. | 355/14 R |
| 3,948,511 | 4/1976 | Smith et al. | 271/116 X |
| 4,203,586 | 5/1980 | Hoyer | 271/263 X |

*Primary Examiner*—Fred L. Braun

*Attorney, Agent, or Firm*—Fitzpatrick, Cella, Harper and Scinto

[57] ABSTRACT

An image forming apparatus has a container for accommodating recording sheets, an image forming station for forming images on the sheets fed from the container, a detection unit for detecting multi-feed of the sheets fed from the container, a separation unit for separating the multi-fed sheets one from others, and a controller responsive to the detection of the multi-feed by the detection unit for controlling the image forming station to form the image on the first one of the multi-fed sheets which was separated and fed to the image forming station and to form no image on the other ones of the multi-fed sheets.

11 Claims, 50 Drawing Sheets

COPY SHEET FEED CONTROLLER FOR AN ELECTROSTATIC COPIER

This application is a continuation of application Ser. No. 350,608 filed Feb. 22, 1982, now abandoned.

BACKGROUND OF THE INVENTION

1. Field of the Invention

The present invention relates to a feed controller in an image forming apparatus such as a copying machine or a recording machine for detecting the simultaneous feeding of two or more sheets (hereinafter referred to as multi-feed) to control the operation of the image forming apparatus.

2. Description of the Prior Art

A copying machine or a facsimile machine usually has a mechanism for separating and feeding sheets stacked in a cassette or deck one by one in order to feed the sheets into an image forming station of the machine one by one, form images thereon, and eject the sheets from the machine. However, if for some reason the sheets are not separated one by one, and two or more sheets are fed simultaneously in the machine, there is a high possibility of jam, or even if jam does not occur, leading edges of the piled sheets are staggered from each other so that the image is not formed in a predetermined area of the sheet resulting in waste of sheets.

In the past, in order to detect the double feed, it has been proposed to detect a change in the thickness of the sheet or detect a change in a transmitted light in order to detect the presence or absence of the double feed. However, these methods do not successfully deal with various types of sheets and are technically difficult to attain.

SUMMARY OF THE INVENTION

It is an object of the present invention to provide a feed controller which controls the feed of sheets such that an image is formed without shear even on multi-fed sheets.

It is another object of the present invention to provide a feed controller which separates and feeds one of the multi-fed sheets and feeds the remaining sheet at a predetermined timing.

It is another object of the present invention to provide an image forming apparatus which forms an image on one of multi-fed sheets and does not form the image on other sheets.

It is another object of the present invention to provide a feed controller which separates and feeds one of multi-fed sheets and collects the remaining sheets at a predetermined station.

It is another object of the present invention to provide a multi-feed detection device which can detect the multi-feed independently of the type of sheet.

It is another object of the present invention to provide a multi-feed detection device which detects the multi-feed by detecting feed interval of the sheets.

It is another object of the present invention to provide a multi-feed detection device which detects the multi-feed after separation of the sheets in synchronism with a feed timing.

It is another object of the present invention to provide a feed controller which issues an alarm when a predetermined number of multi-feed conditions have been detected.

It is other object of the present invention to provide a feed controller which indicates the number of multi-fed sheets.

The above and other objects of the present invention will be apparent from the following description of the present invention.

BRIEF DESCRIPTION OF THE DRAWINGS

FIG. 1-2 is a sectional view of another copying machine to which the present invention may be applied.

FIG. 1-3 is a sectional view of another copying machine to which the present invention may be applied.

FIG. 1-4 is a sectional view of another copying machine to which the present invention may be applied.

FIG. 1-5 is a sectional view of another copying machine to which the present invention may be applied.

FIG. 1-6 is a sectional view of another copying machine to which the present invention may be applied.

FIG. 2 is a sectional view of a multi-feed separation roller.

FIGS. 3 and 4 are alternate elevational views illustrating the operation of the multi-feed separation roller shown in FIG. 2.

FIGS. 5 and 6 are an elevational view and a perspective view, respectively, of a multi-feed detection device.

FIG. 7-1 is a block diagram of a control unit for use in the copying machine.

FIG. 7-2 is a block diagram of a control unit for use in the copying machine.

FIG. 7-3 is a block diagram of a control unit for use in the copying machine.

FIG. 7-4 is a block diagram of a control unit for use in the copying machine.

FIG. 7-5 is a block diagram of a control unit for use in the copying machine.

FIG. 7-6 is a block diagram of a control unit for use in the copying machine.

FIG. 7-7 is a block diagram of a control unit for use in the copying machine.

FIG. 7-8 is a block diagram of a control unit for use in the copying machine.

FIG. 7-9 is a block diagram of a control unit for use in the copying machine.

FIG. 7-10 is a block diagram of a control unit for use in the copying machine.

FIG. 8, comprising FIG. 9 shows a timing chart therefor.

FIG. 10, comprising

FIG. 12, comprising

FIG. 14, comprising

FIG. 16, comprising

FIG. 18, comprising

FIG. 20, comprising

FIG. 23, comprising

DETAILED DESCRIPTION OF THE PREFERRED EMBODIMENTS

The preferred embodiments of the present invention will now be explained in detail with reference to the accompanying drawings.

Figure 1:
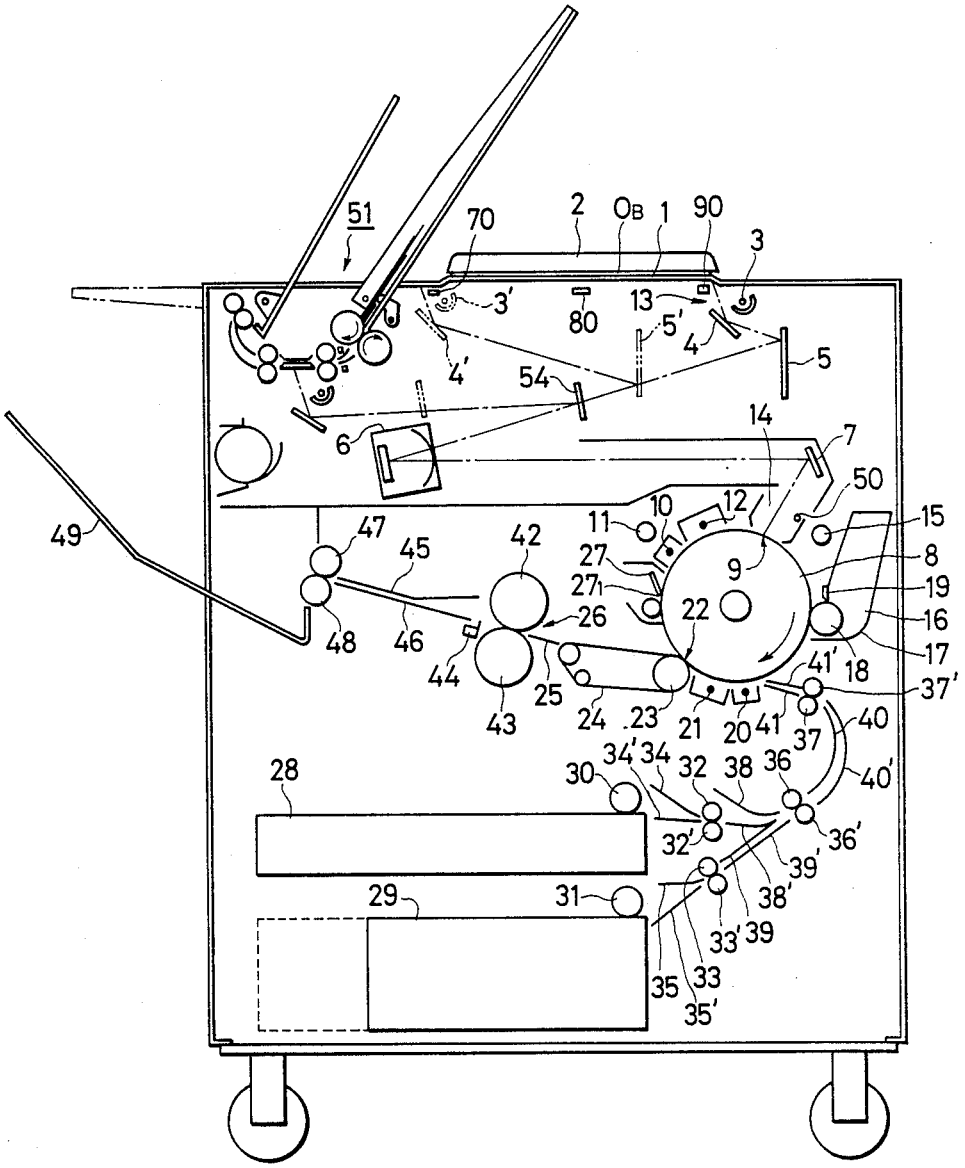
FIG. 1-1 is a sectional view of a copying machine to which the present invention may be applied.

FIG. 1-1 shows a sectional view of a copying machine to which the present invention is applied.

The illustrated copying machine is a powder developer transfer type electrographic copying machine in which numeral 1 denotes a transparent text mount on which an original text $O_B$ (hereinafter "text" or "original") to be copied is mounted with a leading edge thereof being aligned to a reference position on the text mount, and the text is held by a text cover 2. Positioned below the text mount 1 are a text illumination lamp 3, movable mirrors 4 and 5, stationary in-mirror lens 6 and mirror 7 and a photosensitive drum 8, at solid line positions. A fan (not shown) for cooling the text mount which is heated by the text illumination lamp 3 is also arranged. By depressing a copy button, not shown, the photosensitive drum 8 starts to rotate clockwise as shown and is subjected to charge and light exposure by charges and lamps to be described later. At the same time, the text illumination lamp 3 and the movable mirrors 4 and 5, which are movable parts in the optical system, move to positions shown by broken lines. When the photosensitive drum 8 completes a predetermined revolution, a start of exposure signal is issued so that the text illumination lamp 3 and the first mirror 4 start to move rightward from the broken line positions at a velocity equal to a circumferential velocity of the photosensitive drum 8, and the second mirror 5 starts to move towards the right from the broken line position at a velocity which is one half of the circumferential velocity of the photosensitive drum 8. An image of the text $O_B$ illuminated from the bottom thereof by the text illumination lamp 3 is focused by an optical system comprising the movable mirrors 4 and 5, the in-mirror lens 6 and the mirror 7 onto the photosensitive drum 8 at an exposure station 9. Upon the completion of the exposure which is carried out in accordance with a signal which is determined by the size of the sheet, the movable mirrors 4 and 5 stop their rightward movements and immediately return leftward. The above operations are repeated for each of the copies, the number of which are preset by a key pad or a dial, not shown. After the preset number of times of exposure operations have been completed, the text illumination lamp 3 and the movable mirrors 4 and 5 return to the solid line positions and stop there. The velocity of the movement in the illustrated direction is faster than the velocity in the rightward movement in order to enhance a copy efficiency.

The photosensitive drum 8 has a photosensitive layer having a transparent insulative layer covered thereon and it rotates clockwise as described above. The photosensitive drum 8 is first AC discharged by an AC predischarger 10 which is supplied with a high voltage A.C. current from a high voltage supply, not shown and also exposed by a lamp 11 in order to erase charges on the surface of the insulative layer and within the photosensitive layer. Subsequently, it is charged to a positive polarity (+) by a primary charger 12 which is supplied with a positive high voltage from the high voltage supply. At the exposure station 9, the photosensitive drum 8 is slit-exposed by the image from the illumination station 13 and AC discharged by an AC discharger 14 which is supplied with a high AC voltage from the high voltage supply, and then it is flat-exposed by a lamp 15 to form an electrostatic latent image on the surface of the photosensitive drum 8. The photosensitive drum 8 then turns to a developer 16 which comprises a container 17 for accomodating developer, a developing roll 18 and a doctor blade 19. The electrostatic latent image on the photosensitive drum 8 is developed by the developer which is magnetically attracted to the developing roll 18.

Then, a paper P fed from a paper feed station is brought into contact with the photosensitive drum 8 and the image on the photosensitive drum 8 is transferred to the paper P by the charging action of a transfer charger 20 through a high voltage from the high voltage supply. The paper P to which the image has been transferred is discharged by a separation discharger 21 which is supplied with a high AC voltage from the high voltage supply so that the attractive force relative to the photosensitive drum 8 is weakened. Then, the paper P is pulled by a roll 23 at a separation station 22 so that it is separated from the photosensitive drum 8 and guided into a fixing station 26 by a belt 24 and a guide 25. The developer remaining on the photosensitive drum 8 is wiped off by an edge $27_1$ of a pressed blade cleaner 27 and the photosensitive drum 8 then repeats the next cycle. The photosensitive drum 8 repeats the cycles the number of times equal to the preset number of copies and continues to rotate so that the charges within the photosensitive layer are removed by the discharging action of the AC discharger 14 and the flat exposure by the lamp 15. The photoconductive drum 8 then rotates by a predetermined angle to be ready to the next cycle and stops. Numeral 50 denotes a blank exposure lamp which is turned on during the forward movement of the optical system to illuminate the drum surface in order to erase the surface charges and prevent excess toners from being deposited on the drum surface.

On the other hand, the paper P is accommodated in a cassette 28 or a paper feed deck 29 which is positioned at a paper feed station at the bottom left of the machine. Several types of cassettes 28 are prepared depending on the sizes of the papers required and the desired cassette can be readily mounted. The paper feed deck 29 can also accommodate desired one of several sizes of papers as required. The papers P accommodated in the cassette 28 or the paper feed deck 29 are pressed by paper feed rolls 30 and 31, respectively, at a predetermined pressure irrespective of the volume of papers. When the photosensitive drum 8 reaches a predetermined position, the paper feed roll 30 or 31 starts to rotate depending on which one of the cassette 28 or the deck 29 has been selected by a button, not shown, to feed the paper P. The subsequent paper feed is carried out by paper transport means including a pair of rolls 32 and 32' or 33 and 33'. The paper P is guided to the photosensitive drum 8 by roll pair 36, 36', register roll pair 37, 37', guides 38, 38' or 39, 39' and 40, 40' or 41, 41' and synchronized with the image on the photosensitive drum 8 and then contacted to the photosensitive drum 8 and charged by the transfer charger 20 so that the image is transferred thereon. The paper P on which the image has been transferred is then discharged by the separation discharger 21 and separated from the photosensitive drum 8 at the separation station 22 and then fed to the fixing station 26 by the belt 24 driven by a roll and the guide 25. At the fixing station 26, the paper P having an unfixed image thereon is pressed under a predetermined pressure when it passes through rolls 42 and 43 which are pressed against each other under a predetermined pressure while rotating at the same circumferential velocity. The paper P coming out of the fixing station 26 has the charges remaining thereon removed by the discharger 44 and then guided to eject rolls 47 and 48 by guides 45 and 46 and ejected onto a tray 49. Numeral 51 denotes an auto feeder which is positioned at the left top of the machine. By the use of the auto feeder 51, a text on a long web can be copied. The explanation of the operation of the auto feeder 51 is omitted here.

Figures 1, 2:
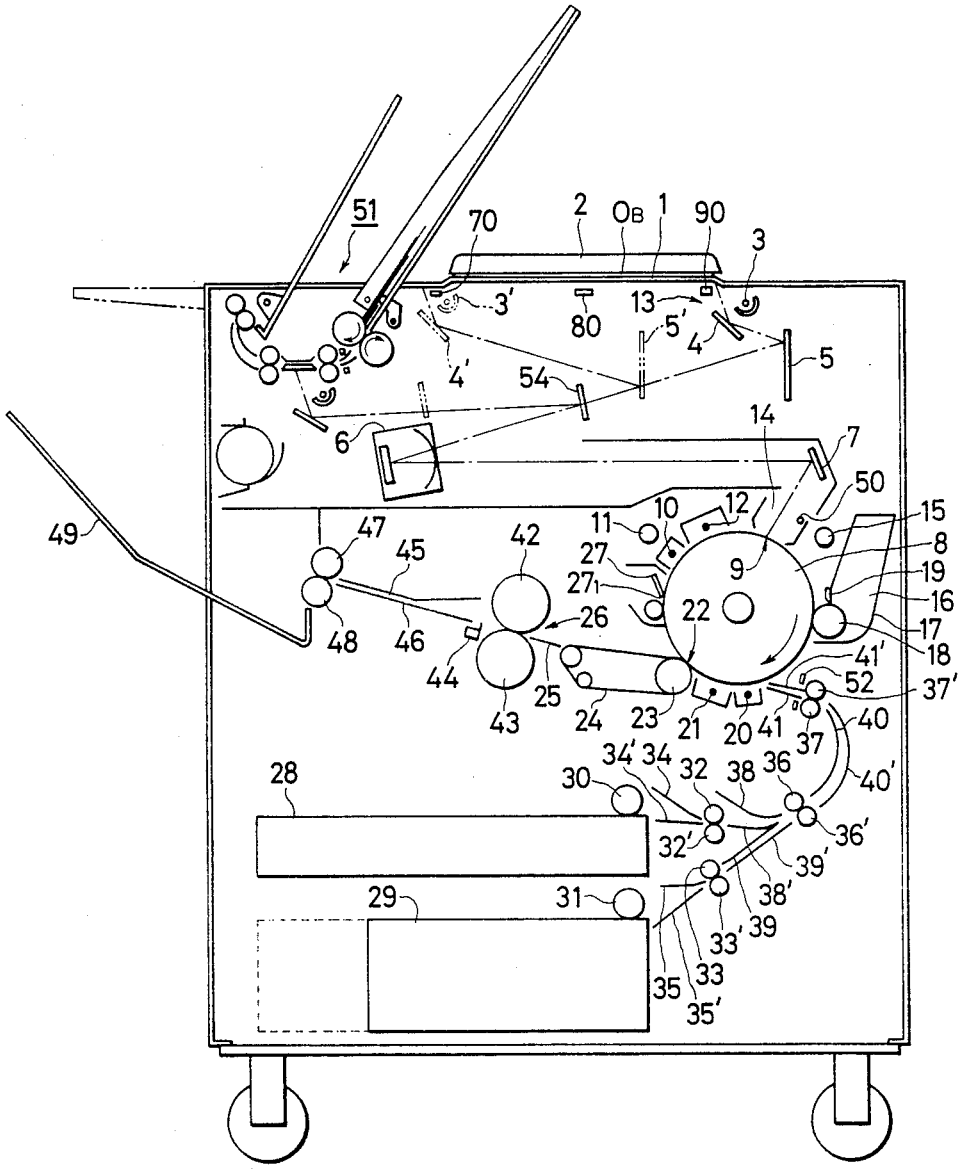

The structure of the multi-feed separation roll pair 32 and 32' is now explained. FIG. 2 shows a perspective view of the multi-feed separation rolls, in which numeral 32 denotes a drive roll which is driven by a drive source, not shown, to rotate in the direction of an arrow F and numeral 32' denotes a follower roll which is pressed to the drive roll 32 by pressing means, not shown, under a predetermined pressure to derive a rotating force from the drive roll 32. A braking member 108 is attached to one end of a shaft 107 of the follower roll 32'. The shaft 107 clamped by a member 109 and a bolt 110 so that a predetermined rotation load is applied to the shaft 107 or the follower roll 32'. Numeral 111 denotes a stop member fixed to a frame to prevent the member 109 from being rotated.

Figures 1, 2, 3:
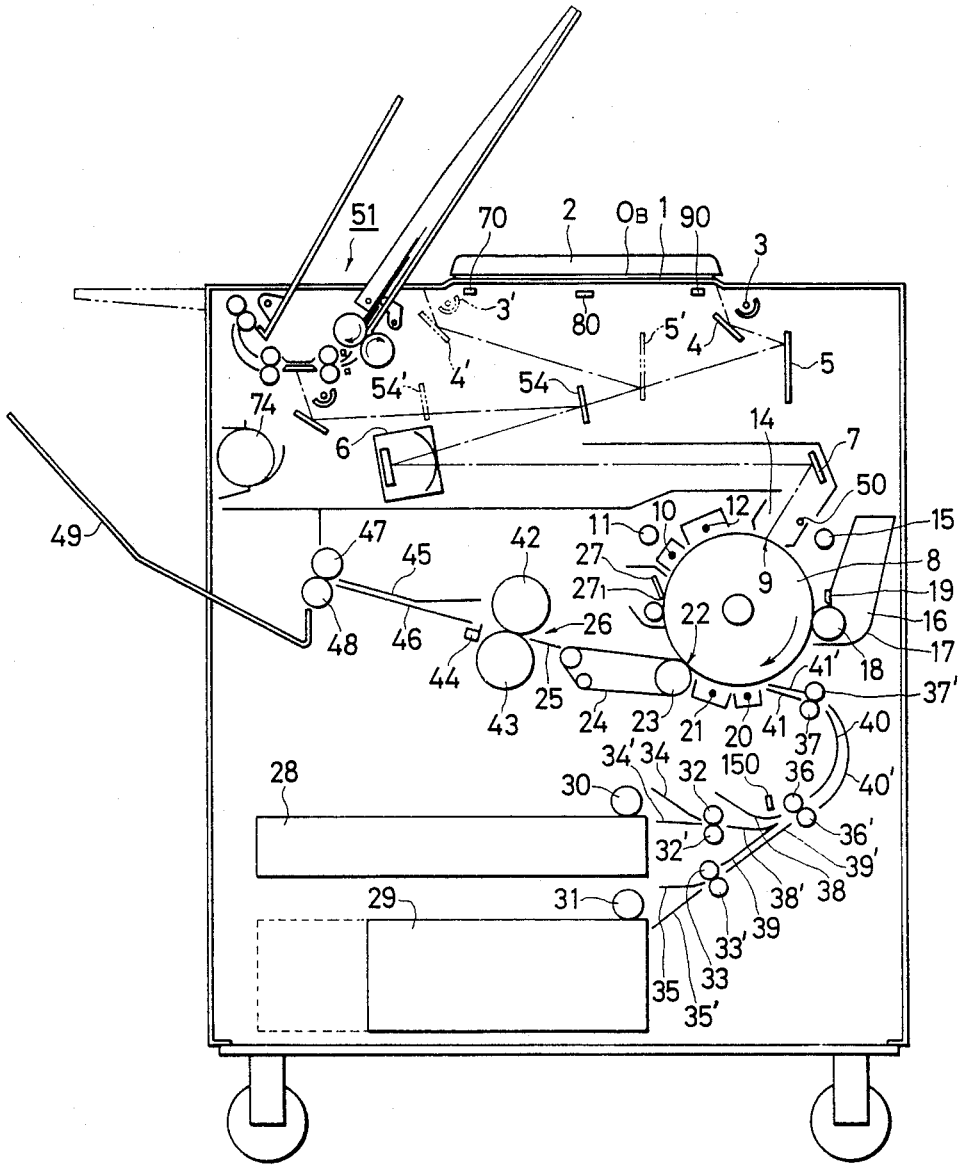
Figures 1, 2, 3, 4:
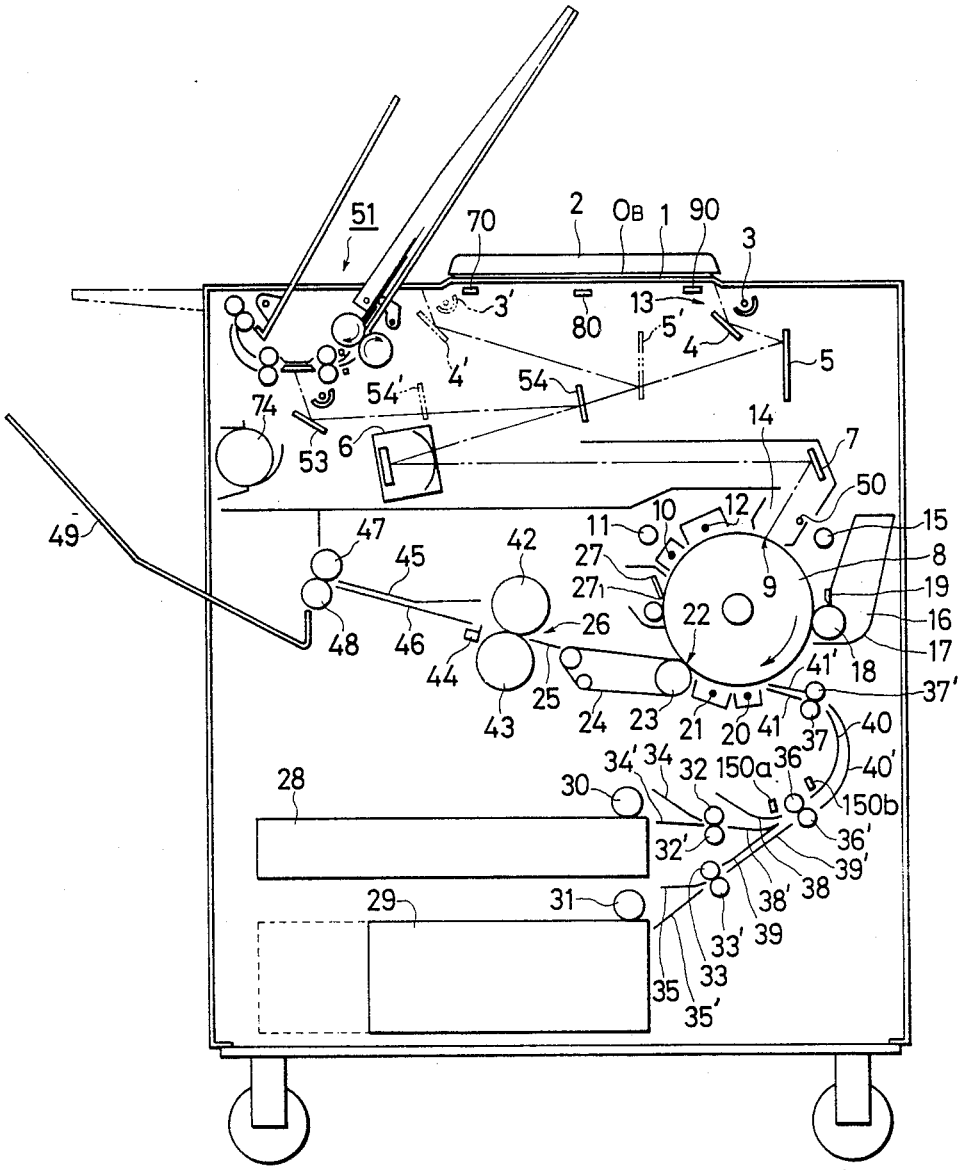

Referring to FIGS. 3 and 4, the operation is now explained. When a single paper S is conveyed as shown in FIG. 3, a feed force $F_1$ transmitted from the drive roll 32 to the paper S and a rotating force $F_2$ transmitted to the follower roll 32' through the paper S are represented by:

$$F_1=\mu_1 P,\ F_2=\mu_2 P$$

where P is a pressing force between the drive roll 32 and the follower roll 32', $\mu_1$ is a coefficient of friction at a contact area between the drive roll 32 and the paper S, and $\mu_2$ is a coefficient of friction at a contact area between the follower roll 32' and the paper S. When $F_1$ and $F_2$ is larger than $F_4$ which represents a rotational load applied to the follower roll 32', the follower roll 32' rotates in the direction of an arrow H, that is, in the paper feed direction and the paper S is fed while it is held by the drive roll 32 and the follower roll 32'.

When two papers $S_1$ and $S_2$ are fed as shown in FIG. 4, a maximum feed force $F_1$ transmitted from the drive roll 32 to the paper $S_1$, a maximum feed force $F_2$ between the follower roll 32' and the paper $S_2$ and a maximum feed force between the papers $S_1$ and $S_2$ are represented by:

$$F_1=\mu_1 P,\ F_2=\mu_2 P\ F_3=\mu_3 P+\alpha$$

where P is the pressing force between the drive roll 32 and the follower roll 32', $\mu_1$ is a coefficient of friction at the contact area between the drive roll 32 and the paper $S_1$, $\mu_2$ is a coefficient of friction at the contact area between the follower roll 32' and the paper $S_2$, $\mu_3$ is a coefficient of friction between the papers $S_1$ and $S_2$, and $\alpha$ is a force other than frictional force such as a contact force acting between the papers $S_1$ and $S_2$ In order to feed the paper in a stable manner, both the drive roll 32 and the follower roll 32' are made of neoprene rubber and the pressing force P is appropriately set so that the coefficients of friction $\mu_1$ and $\mu_2$ to the drive roll 32 and the follower roll 32', respectively, are sufficiently large. In addition, the coefficient of friction $\mu_3$ between the papers $S_1$ and $S_2$ is selected such that $$\mu_1,\ \mu_2 >> \mu_3$$

or $F_1, F_2 >> F_3$ Thus, when the rotational load $F_4$ is selected such that $$F_1,\ F_2 > F_4 > F_3$$

the rotational force transmitted to the follower roll 32' through the papers $S_1$ and $S_2$ is $F_3$ at maximum. Accordingly, the follower roll 32' is prevented from being rotated by the rotational load $F_4$. Accordingly, only the paper $S_1$ which contacts with the drive roll 32 is fed and the paper $S_2$ which contacts with the follower roll 32' is not fed. In this manner, the papers $S_1$ and $S_2$ are separated from each other and the paper is fed one sheet at a time.

The separation rolls 33 and 33' are constructed in the same manner.

Figures 1, 2, 3, 4, 5:
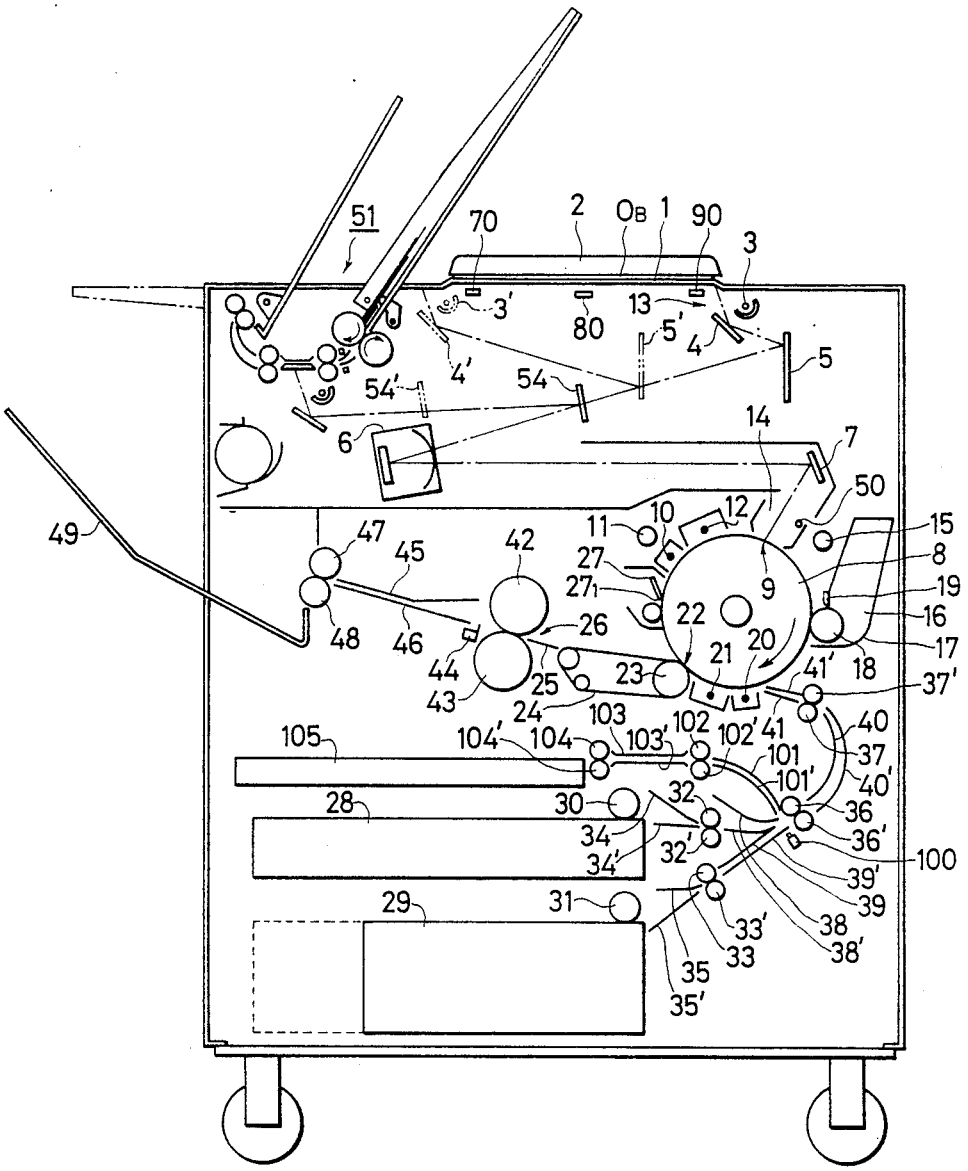
Figures 1, 2, 3, 4, 5, 6:
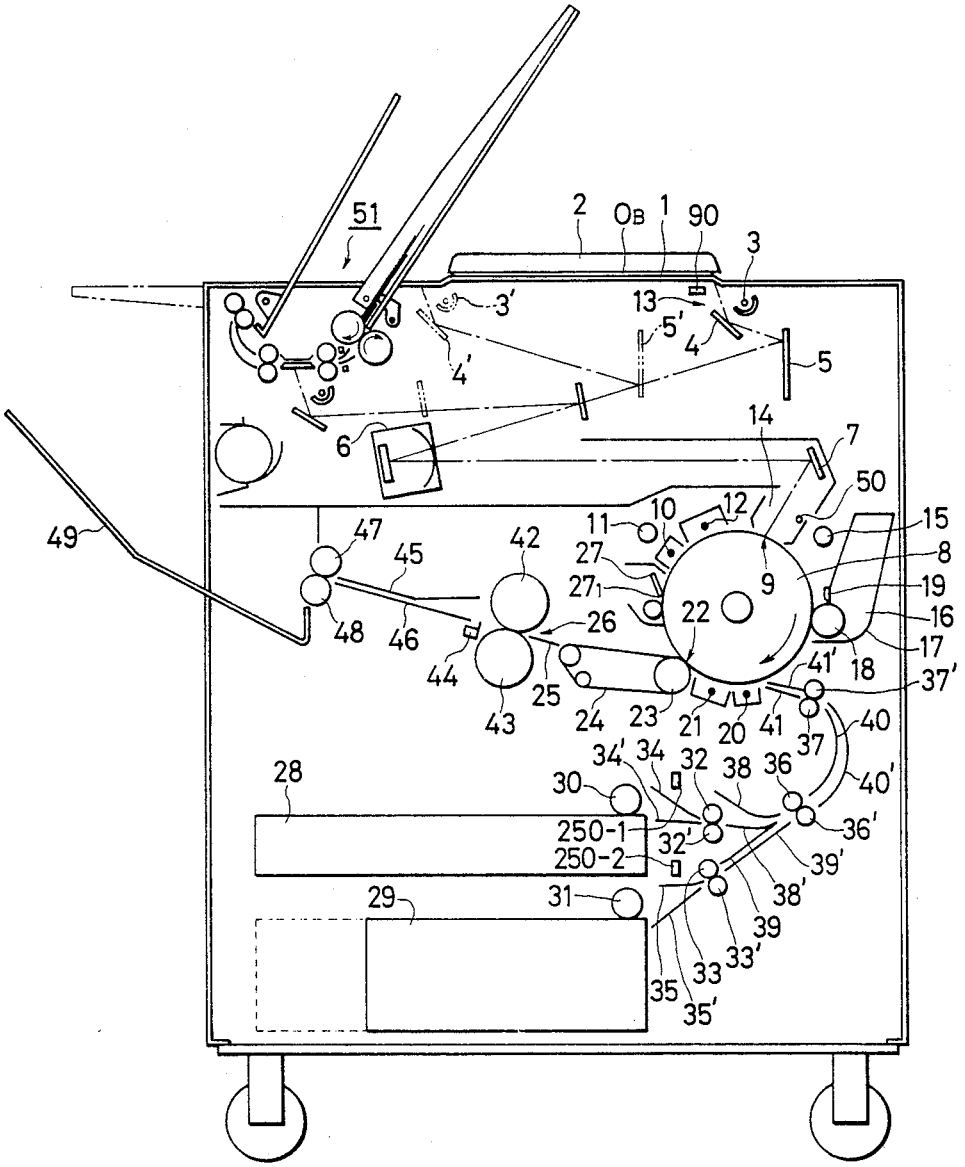
Figure 2:
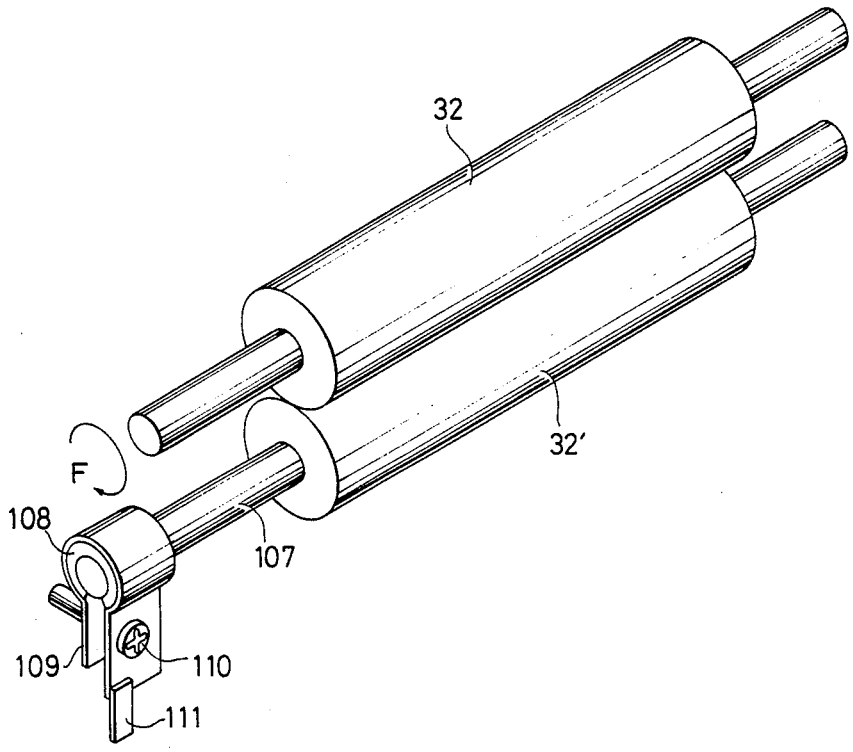
Figure 3:
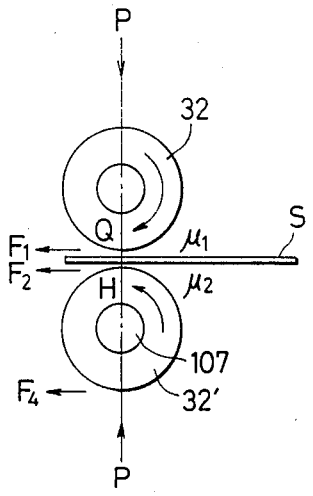
Figure 4:
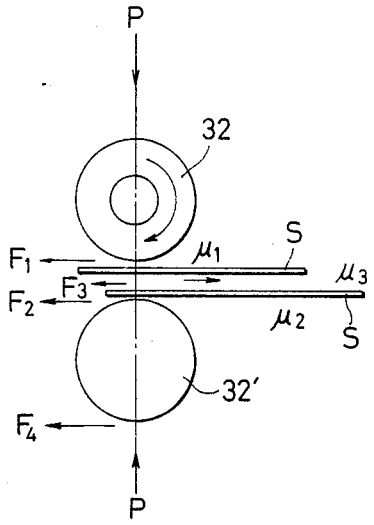
Figure 5:
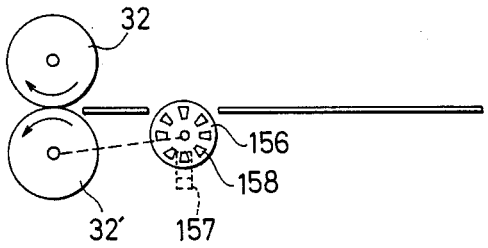
Figure 6:
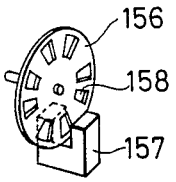

FIGS. 5 and 6 show a device for detecting a multi-feed condition. It comprises a disc 156 having a plurality of apertures 158 formed circumferentially and a photosensor 157. As the follower roll 32' rotates, the disc 156 rotates therewith and the photosensor 157 senses the rotation. In a normal feed operation the photosensor 157 generates pulse signals, but if the multi-feed occurs, the follower roll 32' stops rotating the disc 156 also stops rotating. As a result, the photosensor 157 does not generate a pulse signal. In this manner, the multi-feed condition can be detected.

Figures 1, 7:
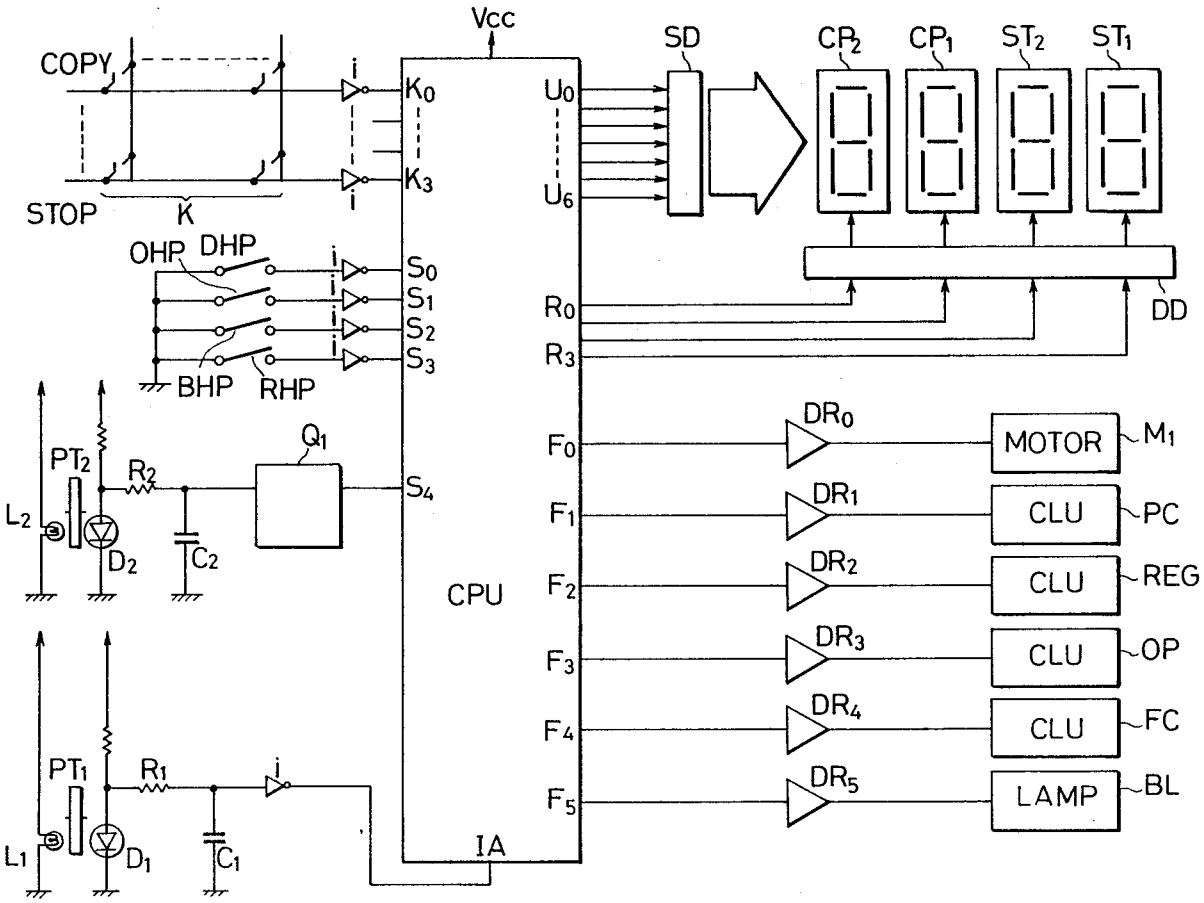
Figures 2, 7:
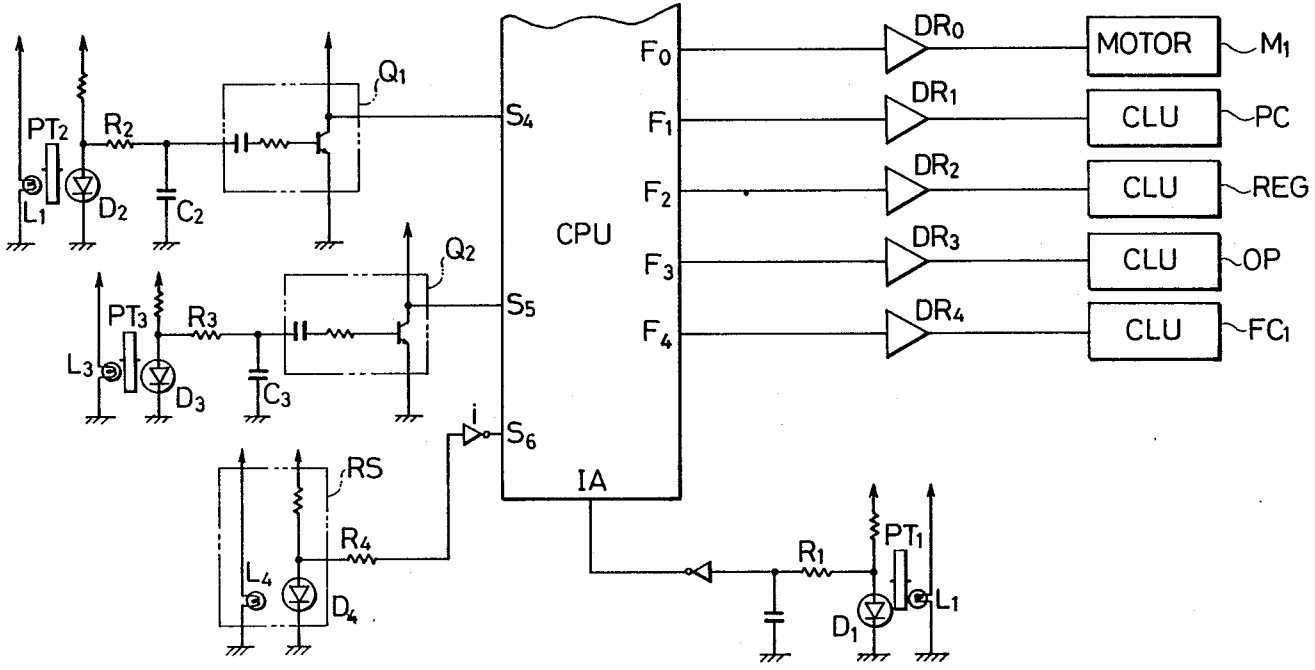
Figures 3, 7:
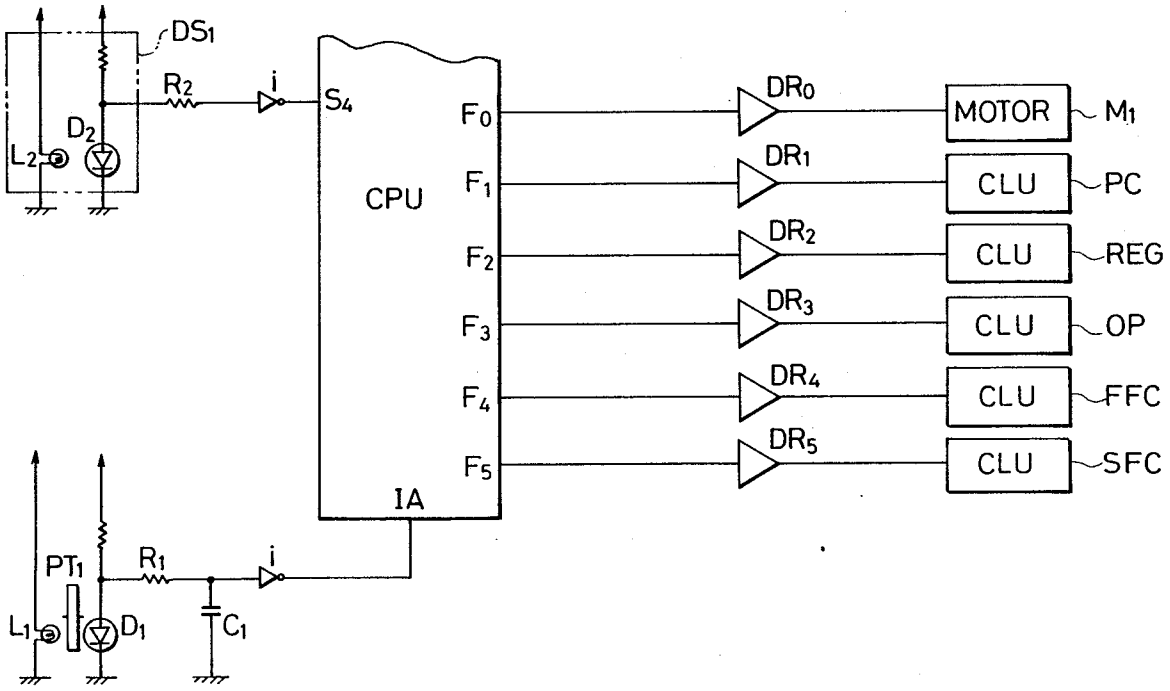
Figures 4, 7:
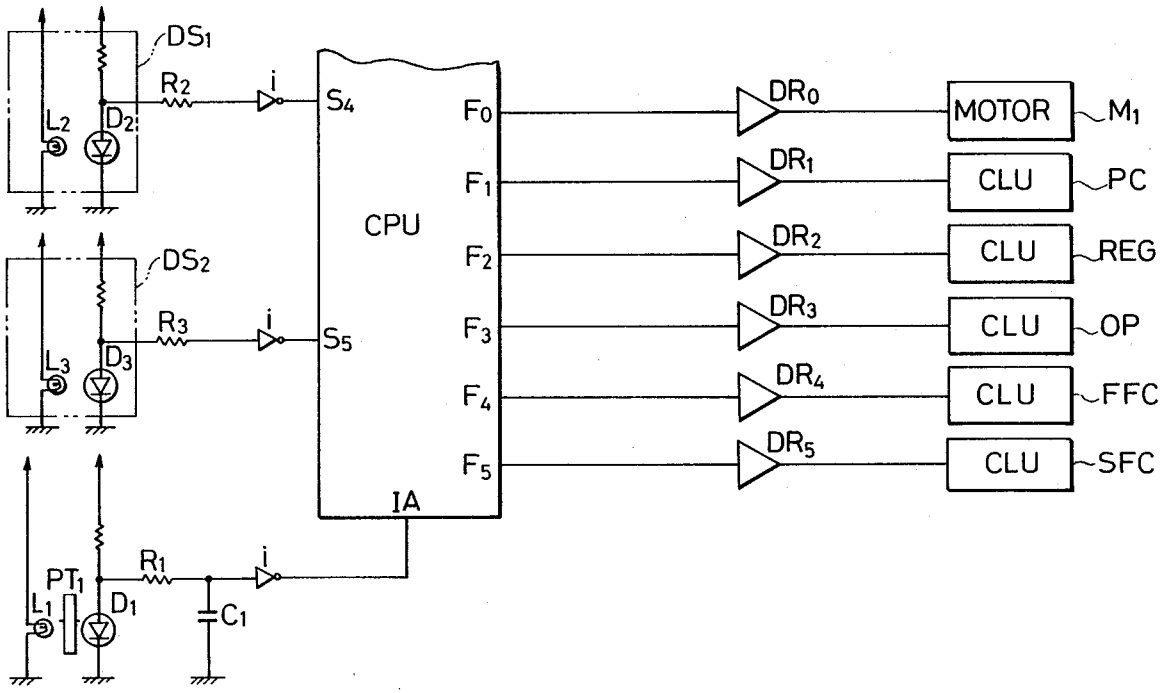
Figures 5, 7:
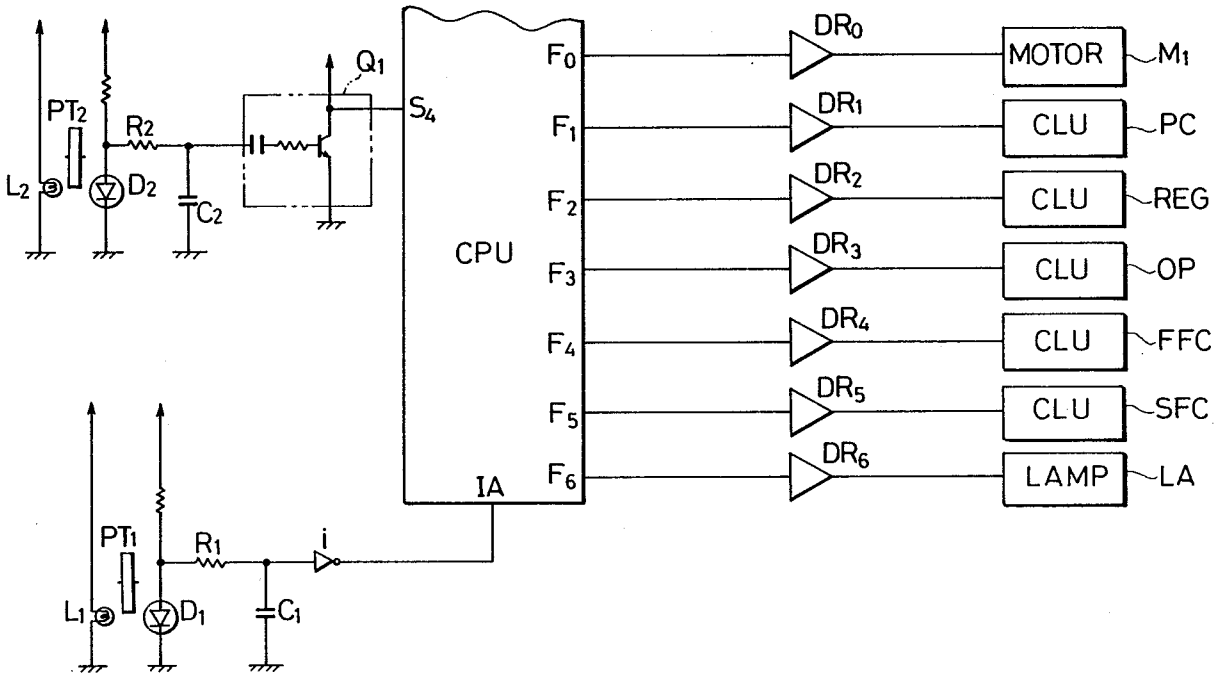
Figures 6, 7:
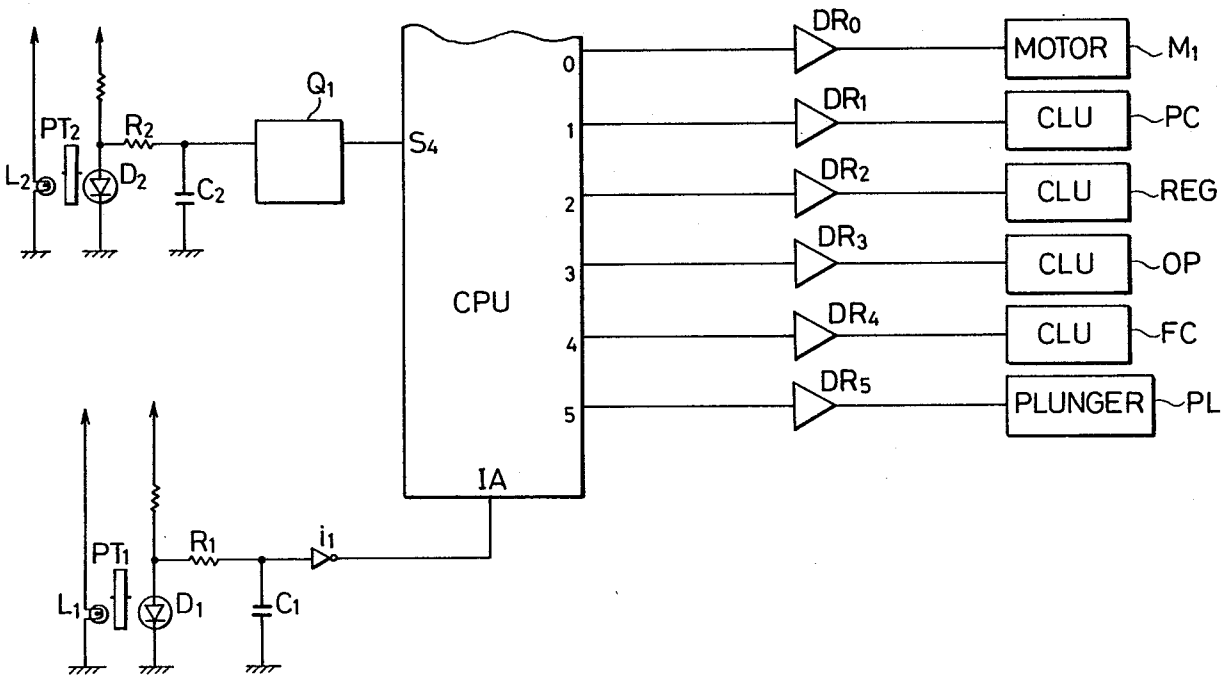
Figure 7:
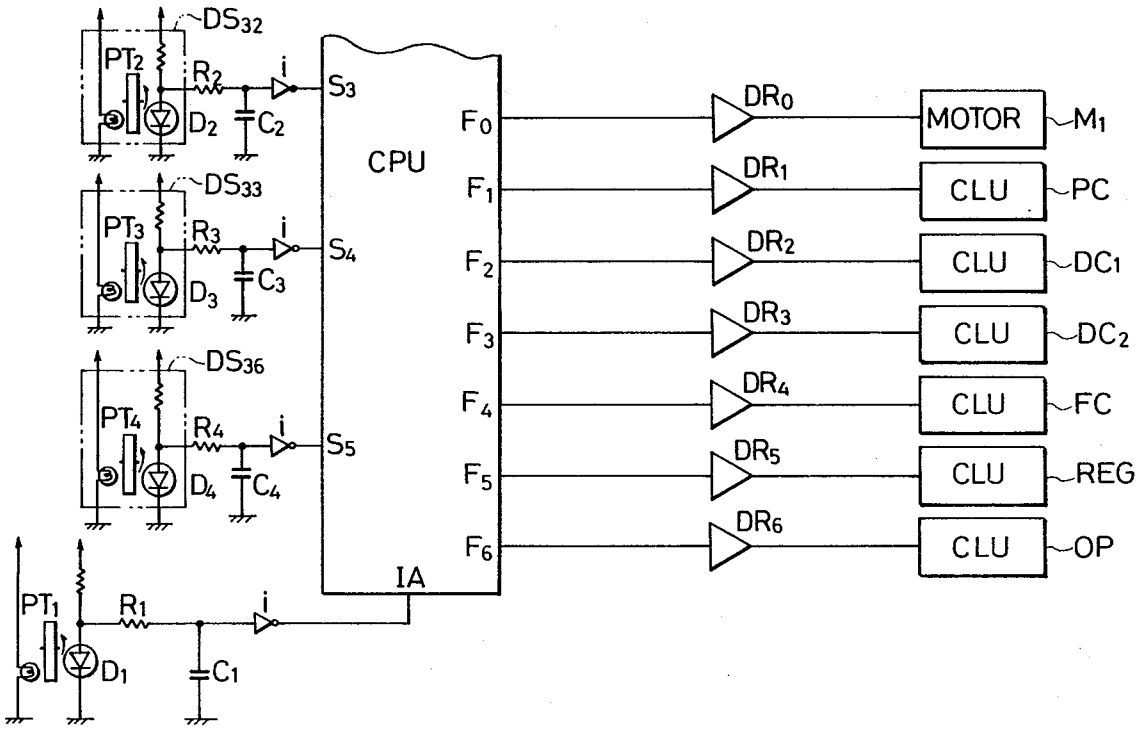

FIG. 7-1 shows a control unit of the copying machine. CPU is a well known one-chip microcomputer including a ROM and a RAM therein, which may be NEC μCOM43. A symbol IA denotes an interruption port. An intermittent signal generated by a timing disc $PT_1$ which rotates with the photosensitive drum 8 is optically sensed by a photosensitive element $D_1$, an output of which is shaped by a capacitor $C_1$ to produce a drum clock pulse, which is applied to the port IA. Symbols $CP_1$, $CP_2$, $ST_1$ and $ST_2$ are seven-segment displays constructed of light emitting diodes or liquid crystal devices. $ST_1$ denotes the display for displaying a unit digit of the preset number of the copies, $ST_2$ denotes the display for displaying tenth digit of the preset number of the copies, $CP_1$ denotes the display for displaying a unit digit of a copy counter which indicates the current number of copies produced and $CP_2$ denotes the display for displaying the tenth digit of the copy counter. A symbol SD denotes a segment driver for fixing the segments of the displays $ST_1$, $ST_2$, $CP_1$ and $CP_2$ in response to segment signals from output terminals $U_0$–$U_6$ of the microcomputer CPU, a symbol DD denotes a driver for causing the displays $ST_1$, $ST_2$, $CP_1$ and $CP_2$ to display the contents of the segment signals in response to the digit signals from output terminals $R_0$–$R_3$ of the microcomputer CPU, a symbol K denotes a key entry matrix by which signals from a start of copy button COPY, a stop button STOP and a key pad for setting the number of copies are entered to input ports $K_0$–$K_3$ of the microcomputer CPU, a symbol DHP denotes a microswitch for detecting a home position of the drum, a symbol OHP denotes a microswitch (90 in FIG. 1) for detecting a home position of the optical system, a symbol BHP denotes a microswitch (70 in FIG. 1) for detecting a back position which is a reverse position of the optical system, and a symbol RHP denotes a timing control microswitch (80 in FIG. 1) for turning on the regist roll 37. Those microswitches are connected to input ports $S_0$–$S_3$ of the microcomputer CPU.

Connected to an input port $S_4$ of the microcomputer CPU is the multi-feed detection device shown in FIGS. 5 and 6. A signal generated by a disc $PT_2$ (156 in FIGS. 5 and 6) which is coupled to the follower roll 32' and a photosensor (157 in FIGS. 5 and 6) comprising a light emitting device and a photosensing device, when the multi-feed is detected, is shaped by a capacitor $C_2$ and the shaped signal is applied to a multi-feed detection circuit $Q_1$. The multi-feed detection circuit $Q_1$ produces a "0" signal when the paper is properly fed and a pulse signal is generated, and produces a "1" signal when the pulse signal is not generated because of the multi-feed. The output signal of the multi-feed detection circuit $Q_1$ is applied to the input port $S_4$. Although not shown, a similar multi-feed detection device is connected to the microcomputer CPU to monitor the operation of the follower roll 33'.

Connected to output ports $F_0$–$F_5$ through drivers $DR_0$–$DR_5$, respectively, are a main motor $M_1$, a clutch PC for driving the paper feed roll 30 (or 31), a clutch REG for driving the register roll 37, a clutch OP for driving the optical system, a clutch FC for driving the multi-feed separation roll arranged in the feed path between the paper feed station and the ejection station and the feed roll, and a blank exposure lamp BL (50 in FIG. 1), respectively.

The start button COPY and the key entry switches are scanned by time-division signals from the output ports $R_0$–$R_3$ and dynamically supplied to the input ports $K_0$–$K_3$. The computer CPU reads the input signals to drive the main motor $M_1$. As the photosensitive drum 8 rotates, the intermittent signal is generated by the disc $PT_1$ which rotates with the main motor $M_1$ and it is detected by the photosensing device $D_3$ which produces the drum clock pulse. At the home position of the drum, the microswitch DHP is turned on by a cam coupled to the drum, and when the optical system reaches the home position to turn on the microswitch OHP, a predetermined number of drum clocks are counted up in order to turn on the clutch PC for driving the paper feed roll. That is, the ON signal of the microswitch DHP to the input port $S_0$ causes the interruption port IA to accept the drum clocks. After the predetermined number of drum clocks have been counted, a drive signal is issued from the output port $F_1$ to turn on the clutch PC for driving the paper feed roll in order to drive the paper feed roll 30 (or 31) to feed the paper. Thereafter, when a predetermined number of clocks have been further counted, the paper feed roll is turned off. The other equipment which is to be turned on and off in a timed relation are controlled in a similar fashion.

Figures 7, 8:
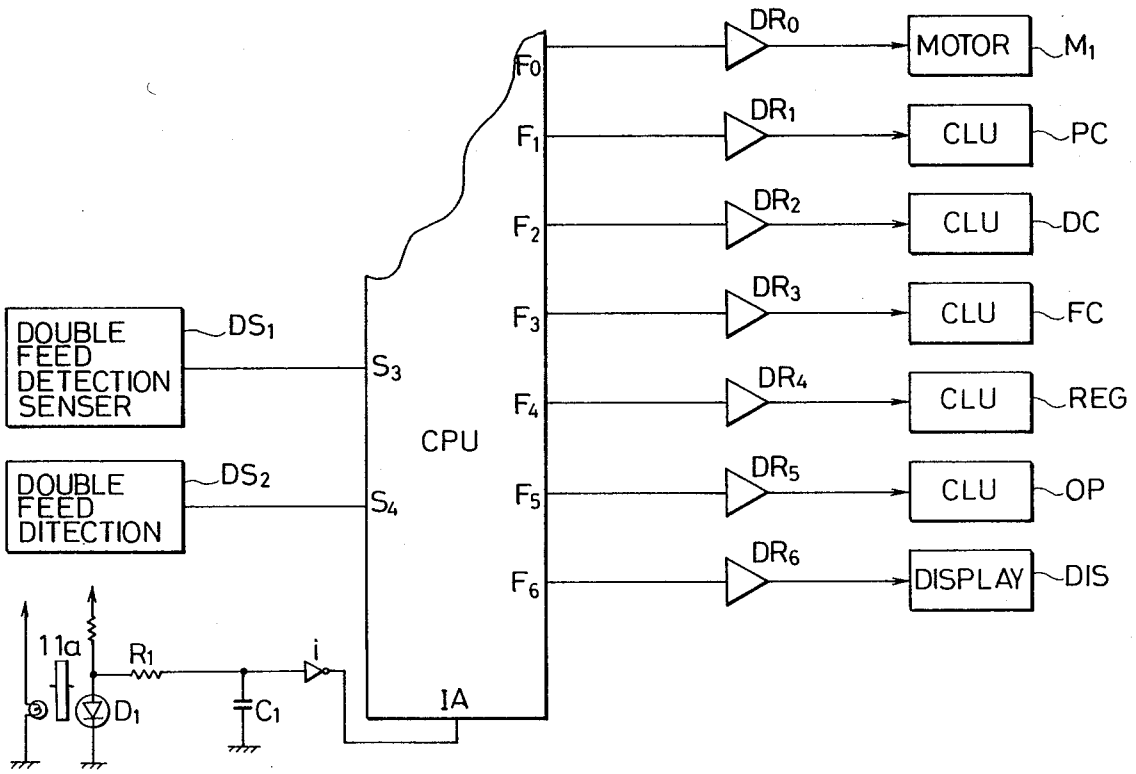
Figures 7, 8, 9:
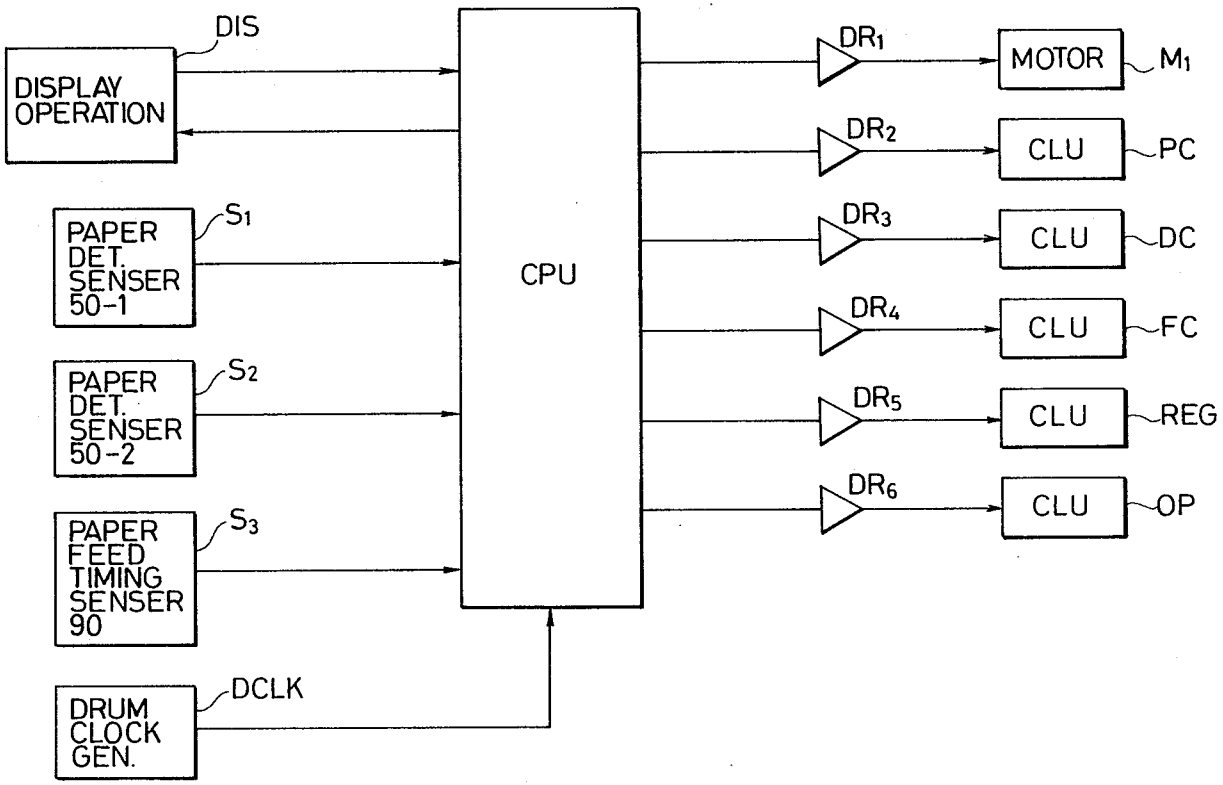

FIG. 8 shows a control flow chart of one embodiment of the present invention and FIG. 9 shows a timing chart therefor. In the illustrated embodiment, when the multi-feed is detected, an image forming sequence is carried out only to the paper which is separated by the multi-feed separation roll and fed first, and the scan of the optical system is stopped for the paper subsequently fed and a blank exposure is carried out with respect to the subsequently fed paper so that a white copy paper is ejected. After the above cycle, a normal sequence is carried out. The operation is now explained with reference to FIGS. 8 and 9.

In a step 1, the number of copies, the size of copies and the density of copies are set. When the copy key COPY is depressed, those signals are entered from the input port $K_0$ and the data are loaded to an accumulator, not shown, in the microcomputer CPU and then the data are stored in a selected area of a RAM, not shown. When the sensor OHP detects that the optical system is at the home position, a drive signal is issued from the output port $F_0$ through the driver $DR_0$ to drive the main motor $M_1$. Another drive signal is issued from the output port $F_4$ through the driver $DR_4$ to turn on the clutch FC for driving the feed roll so that the multi-feed separation roll 32 (or 33) and the feed roll arranged in the feed path between the paper feed station and the ejection station start to operate.

In a step 2, a timer 1 provided in a selected area of the RAM is turned on to start timer operation to count $N_1$ drum clocks applied to the interruption port IA. The duration of the period measured by timer 1 corresponds to the time period from the moment that the copy key is depressed the copy key to the time that the paper feed is activated. When the timer 1 is turned off after it has counted $N_1$ drum clocks, a drive signal is issued from the output port $F_1$ through the driver $DR_1$ to turn on the clutch PC for driving the paper feed roll so that a first run of the paper feed operation is carried out. In a step 3, timers 2 and 3, which are provided in selected areas of the RAM, are turned on to start timer operations to count $N_2$ and $N_3$ drum clocks, respectively. The duration of the time measured by timer 2 corresponds to a time period from the start of the paper feed to a time point when the paper reaches the multi-feed separation roll 32 (or 33). The duration of the time measured by timer 3 corresponds to a time period from the start of the paper feed to the time when of the optical system is turned on. When the timer 2 is turned off, the output of the multi-feed detection circuit $Q_1$ is checked to determine the presence or absence of a multi-feed in the first run of the paper feed. If a multi-feed is not present, the sequence goes to a step 4. In the example shown in FIG. 9, the output of the multi-feed detection circuit $Q_1$ at this moment is "1" which is determined as the multi-feed. Thus, the sequence goes to a step 8.

In the step 8, when the timer 3 is turned off, a Z0 drive signal is issued from output port $F_3$ through the driver $DR_3$ to turn on the clutch OP for driving the optical system so that the optical system is driven to expose light. In the present embodiment, the text exposure is carried out during the reverse movement of the optical system from the back position to the home position.

The sequence then goes to a step 9 in which a timer 4 provided in a selected area of the RAM is turned on to start timer operation to count $N_4$ drum clocks. The duration of the time measured by timer 4 corresponds to a time period from the turn-on of the optical system to the start of the next paper feed operation. In the illustrated example, since a multi-feed has been detected in the step 3 the clutch PC for driving the paper feed roll is not turned on when the timer 4 is turned off and hence the paper is not fed. The presence or absence of a stop condition is then determined. That is, if a stop condition is detected by the completion of the predetermined number of copies, the actuation of the stop key STOP or the jam, the sequence goes to a step 6.

In the example shown in FIG. 9, no stop condition is detected and the sequence goes to a step 10 in which a timer 5 provided at a selected area of the RAM hs turned on to start a timer operation to count $N_5$ drum clocks. The duration of the time measured by timer 5 corresponds to a time period from the turn-off of the timer when the multi-feed is detected to the start of the paper feed. When the timer 5 is turned off, the clutch PC for driving the paper feed roll is turned on so that a second run of paper feed is carried out. The timers 2 and 3 are turned on to start the timer operation. Before the timer 2 is turned on, the timing sensor RHP for controlling the register roll is turned on so that the input signal to the input port $S_2$ changes to "1" and a drive signal is issued from the output port $F_2$ through the driver $DR_2$ to turn on the clutch REG for driving the register roll. As the roll 37 is driven, that paper of the multi-fed papers which was separated by the multi-feed separation roll 32 (or 33) and fed first from the multi-feed separation roll is now fed to the transfer station where the image formed on the photosensitive drum 8 is transferred to the paper. As the optical system returns to the home position and the input signal to the input port $S_1$ changes to "1", the clutch OP for driving the optical system is turned off to stop the optical system. A multi-feed flag is checked and if it is set, the sequence goes to the step 8. In the illustrated example, since the multi-feed flag is not set, the sequence goes to the step 4.

In the step 4, the sequence waits until, the timer 3 is turned off. During this period, the register roll 37 continues to operate so that that paper of the multi-fed papers which was separated by the multi-feed separation roll 32 (or 33) and fed later by the multi-feed separation roll is now fed to the transfer station. However, the optical system does not operate during this period and a blank exposure is carried out so that no image is formed on the paper. When the timer 3 is turned off, the clutch OP for driving the optical system is again turned on by the drive signal from the output port $F_3$ so that the optical system starts the scan operation.

In a step 5, the timer 4 starts the timing operation. When the timer 4 is turned off after it has counted $N_4$ drum clocks, the presence or absence of the stop condition is checked. If the stop condition is not present, the clutch PC for driving the paper feed roll is turned on to carry out the paper feed operation. In the illustrated example, the stop condition is detected at this step and a stop flag F is set. Then the sequence goes to the step 6.

In step 6, the timer 2 is turned on to start the timing operation. When the timer 2 is turned off, the multi-feed condition is checked and if a multi-feed is detected, a multi-feed flag F is set. In the illustrated example, since the multi-feed is not detected at this step, the multi-feed flag is not set. As the timing sensor RHP is turned on, the clutch REG for driving the register roll is turned on to drive the register roll 37, and the paper fed in the second run is fed to the transfer station. The optical system returns to the home position and when the sensor OHP turns on the multi-feed flag is checked. If the multi-feed flag has been set, it is now reset and the sequence goes to the step 9. In the illustrated example, since the multi-feed flag has not been set, the sequence goes to the step 7 where the stop flag F is checked. In the illustrated example, since the stop flag is not set, the clutch OP for driving the optical system is turned off to stop the optical system.

In the illustrated example, the optical system is disabled with respect to that paper of the multi-fed papers which was separated and fed later and the blank exposure is carried out on that paper. Alternatively, the charger and the developer may be disabled.

In accordance with the above control sequence, a time loss due to the multi-feed can be minimized.

Figures 7, 8, 9, 10:
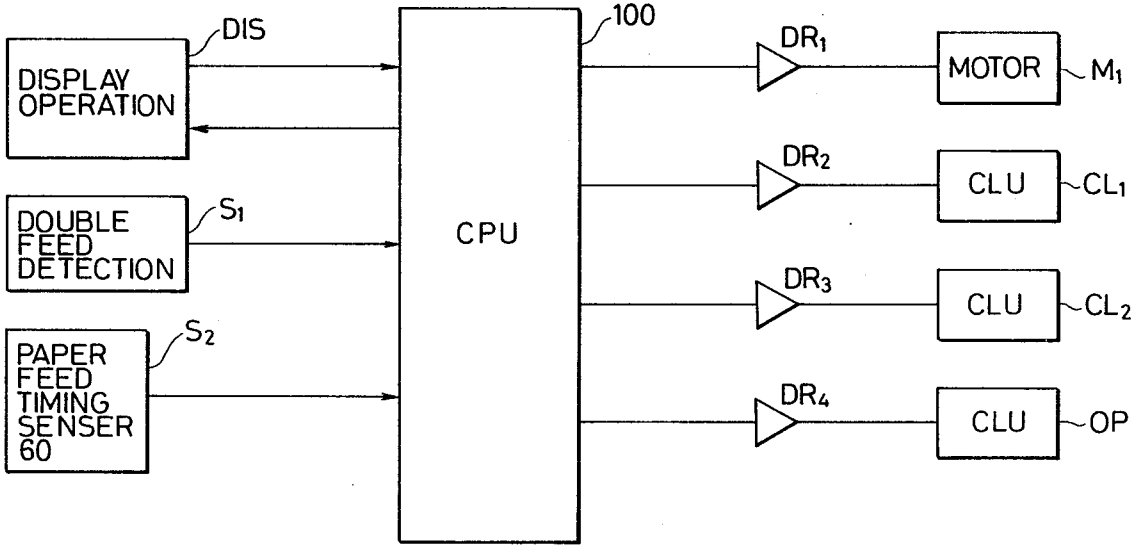
Figure 8A:
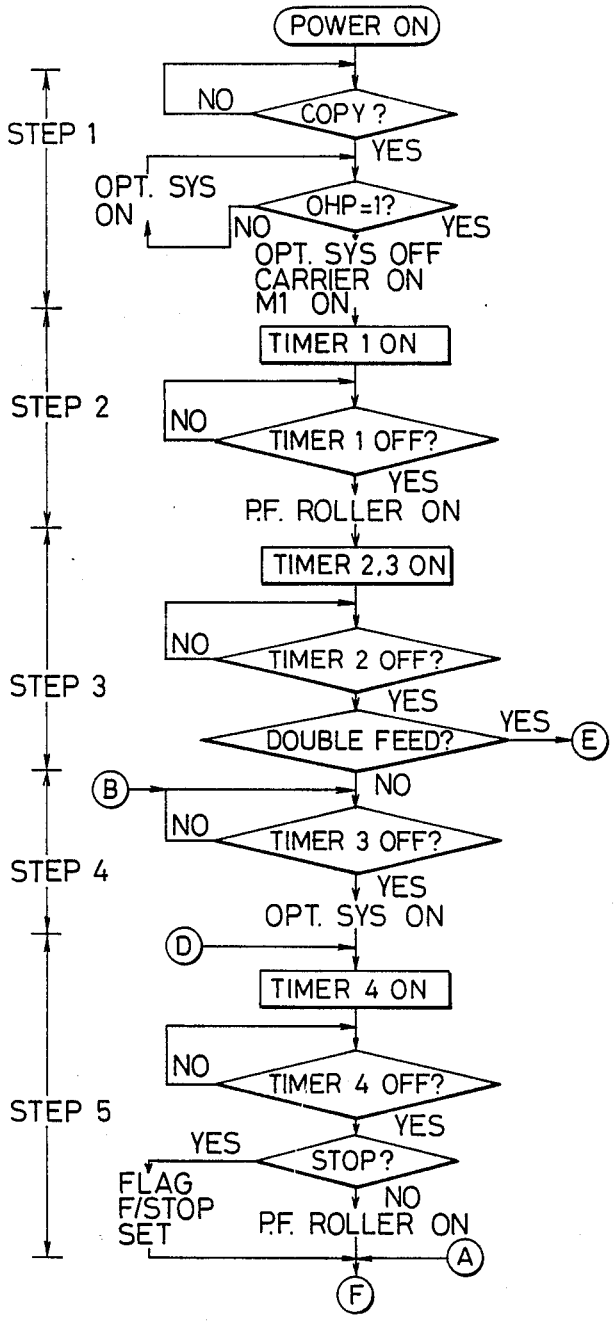
FIGS. 8A and 8B, shows a control flowchart for one embodiment of the invention.
Figure 8B:
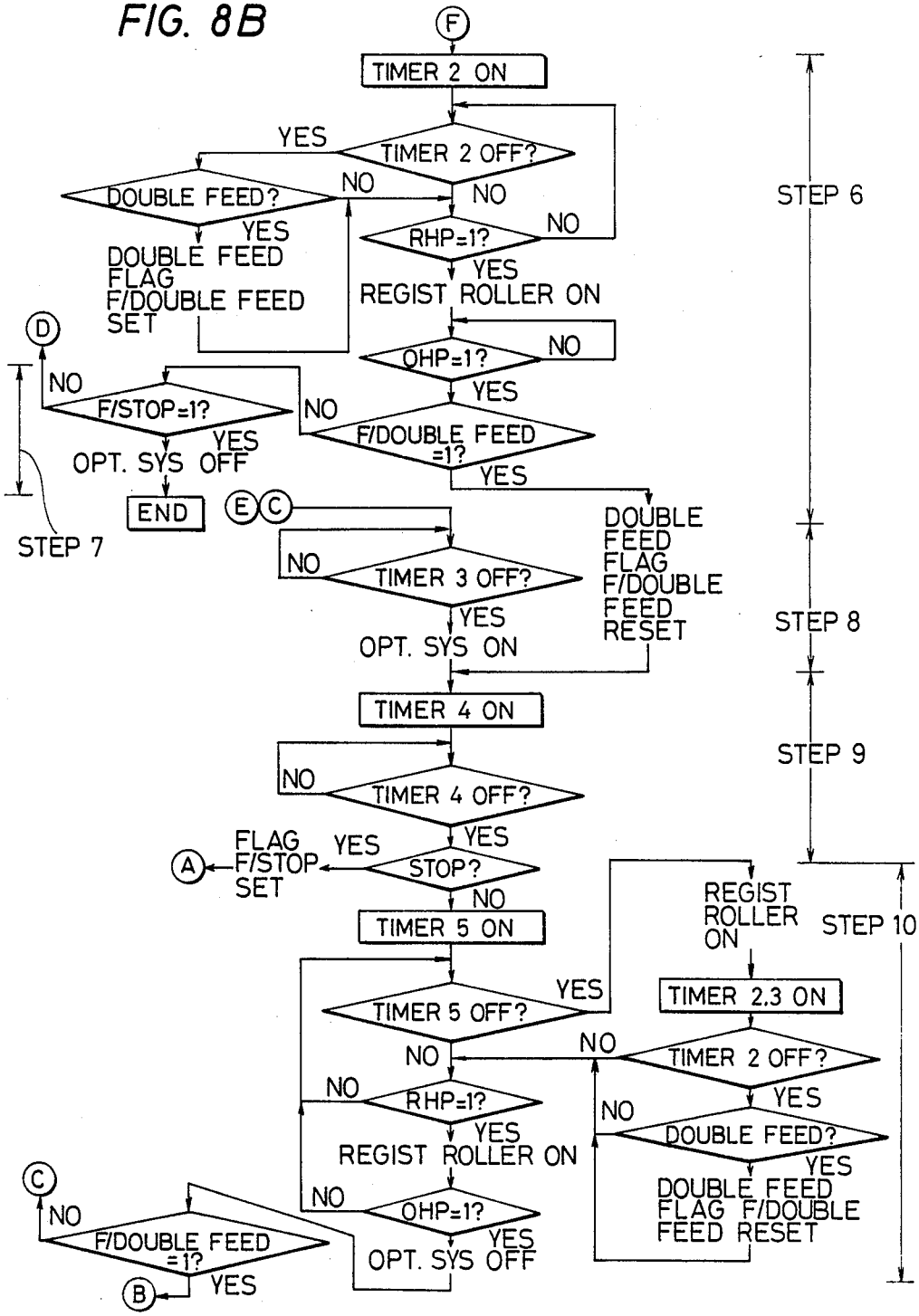
Figure 9:
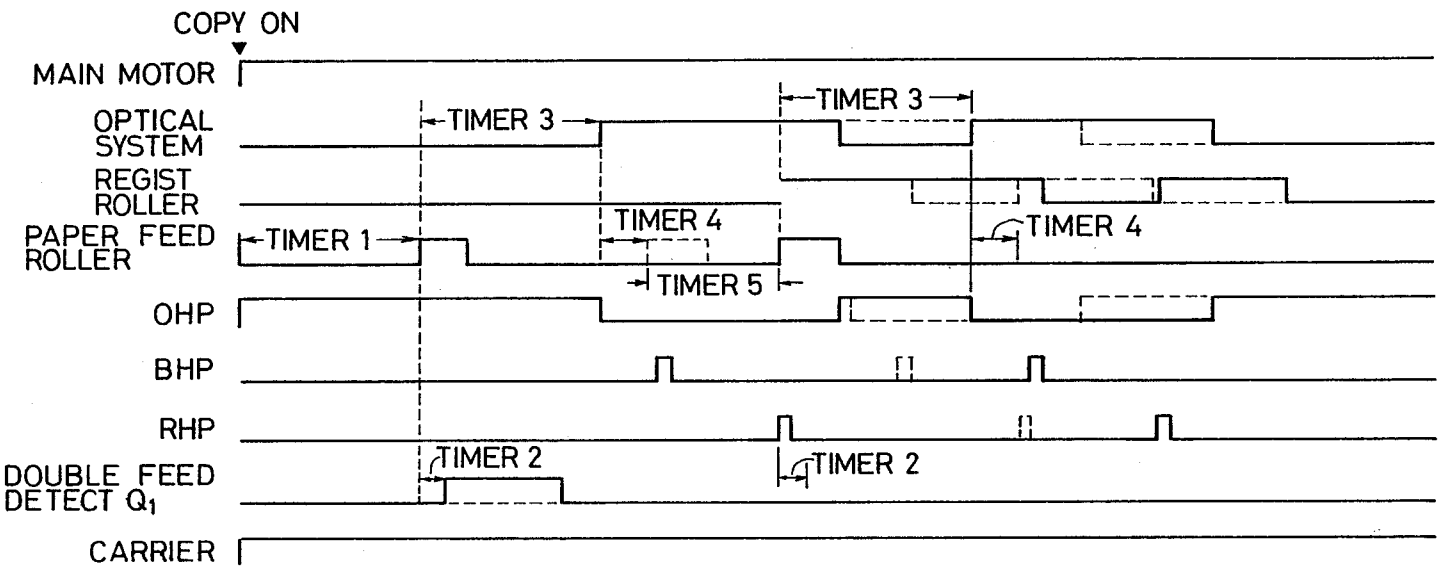
Figure 11:
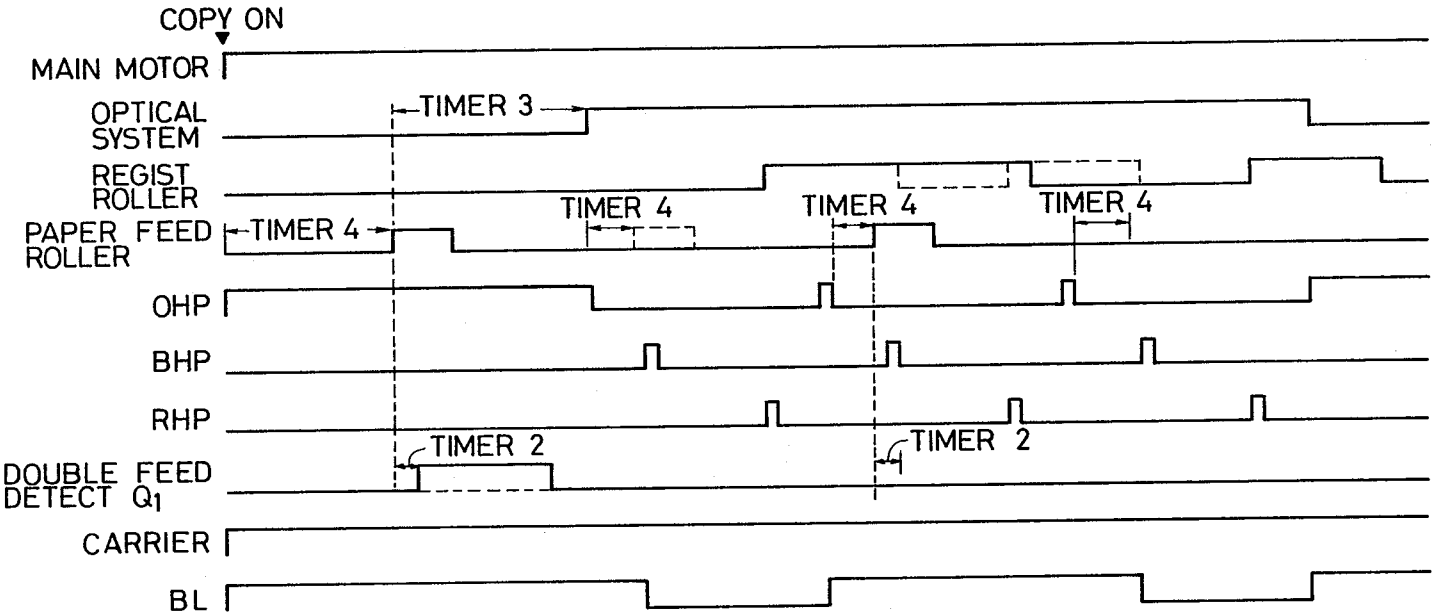
FIG. 11 shows a timing chart therefor.

FIG. 10 shows a control flow chart of another embodiment of the present invention and FIG. 11 shows a timing flow chart therefor. In the illustrated embodiment, when a multi-feed is detected, an image forming sequence is carried out on that paper of the multi-fed papers which was separated by the multi-feed separation roll and fed first and the scan of the optical system is carried out to the subsequently fed paper. However, during the scan of the optical system, the blank exposure is carried out to prevent toners from being deposited on the photosensitive drum 8. A normal image forming sequence is then recovered from the paper next fed. The operation is now explained with reference to FIGS. 10 and 11.

In a step 1, in the embodiment shown in FIG. 8, the number of copies, the size of copies and the density of copies are set and the copy key COPY is depressed. The input signals are applied to the input port $K_0$, thence the input data are loaded in an accumulator, not shown, in the microcomputer CPU and then stored in a selected area of the RAM, not shown. When the sensor OHP is turned on to detect that the optical system is at the home position, a drive signal is generated from the output port $F_0$ through the driver $DR_0$ to drive the main motor $M_1$. A drive signal is also issued from the output port $F_4$ through the driver $DR_4$ to turn on the clutch FC for driving the paper feed station so that the multi-feed separation roll 32 (or 33) and the paper feed roll arranged in the feed path between the paper feed station and the ejection station start to operate. A drive signal from the output port $F_5$ turns on the blank exposure lamp BL.

In a step 2, the timer 1 provided in the selected area of the RAM is turned on to start the timer operation to count $N_1$ drum clocks applied to the interruption port IA. The duration of the time measured by timer 1 corresponds to a time period from the time of the depression of the copy key to the time that the paper feed roll is turned off. When the timer 1 is turned off after it has counted $N_1$ drum clocks, a drive signal is issued from the output port $F_1$ through the driver $DR_1$ to turn on the clutch PC for driving the paper feed roll so that a first run of paper feed is carried out. In a step 3, the timers 2 and 3 provided in the selected areas of the RAM are turned on to start the timing operations to count $N_2$ and $N_3$ drum clocks, respectively. The duration of the time measured by timer 2 corresponds to a time period from the start of the paper feed to the arrival of the paper to the multi-feed separation roll 32 (or 33). The duration of the timer 3 corresponds to a timer period from the start of the paper feed to the time when of the optical system is turned on. When the timer 2 is turned off, the multi-feed in the first run of paper feed is checked. If the multi-feed is not detected, the sequence goes to a step 4. In the example of FIG. 9, the output of the multi-feed detection circuit $Q_1$ is "1" at this time and hence the multi-feed is detected. Thus, the sequence goes to a step 7.

In the step 7, when the timer 3 is turned off, a drive signal is issued from the output port $F_3$ through the driver $DR_3$ to turn on the clutch OP for driving the optical system so that the optical system is driven to carry out the exposure operation. In the present embodiment, the exposure is carried out when the optical system returns from the back position to the home position.

The sequence then goes to a step 8 in which the timer 4 provided in the selected area of the RAM is turned on to start the timer operation to count $N_4$ drum clocks. The duration of the timer 4 corresponds to a time period from the turn-on of the optical system to the start of the next paper feed. In the present example, since the multi-feed has been detected in the step 3, the clutch PC for driving the paper feed roll is not turned on when the timer 4 is turned off and the paper feed is not carried out. Then, the presence or absence of the stop condition is determined. If the stop condition is detected due to the completion of the preset number of copies, the depression of the stop key STOP or the jam, the sequence goes to a step 6.

In the example of FIG. 11, the stop condition is not detected and the sequence goes to a step 9 in which when the optical system reaches the back position the blank exposure lamp BL is turned off. The optical system is then driven in the reverse direction, and when the timing sensor RHP is on to change the input signal to the input port $S_3$ to "1", a drive signal is issued from the output port $F_2$ through the driver $DR_2$ to turn on the clutch REG for driving the register roll. As a result, the resist roll operates for a predetermined time period. Thus, that paper of the multi-fed papers which was separated by the multi-feed separation roll pair 32 and 32' (or 33 and 33') and fed first is now fed to the transfer station. As the optical system reaches the home position and again moves forwardly, the sensor OHP is turned off and the sequence goes to a step 5. At this time, the blank exposure lamp BL is again turned on by the drive signal from the output port $F_5$.

In the step 5, the timer 4 provided in the selected area of the RAM is turned on to start the timer operation to count $N_4$ drum clocks. The duration of the timer 4 corresponds to a time period from the turn-off of the sensor OHP to the start of the paper feed. When the timer 4 is turned off, the presence or absence of the stop condition is checked. If the stop condition is detected, the stop flag F is set in the selected area of the RAM. In the example of FIG. 11, the stop condition is not detected and a drive signal is issued from the output port $F_1$ to turn on the clutch PC for driving the paper feed roll to start a second run of paper feed.

In the step 6, the timer 2 is turned on and when it counts $N_2$ drum clocks the presence or absence of the multi-feed in the second run of paper feed is checked. If the multi-feed is detected, the multi-feed flag F is set in the selected area of the RAM. In the example of FIG. 11, the multi-feed is not detected and the timing, sensor RHP is turned on. However, at this time, the clutch REG for driving the register roll remains on to drive roll 37 so that the paper separated by the multi-feed separation roll pair 32 and 32' (or 33 and 33') and fed later is now fed to the transfer station. Since the blank exposure lamp BL is on at this time, no electrostatic latent image is formed on the photosensitive drum 8. Then, as the sensor OHP is turned on to change the input signal to the input port $S_1$ to "1", the multi-feed flag F is checked. In the example of FIG. 11, the multi-feed flag F is not set. Then, the stop flag F is sensed. Since it is also not in the set status, the sequence goes to the step 5.

The timer 4 is set in the same manner as described above. When the timer 4 is turned off, the presence or absence of the stop condition is checked. In the example of FIG. 11, the stop condition is detected at this time and the stop flag F is set. In step 6, the timer 2 is turned on. When the optical system reaches the back position and the sensor BHP is turned on, the blank exposure lamp BL is turned off. The timing sensor RHP is turned on to drive the register roll 37 so that the paper fed in the second run of paper feed is now fed to the transfer station. When the optical system reaches the home position to turn on the sensor OHP, the multi-feed flag F and the stop flag F are checked. In the example of FIG. 11, the stop flag F is, in the set status at this time. Accordingly, the clutch OP for driving the optical system is turned off to stop the optical system. The blank exposure lamp BL is again turned on.

In the present embodiment, no image is formed on that paper of the multi-fed papers which was separated by the multi-feed separation roll and fed later by turning on the blank: exposure lamp. Alternatively, other means which contribute to the image formation, such as charger, may be disabled.

According to the above arrangement, the control is simple because the optical operation of the system need not be stopped.

In the present embodiment, the number of copies is counted by counting the number of paper feed operations.

In the embodiments shown in FIGS. 8–11, when the multi-feed is detected, the multi-fed papers are separated from each other and the original image is reproduced on one of the multi-fed papers and the original image is not reproduced on the other papers but they are simply ejected. Accordingly, no paper is wasted. Even if the multi-feed occurs, the normal sequence can be automatically recovered. Therefore, unlike the prior art apparatus, it is not necessary to check the jam when the multi-feed occurs in order to stop the apparatus. Thus, the present apparatus is easy to handle.

When the multi-feed is detected, the sequence may be controlled in the following manner. After the paper which was separated by the multi-feed roll and fed first (first paper) has been fed past the register roll, the register roll and the feed path extending from the paper feed station to the register roll are stopped. Then, they are driven again in timed relation with a normal copy cycle so that the paper which was separated and fed later (second paper) is fed by the register roller to recover the normal sequence. This control sequence is now explained below.

FIG. 1-2 shows a sectional view of a copying machine which carries out the above control sequence. In FIG. 1-2, the like numerals to those of FIG. 1-1 designate the like elements. Numeral 52 denotes a reflection type paper sensor which provides a "1" signal to the control unit when it senses a paper. The sensor 52 controls tne operations of the register roll 37 and the feed path between the paper feed station and the register roll 37.

FIG. 7-2 shows a block diagram of the control unit. A signal generated by a photosensor comprising a disc $PT_3$ which is rotated with the follower roll 33' of the multi-feed separation roll pair 33 and 33', a light emitting element $L_2$ and a photosensing element $D_2$, is detected by a multi-feed detection circuit $Q_2$, and a detection signal thereof is supplied to an input port $S_5$. Connected to an input port $S_6$ is a reflection type sensor RS (52 in FIG. 1) comprising a light emitting device $L_4$ and a photosensing device $D_4$. When the sensor RS senses a paper, it provides a "1" signal to the input port $S_6$.

Symbol $FC_1$ denotes a clutch driving a feed path extending from the paper feed station to the register roll 37.

The other constructions are identical to those shown in FIG. 7-1.

Figure 12A:
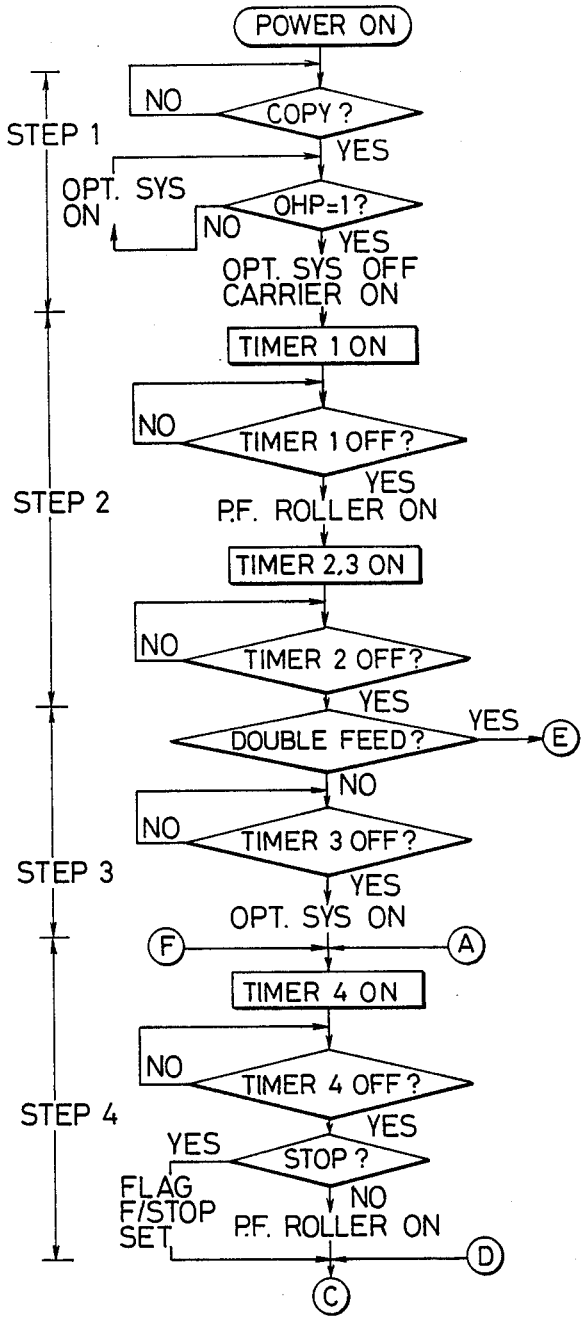
FIGS. 12A, 12B and 12C, shows a control flowchart for another embodiment of the invention.
Figure 12B:
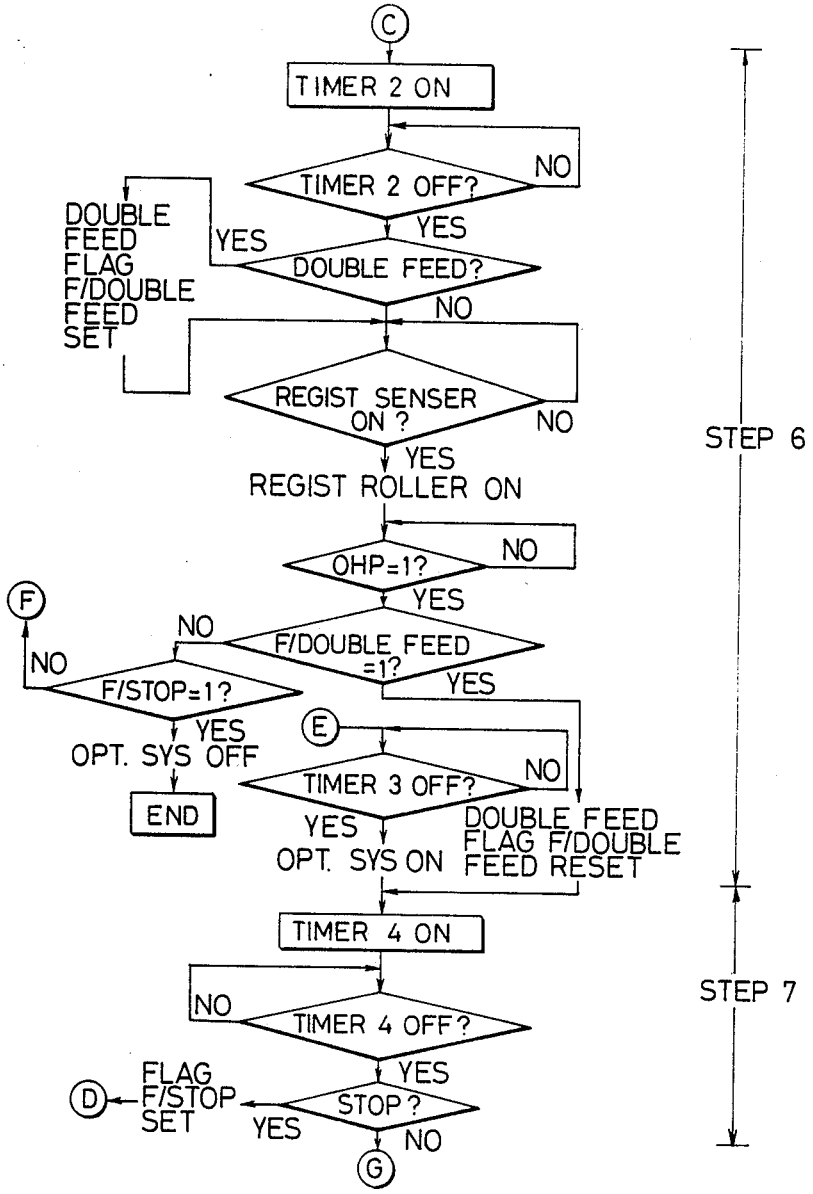
Figure 12C:
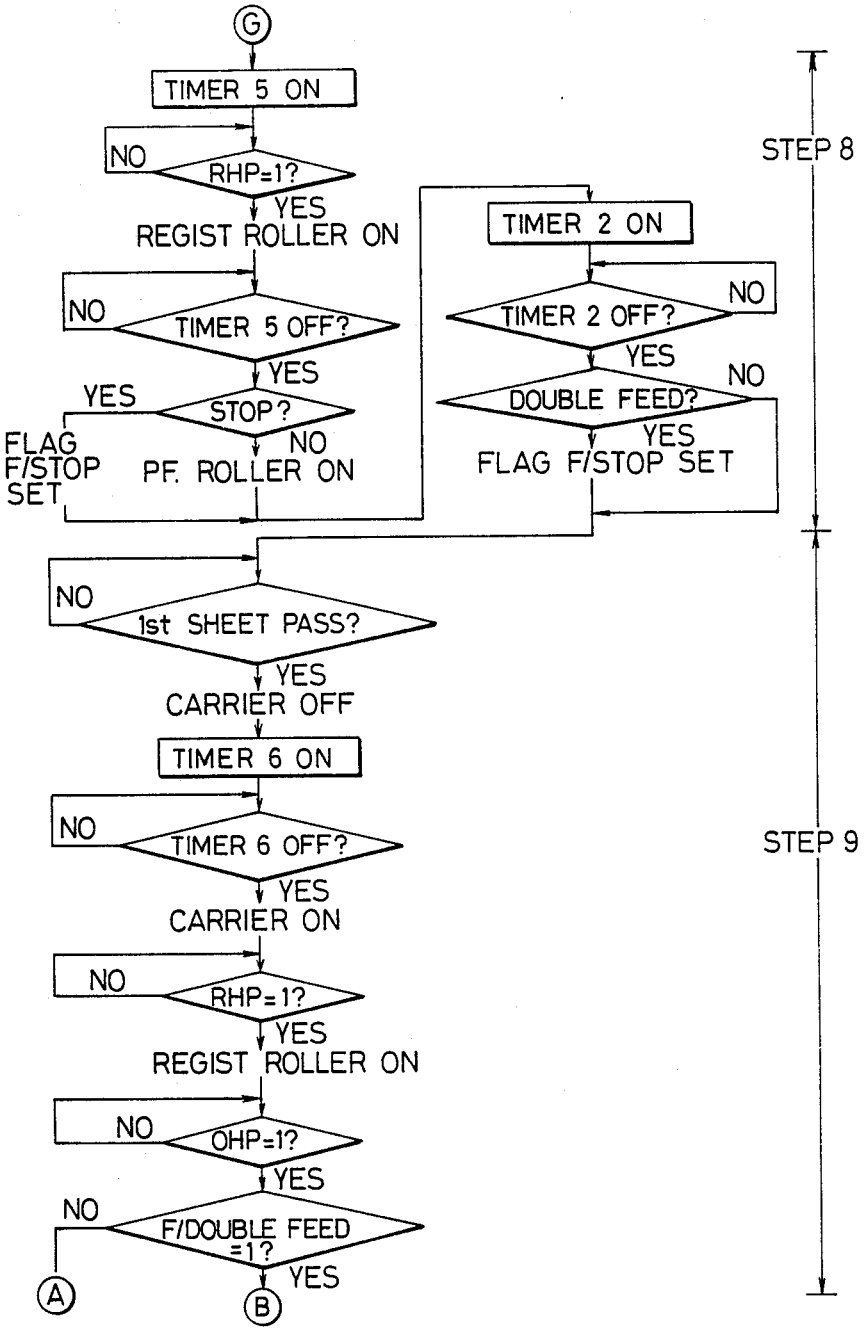
Figure 13:
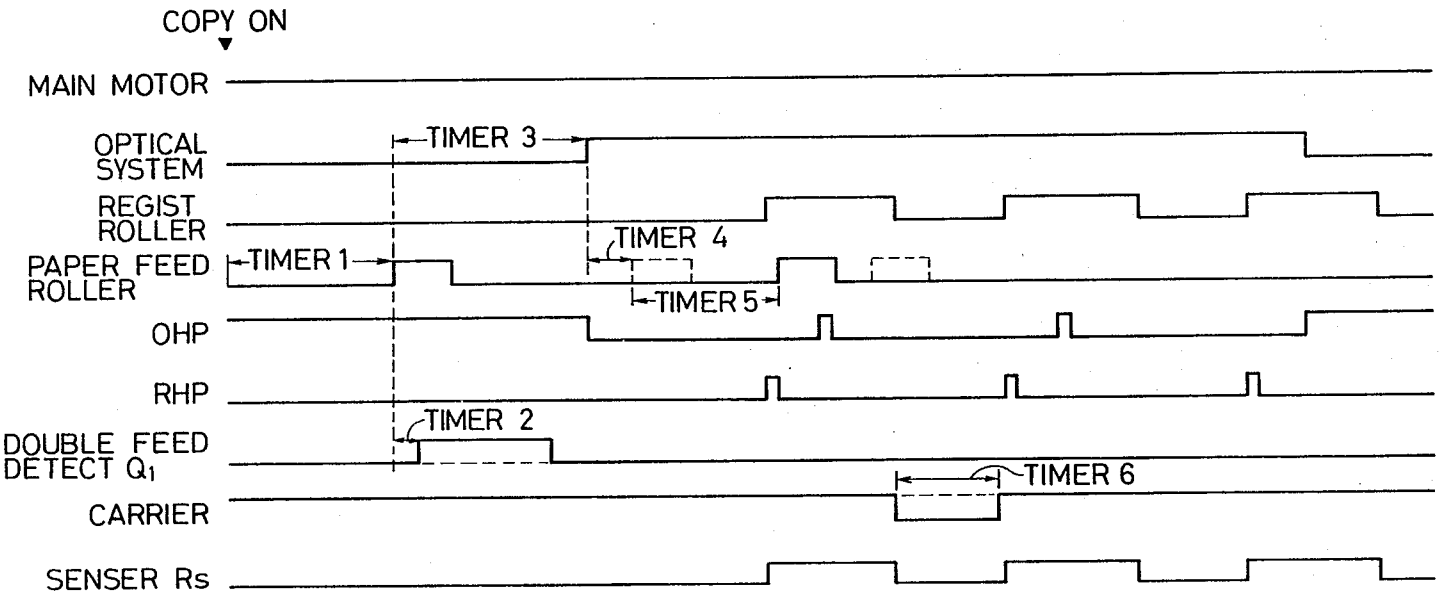
FIG. 13 shows a timing chart therefor.

FIG. 12 shows a control flow chart for explaining the present embodiment and FIG. 13 shows a time chart therefor.

In a step 1, the number of copies, the size of copies and the density of copies are set. When the copy key COPY is depressed, the input signals are applied to the input port $K_0$ and the data are loaded to the accumulator, not shown, in the microcomputer CPU and then stored in the selected area of the RAM, not shown. When the sensor OHP is turned on to indicate that the optical system is at the home position, a drive signal is issued from the output port $F_0$ through the driver $DR_0$ to drive the main motor $M_1$. A drive signal is also issued from the output port $F_4$ through the driver $DR_4$ to turn on the clutch FC for driving the feed station. As a result, the multi-feed roll 32 (or 33) and the paper feed roll arranged in the feed path between the paper feed station and the ejection station start operation.

In a step 2, the timer 1 provided in the selected area of the RAM is turned on to start the timer operation to count $N_1$ drum clocks applied to the interruption port IA. The duration of the timer 1 corresponds to a time period from the depression of the copy key to the turn-on of the paper feed roll. When the timer 1 is turned off after it has counted $N_1$ drum clocks, a drive signal is issued from the output port $F_1$ through the driver $DR_1$ to turn on the clutch PC for driving the paper feed roll to initiate a first run of paper feed. The timers 2 and 3 provided in the selected areas of the RAM are turned on to start the timer operations to count $N_2$ and $N_3$ drum clocks, respectively. The duration of the timer 2 is set to a time period from the start of the paper feed to the arrival of the paper at the multi-feed separation roll 32 (or 33). The duration of the timer 3 is set to a time period from the start of the paper feed to the turn-on of the optical system. When the timer 2 is turned off, the multi-feed in the first run of paper feed is checked, and if the multi-feed is not detected the sequence goes to a step 4. In the example of FIG. 13, the output of the multi-feed detection circuit $Q_1$ is "1" at this time. Accordingly, a multi-feed is detected and the sequence goes to a step 6.

In the step 6, when the timer 3 is turned off, a drive signal is issued from the output port through the driver $DR_3$ to turn on the clutch OP for driving the optical system. As a result, the optical system is driven to carry out the exposure operation. In the present embodiment, the text exposure is carried out during the backward movement of the optical system from the back position to the home position. The sequence then goes to a step 7 in which the timer 4 provided in the selected area of the RAM is turned on to start the timer operation to count $N_4$ drum clocks. The duration of the timer 4 is set to a time period from the turn-on of the optical system to the start of the next paper feed. When the timer 4 is turned off, the stop condition is checked. If the stop condition is detected due to the completion of the preset number of copies, the depression of the stop key STOP or the jam, the stop flag F is set and the sequence goes to step 5. In the example of FIG. 13, the stop condition is not detected and the sequence goes to a step 8 in which the timer 5 provided in the selected area of the RAM is turned on to start the timer operation to count $N_5$ drum clocks. The duration of the timer 5 is set to a time period from the turn-off of the timer 4 by the detection of the multi-feed to the start of the next paper feed. When the timing sensor RHP is turned on to change the input signal to the input port $S_3$ to "1", a drive signal is issued from the output port $F_2$ to the driver $DR_2$ to drive the register roll 37 for a predetermined time period. As a result, of the papers fed in the first run of paper feed, the first sheet which was separated by the multi-feed roll pair 32 and 32' (or 33 and 33') and fed first is now fed to the transfer station. When the timer 5 is turned off, the stop condition is checked. In the example of FIG. 13, the stop condition is not detected and a drive signal is issued from the output port $F_1$ to turn on the clutch PC for driving the paper feed roll and a second run of paper feed is carried out by the paper feed roll 30 (or 31). When the timer 2 is turned on, the multi-feed in the second run of paper feed is checked, and if the multi-feed condition is checked the multi-feed flag F is set. In the example of FIG. 13, a multi-feed is not detected in the second run of the paper feed and hence the multi-feed flag F is not set. When a rear edge of the first paper is detected by the sensor RS located behind the register roll 37, the clutch FC for driving the feed station is turned off to stop the feed station. Then, the timer 6 provided in the selected area of the RAM is turned on to start the timer operation to count $N_6$ drum clocks. The duration of the timer 6 is set to a time period required to stop the feed station. Before the timer 6 is turned off, the multi-feed condition of the second run of paper feed is checked. In the example of FIG. 13, a multi-feed is not detected in the second run of paper feed. When the timer 6 is turned off, a drive signal is issued from the output port $F_4$ to turn on the clutch FC for driving the feed station to drive again the feed station. When the timing sensor RHP is turned on, the clutch REG for driving the register roll is turned on and the second paper of the papers fed by the register roll 37 in the first run of paper feed, which was separated by the multi-feed separation roll pair 32 and 32' (or 33 and 33') and fed later, is now fed to the transfer station. As the optical system returns to the home position and the sensor OHP is turned on to change the input signal to the input port $S_1$ to "1", the multi-feed flag F is checked and if it is in the set status the sequence goes to a step 7. In the example of FIG. 13, the multi-feed flag F is not in the set condition and the sequence goes to the step 4.

In the step 4, the timer 4 is turned on. When the timer 4 is turned off after it has counted $N_4$ drum clocks, the stop condition is checked. In the example of FIG. 13, the stop condition is detected at this time and the sequence goes to the step 5. In the step 5, the timer 2 is turned on, and when it is then turned off, the multi-feed condition is checked. In the example of FIG. 13, the multi-feed is not detected because a third run of paper feed was not carried out in the step 4. When the timing sensor RHP is turned on, the clutch REG for driving the register roll is turned on so that the paper fed by the register roll 37 in the second run of paper feed is fed to the transfer station. When the optical system returns to the home position to turn on the sensor OHP, the multi-feed flag F is checked. If it is in the set status, the sequence goes to the step 7. In the example of FIG. 13, the multi-feed flag F is not in the set condition. Then, the stop flag is checked. If it is not in the set condition, the sequence goes to the step 4. In the example of FIG. 13, it is in the set status. Thus, the clutch OP for driving the optical system is turned off to stop the optical system.

In the present embodiment, the number of copies is counted by counting the number of the paper feed operations. When a multi-feed is detected, the count is incremented by one. The paper feed timing after the multi-feed has been detected is faster than the timing before the multi-feed is detected by a time period corresponding to the stop time of the feed section. Accordingly, a time loss due to the multi-feed is reduced.

Figure 14A:
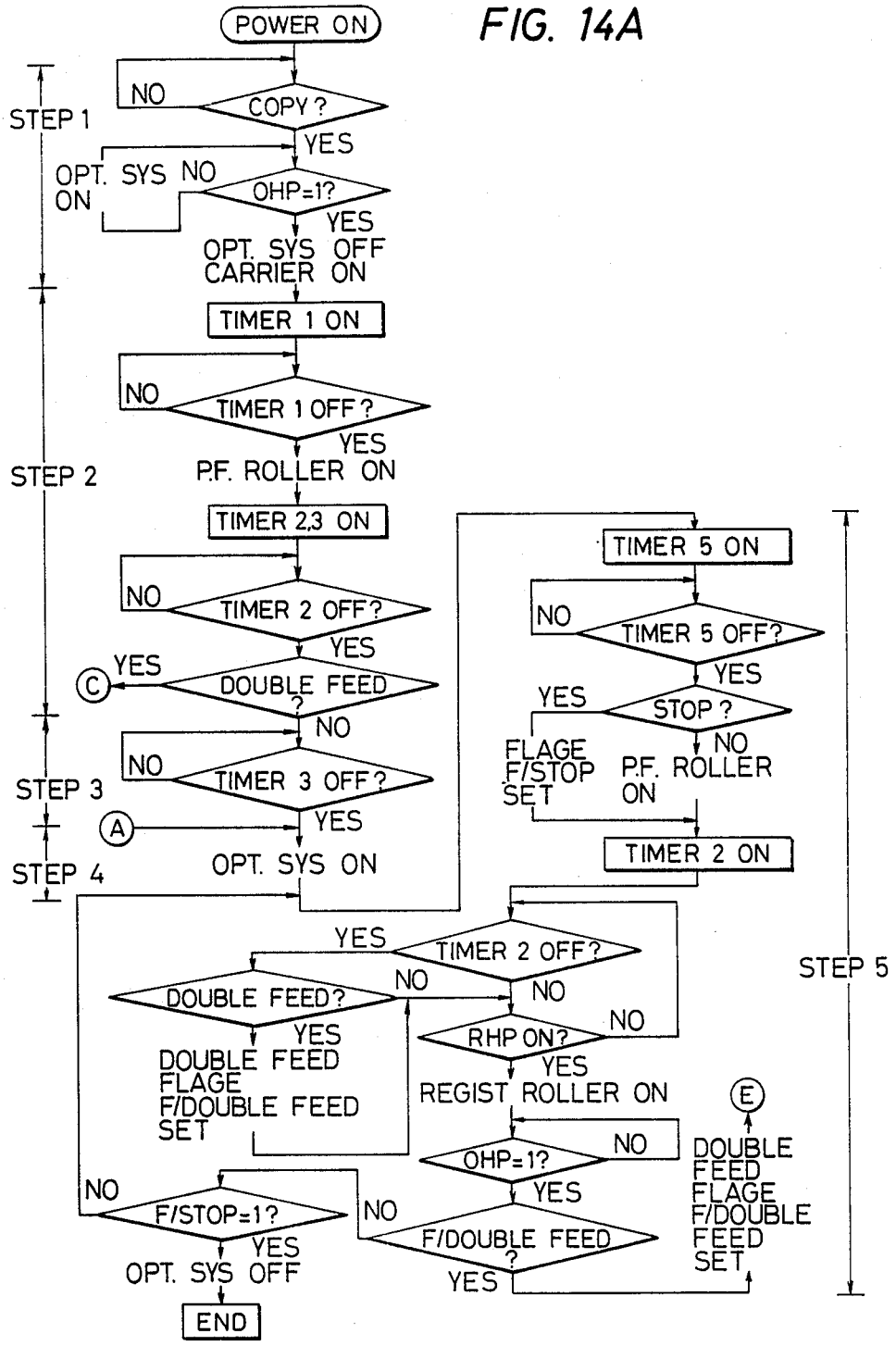
FIGS. 14A and 14B, shows a control flowchart for another embodiment of the invention.
Figure 14B:
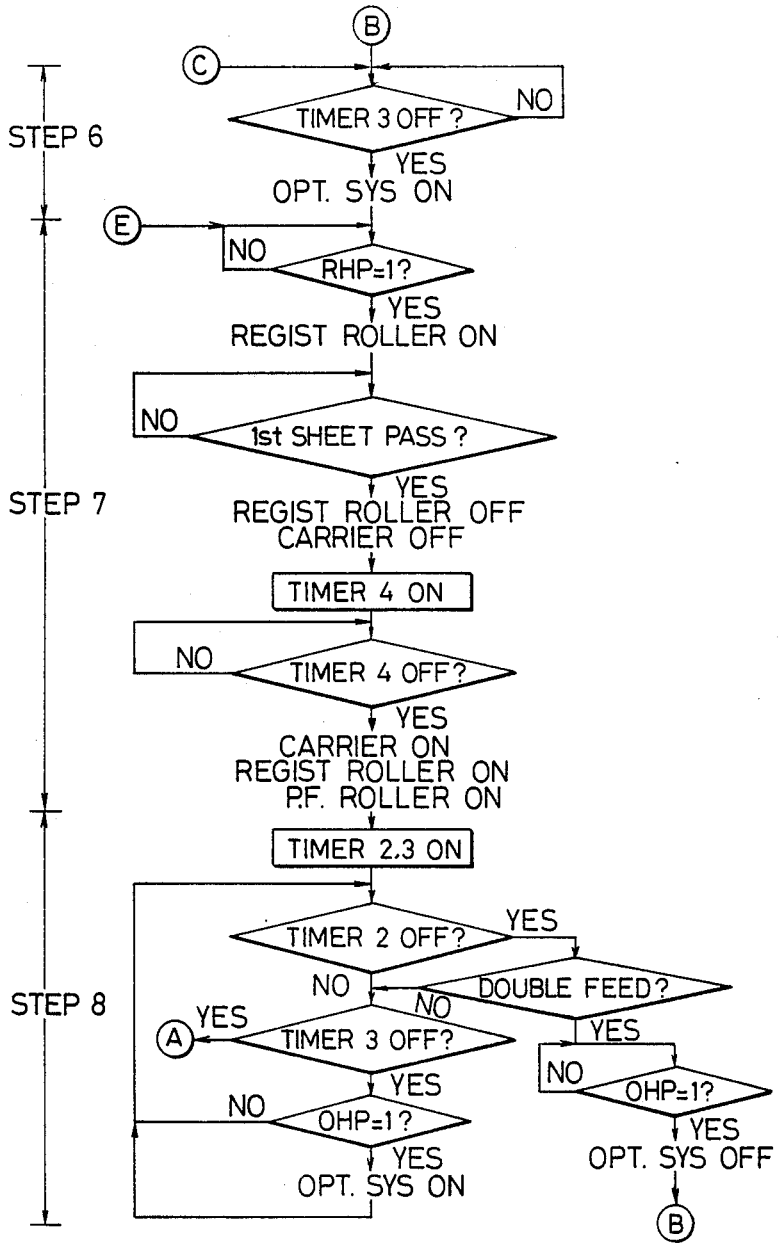
Figure 15:
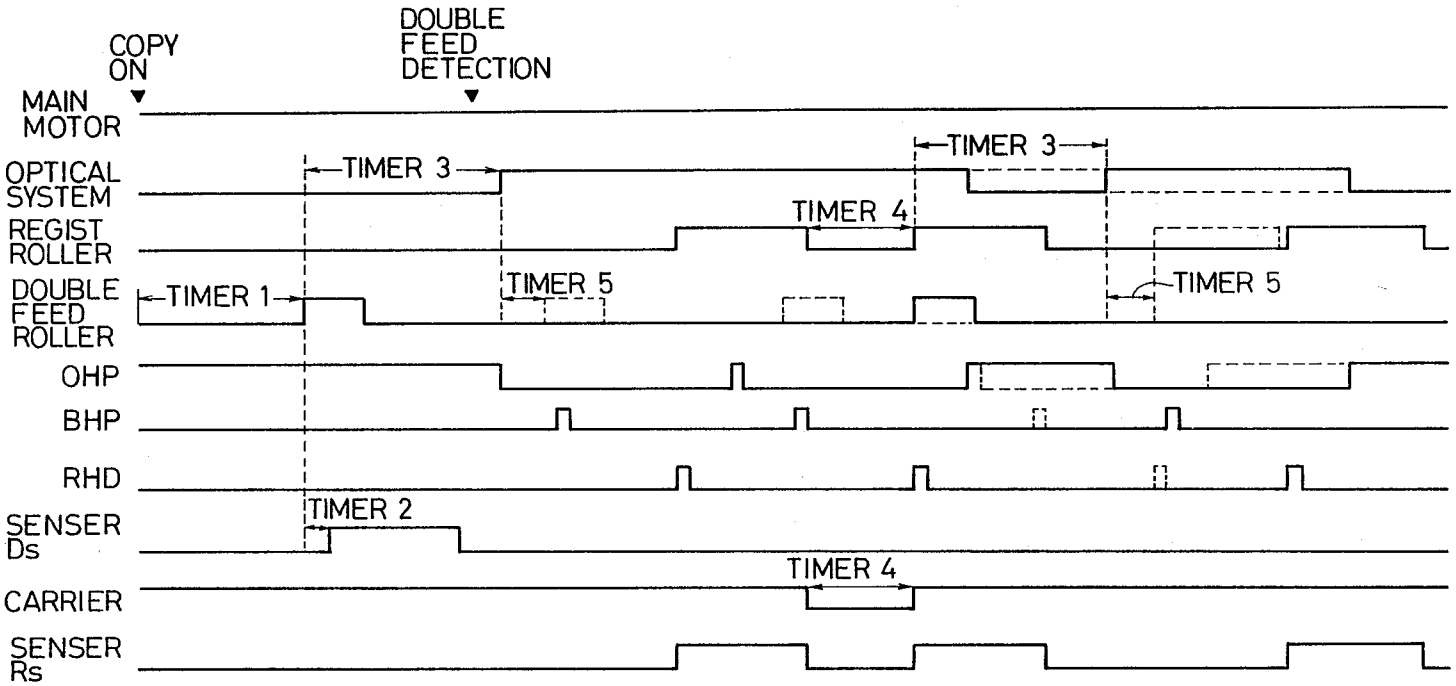
FIG. 15 shows a timing chart therefor.

FIG. 14 shows a control flow chart of another embodiment of the present invention, and FIG. 15 shows a timing chart therefor. In the present embodiment, when the multi-feed is detected, the register roll and the feed path extending from the paper feed station to the register roll are stopped after the paper separated by the multi-feed separation roll and fed first (first paper) has been fed past the register roll. Thereafter, they are driven again at a predetermined timing, that is, at the turn-on of the timing sensor for controlling the register roll, and the paper which was separated and fed later (second paper) is fed by the register roll. In this manner, the normal sequence is recovered. The paper feed after the multi-feed is also resumed at this timing. The optical system is temporarily stopped to synchronize it with the paper feed timing after the multi-feed. The operation is now explained with reference to FIGS. 14 and 15.

In a step 1, like in the embodiment of FIG. 12, the number of copies, the size of copies and the density of copies are set. When the copy key COPY is depressed, the input signals are applied to the input port $K_0$ and the input data are loaded to the accumulator, not shown, in the microcomputer, and then they are stored in the selected areas of the RAM, not shown. When the sensor OHP is turned on to indicate that the optical system is at the home position, a drive signal is issued from the output port $F_0$ through the driver $DR_0$ to drive the main motor $M_1$. A drive signal is also issued from the output port $F_4$ through the driver $DR_4$ to turn on the clutch FC for driving the feed station. Thus, the multi-feed separation roll 32 (or 33) and the paper feed roll arranged in the feed path between the paper feed station and the ejection station start to operate.

In a step 2, the timer 1 provided in the selected area of the RAM is turned on to start the timer operation to count $N_1$ drum clocks applied to the interruption port IA. The duration of the timer 1 corresponds to a time period from the depression of the copy key to the time at which the paper feed roll is turned on. When the timer 1 is turned off after it has counted $N_1$ drum clocks, a drive signal is issued from the output port $F_1$ through the driver $DR_1$ to turn on the clutch PC for driving the paper feed roll. As a result, a first run of paper feed is carried out. The timers 2 and 3 provided in the selected areas of the RAM are turned on to start the timer operations to count $N_2$ and $N_3$ drum clocks, respectively. The duration of the timer 2 is set to a time period from the start of the paper feed to the arrival of the paper at the multi-feed roll 32 (or 33). The duration of the timer 3 is set to a time period from the start of the paper feed to the time that the optical system is turned on. When the timer 2 is turned off, the multi-feed in the first run of paper feed is checked. If the output of the multi-feed detection circuit $Q_1$ is "1" when the timer 2 is turned off, the multi-feed is detected. In the example of FIG. 15, the output of the multi-feed detection circuit $Q_1$ is "1" and the sequence goes to a step 6.

In the step 6, when the timer 3 is turned off, a drive signal is issued from the output port $F_3$ through the driver $DR_3$ to turn on the clutch OP for driving the optical system so that the optical system is driven to carry out the exposure operation. In the present embodiment, the exposure is carried out in the backward movement of the optical system from the back position to the home position.

Then, the sequence goes to a step 7 in which the timing sensor RHP is turned on to change the input signal to the input port $S_3$ to "1". As a result, a drive signal is issued from the output port $F_2$ to the driver $DR_2$ to turn on the clutch REG for driving the register roll so that the register roll 37 starts the operation. Thus, the first paper separated by the multi-feed separation roll 32 (or 33) and fed first is now fed to the transfer station. When the sensor RS positioned behind the register roll 37 detects a rear edge of the first paper, the clutch REG for driving the register roll and the clutch FC for driving the feed station are turned off to stop the register roll 37 and the first feed station. The timer 4 provided at the selected area of the RAM is turned on to start the timer operation to count $N_4$ drum clocks. The duration of the timer 4 corresponds to the stop time period of the register roll 37 and the feed station. When the timer 4 is turned off, a drive signal is issued from the output port $F_1$ to the driver $DR_1$ to turn on the clutch PC for driving the paper feed roll so that a second run of paper feed is carried out by the paper feed roll 30 (or 31). At the same time, drive signals are issued from the output ports $F_2$ and $F_4$ to drive the register roll 37 and the first feed station so that the second paper separated and fed later is now fed to the transfer station.

The sequence then goes to a step 8 in which the timers 2 and 3 are turned on. Before the timer 2 is turned off, the optical system reaches the home position and the sensor DHP is turned on to change the input signal to the input port $S_1$ to "1". Accordingly, the clutch OP for driving the optical system is turned off to stop the optical system. When the timer 2 is turned off, the multi-feed condition of the second run of paper feed is checked. In the example of FIG. 15, the multi-feed is not detected in the second run of paper feed. Accordingly, the sequence goes to step 4 after the timer 3 has been turned off.

In the step 4, a drive signal is issued from the output port $F_3$ to turn on the clutch OP for driving the optical system. In a step 5, the timer 5 provided in the selected area of the RAM is turned on to start the timer operation to count $N_5$ drum clocks. The duration of the timer 5 corresponds to a time period from the turn-off of the optical system to the start of the next paper feed. When the timer 5 is turned off, the presence or absence of the stop condition is checked. The stop condition is detected by the completion of the preset number of copies, the depression of the stop key STOP or the jam. If the stop condition is not detected, the clutch PC for driving the paper feed roll is turned on to carry out the paper feed. In the example of FIG. 15, the stop condition is detected at this time and the stop flag F is set in the selected area of the RAM. Then the timer 2 is turned on. Before the timer 2 is turned off, the timing sensor RHP is turned on to drive the register roll 37 so that the paper fed in the second run of paper feed is fed to the transfer station. When the timer 2 is turned off, the multi-feed condition is checked. In the example of FIG. 15, since a third run of paper feed is not carried out, the multi-feed is not detected. When the optical system reaches the home position, the multi-feed flag F and the stop flag F are checked. If the multi-feed flag F is in the set status, it is reset and the sequence goes to the step 7. If the stop flag F is not in the set status, the sequence returns to the beginning of the step 5. In the example of FIG. 15, the stop flag F is in the set status. Therefore, the clutch OP for driving the optical system is turned off to stop the optical system.

In the present embodiment, the number of copies is counted by counting the number of the paper feed operations, and when a multi-feed is detected the count is incremented by one.

In accordance with the above arrangement, the timing control in the restart of drive is facilitated.

Alternatively, if the multi-feed is detected in the last run of paper feed, the paper feed station and the register roll may not be stopped but kept in operation to eject the paper.

In the embodiment shown in FIGS. 12 to 15, the multi-fed papers are separated from each other and when it is detected that the paper fed first has been fed from the feed station to the image forming station, the feed station is stopped. Thereafter, the feed station is driven again at an appropriate timing to form the image on the remaining paper. Accordingly, no paper is wasted. Further, since the normal sequence is automatically recovered, the apparatus need not be stopped when the multi-feed is detected. Accordingly, the present apparatus is easy to handle.

In the embodiment described above, the roll 32 or 33 has a separation function for the multi-fed papers. Alternatively, the roll 36 may have the separation function for the multi-fed papers to control the operation when the multi-feed is detected. This control sequence is now explained below.

FIG. 1-3 shows a sectional view of a copying machine in which the roll 36 has the separation function for the multi-fed papers while the rolls 32 and 33 are conventional feed rolls. Numeral 150 denotes a reflection type sensor which provides a "1" signal to the control unit when it detects the paper. In the present embodiment, the multi-feed is determined by the time at which the paper passes the sensor 150. In FIG. 1-3, the like numerals to those of FIG. 1-1 designate the like elements.

FIG. 7-3 shows a block diagram of the control unit. Connected to the input port $S_4$ is a reflection type sensor $DS_1$ (50 in FIG. 1) comprising the light emitting device $L_2$ and the photosensing device $D_2$. When the sensor $DS_1$ detects the paper, it provides an "L" level signal to an inverter I which provides an inverted signal to the port $S_4$. The output from the sensor 50 is sampled at a predetermined timing as will be described later. If the paper is detected at this timing, the multi-feed is detected. Connected to the output ports $F_4$ and $F_5$ of the microcomputer CPU are a clutch FFC for driving a first feed station extending from the paper feed station to the multi-feed separation roll 36 and a clutch SFC for driving a second feed station extending from the multi-feed separation roll 36 to the ejection station. The other constructions are identical to those shown in FIG. 7-1.

Figure 16A:
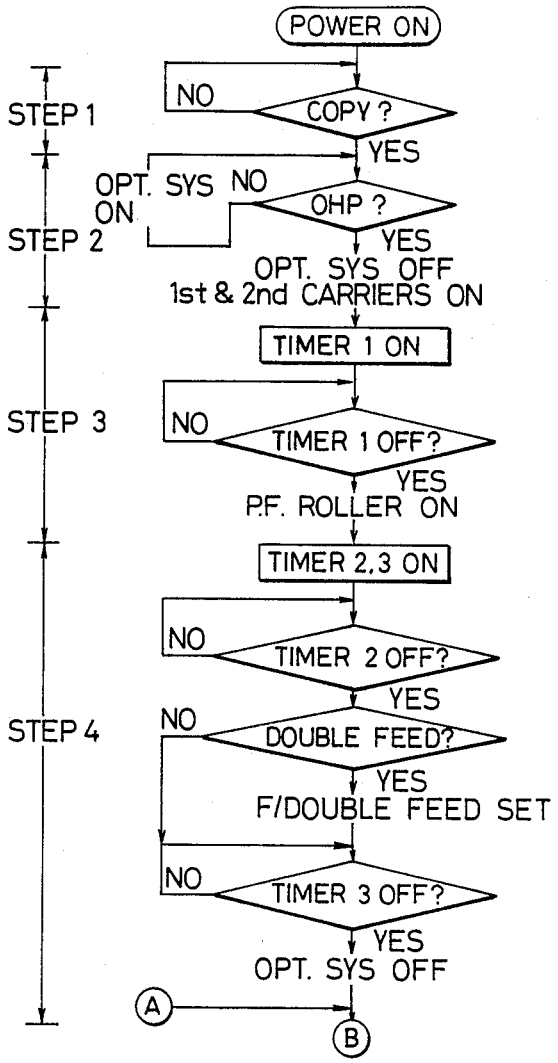
FIGS. 16A and 16B, shows a control flowchart for another embodiment of the invention.

FIG. 16 shows a control flow chart in which, when the multi-feed is detected, the first feed station is stopped at the time when the paper is fed from the cassette 28 or the deck 29. FIG. 17 shows a timing chart therefor, in which three copies are to be reproduced and the multi-feed occurs in the first run of paper feed. The operation is now explained with reference to FIGS. 16 and 17.

In a step 1, when the start of copy button COPY is depressed, an input signal is applied to the input port $K_0$ and the input data is loaded to the accumulator, not shown, in the microcomputer CPU and then stored in the selected area of the RAM, not shown.

In a step 2, it is checked if the optical system is at the home position, that is, if the microswitch OHP is on. If the optical system is not at the home position, a drive signal is issued from the output port $F_3$ of the microcomputer CPU through the driver $DR_3$ to turn on the clutch OP for driving the optical system. Thus, the optical system is driven until it returns to the home position. Then, the optical system is stopped and drive signals are issued from the output ports $F_4$ and $F_5$ through the drivers $DR_4$ and $DR_5$ to turn on the clutches FFC and SFC for driving the first and second feed stations. Thus, the feed rolls arranged on the feed path begin to operate.

In a step 3, the timer 1 provided in the selected area of the RAM is turned on to start the timer operation to count $N_1$ drum clocks applied to the interruption port IA. The duration of the timer time measured by 1 corresponds to a time period from the depression of the copy key to the turn-on of the paper feed roll. When the timer 1 is turned off, a drive signal is issued from the output port $F_1$ to the clutch PC for driving the paper feed roll so that the paper feed roll 30 (or 31) is driven to carry out a first run of paper feed.

In a step 4, the timers 2 and 3 provided in the selected areas of the RAM are turned on to start the timer operations to count $N_2$ and $N_3$ drum clocks, respectively. The duration of the timer 2 is set to be slightly longer than a time period from the start of a normal paper feed of a longest size paper acceptable to the copying machine to the detection of a rear edge of the paper by the paper sensor 150. The duration of the timer 3 is set to a time period from the start of the paper feed to the time at which the optical system is turned on. When the timer 2 is turned off, the presence or absence of multi-feed, that is, the level of the output signal of the paper sensor 150 applied to the input port $S_4$ is checked. If it is "H" level, that is, if the paper sensor 150 detects the paper, the multi-feed is detected and the multi-feed flag F provided in the selected area of the RAM is set. In the present example, the multi-feed is detected at this time and the multi-feed flag F is set. When the timer 3 is turned off, a drive signal is issued from the output port $F_3$ through the driver $DR_3$ to turn on the clutch OP for driving the optical system. Thus the optical system is driven to carry out the exposure operation. The text exposure is carried out when the optical system returns from the back position to the home position.

In a step 5, the timer 4 provided in the selected area of the RAM is turned on to start the timer operation to count $N_4$ drum clocks. The duration of the timer 4 is set to a time period from the turn-on of the optical system to the start of the next paper feed. When the timer 4 is turned off, it is checked if a stop signal has been produced by the completion of the preset number of copies, the depression of the stop key or the jam. If the stop signal is detected, the sequence goes to a step 6. If the stop signal is not detected, the set status of the multi-feed flag F is checked. If it is not in the set status, a drive signal is issued from the output port $F_1$ through the driver $DR_1$ to turn on the clutch PC for driving the paper feed roll to carry out the paper feed operation. The timer 2 is turned on again. If the multi-feed flag F is set, it is reset and then the clutch FFC for driving the first feed station is turned off to stop the first feed station. The timer 5 provided in the selected area of the RAM is turned on to start the timer operation to count $N_5$ drum clocks. The duration of the timer 5 corresponds to a stop time period of the first feed station when the multi-feed is detected. When the timer 5 is turned off, the clutch FFC for driving the first feed station is again turned on to drive the first feed station. In the present example, since the multi-feed flag F is set, the paper feed operation is not carried out.

In a step 6, the sequence waits until the microswitch RHP for controlling the timing of the register roll is turned on, when a drive signal is issued from the output port $F_2$ through the driver $DR_2$ to turn on the clutch RFG for driving the register roll. Thus the register roll 37 is driven for a predetermined time period. As a result, the first paper is fed to the transfer station. The RHP flag is set in a selected area of the RAM. When the timer 2 is turned off, the multi-feed is again checked, and if the multi-feed is detected the multi-feed flag is set. In the present example, the multi-feed is not detected at this time and hence the multi-feed flag is not set. The RHP flag is then reset and, as the optical system is returned the home position to turn on the microswitch OHP, the set status of the stop flag is checked. In the present embodiment, the stop flag is not set and the sequence returns to the step 5.

The timer 4 is again turned on. When it is then turned off, the stop condition is checked. In the present example, the stop condition does not exist and hence the multi-feed flag is then checked. In the present example, since it is not in the set status, a drive signal is issued from the output port $F_1$ to drive the paper feed roll 30 (or 1) to feed the paper. Then, the timer 2 is turned on and the sequence goes to the step 6.

A second paper is fed to the transfer station by the same operation as described above, and the sequence returns to the step 5. In the present embodiment, the stop condition is detected at this time and the stop flag is set.

In the step 6, a third paper is fed to the transfer station by the register roll at a predetermined timing. Since the stop flag is in the set status, the sequence goes to a step 7 in which the optical system is turned off.

The number of copies is counted by the paper feed timing, and the content of the copy counter is incremented by one each time the multi-feed is detected.

As described above, in the present embodiment, the operation of the first feed station is stopped at the time that the paper is fed from the paper container if the multi-feed is detected. In this manner, the multi-fed papers are separated from each other and the remaining paper can be fed in synchronism with the next paper feed timing. Accordingly, no paper is wasted by the multi-feed.

Further, since the paper feed timing is used, no additional sensor is required to get the timing to stop the first feed station. Accordingly, the construction and the control of the device are simplified.

As shown in FIG. 1-4, sensors 150*a* and 150*b* may be arranged in front of and behind the separation roll 36 so that the first feed station is stopped by the output of the sensor 150*b* when the multi-feed condition is detected.

FIG. 7-4 shows a block diagram of a control unit for the above control sequence.

Connected to the input port $S_4$ is a reflection type sensor $DS_1$ (150*a* in FIG. 1-4) comprising a light emitting device $L_2$ and a photosensing device $D_2$. When the sensor detects a paper, it provide a "H" level signal to an inverter I which provides an inverted signal to the input port $S_4$. Connected to the input port $S_5$ through an inverter I is a reflection type sensor $DS_2$ (150*b* in FIG. 1-4) comprising a light emitting element $L_3$ and a photosensing element $D_3$. The other constructions are identical to those of FIG. 7-1. The multi-feed is again detected by the output of the sensor 150*a* as described above.

Figure 18A:
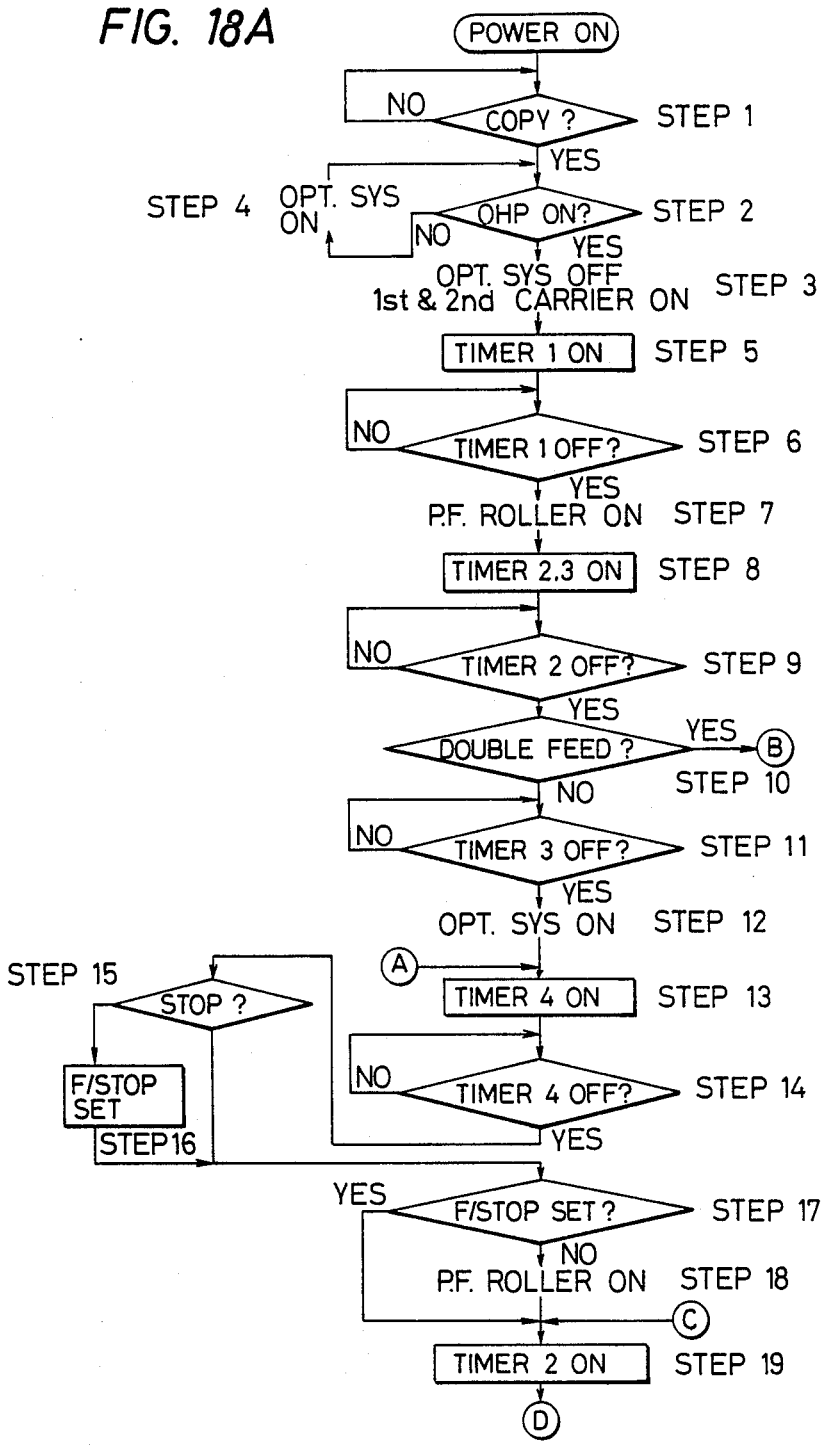
FIGS. 18A and 18B, shows a control flowchart for another embodiment of the invention.

The operation is now explained with reference to a control flow chart shown in FIG. 18 and a timing chart shown in FIG. 19. In the example shown in the timing chart of FIG. 19, three copies are to be reproduced and the double feed occurs in the first run of paper feed.

In the present embodiment, if the multi-feed is detected, the drive of the first feed station extending from the paper feed station to the multi-feed separation roll 36 is stopped when the sensor 150*b* detects a leading edge of the paper which was separated by the multi-feed separation roll and remains unfed, that is, the paper which is in contact with the follower roll 36'.

In a step 1, when the start of copy button COPY is depressed, an input signal is applied to the input port $K_0$ and the input data is loaded to the accumulator, not shown, of the microcomputer CPU, and then stored in the selected area of the RAM. In a step 2, it is checked if the optical system is at the home position, that is, if the microswitch OHP is on. If the optical system is not at the home position, a drive signal is issued, in a step 4, from the output port $F_3$ of the microcomputer CPU through the driver $DR_3$ to turn on the clutch OP for driving the optical system. The optical system is then driven until it returns to the home position. In a step 3, the optical system is stopped and drive signals are issued from the output ports $F_4$ and $F_5$ through the drivers $DR_4$ and $DR_5$ to turn on the clutches FFC and SFC for driving the first and second feed stations. Thus, the feed roll arranged on the feed path and the multi-feed separation roll 36 start to operate. In a step 5, the timer 1 provided in the selected area of the RAM is turned on to start the timer operation to count $N_1$ drum clocks applied to the interruption port IA. The duration of the timer 1 corresponds to a time period from the depression of the copy key to the turn-on of the paper feed roll. In a step 6, the timer 1 is turned off. In steps 7 and 8, a drive signal is issued from the output port $F_1$ to turn on the clutch PC for driving the paper feed roll and the paper feed roll 30 (or 31) is driven to carry out the first run of paper feed. The timers 2 and 3 provided in the selected areas of the RAM are turned on to start the timer operations to count $N_2$ and $N_3$ drum clocks, respectively. The duration of the timer 2 is set to be slightly longer than a time period from the start of the normal paper feed of the longest size paper acceptable to the copying machine to the detection of a rear edge of the paper by the paper sensor 150*a*. The duration of the timer 3 is set to a time period from the start of the paper feed to the time that the optical system is turned on. In a step 9, when the timer 2 is turned off, it is checked if a multi-feed has occurred, that is, if the output signal of the paper sensor $DS_1$ (150*a*) connected to the input port $S_4$ is "H" level. If it is "H" level, that is, if the sensor $DS_1$ detects the paper, the multi-feed is detected and the sequence goes to a step 29. If the multi-feed is not detected, the sequence goes to a step 11. In the timing chart shown in FIG. 19, the multi-feed occurs in the first run of paper feed. Accordingly, the sequence goes to a step 30. In the steps 30 and 31, when the timer 3 is turned on, a drive signal is issued from the output port $F_3$ through the driver $DR_3$ to turn on the clutch OP for driving the optical system so that the optical system is driven to carry out the exposure operation. The text exposure is carried out when the optical system returns from the back position to the home position. In steps 32 and 33, the timer 4 provided in the selected area of the RAM is turned on to start the timer operation to count $N_4$ drum clocks. The duration of the timer 4 is set to a time period from the turning on of the optical system to the start of the next paper feed. When the timer 4 is turned off, it is checked in a step 34 if the stop signal has been produced by the completion of the preset number of copies, the depression of the stop key or the jam. If the stop signal is not detected, the sequence goes to step 35, and if the stop signal is detected, the stop flag is set in the selected area of the RAM in a step 43 and the sequence goes to step 19. In the example of FIG. 19, the stop signal is not present and hence the sequence goes to a step 35. When the paper sensor $DS_2$ (150*b*) is turned on, that is, when the output signal thereof assumes the "H" level by detecting the paper, the clutch FFC for driving the first feed station is turned off in a step 34 to stop the first feed station. In this manner, the feed timing of the paper which was separated by the multi-feed separation roll 36 and remains unfed is controlled. In a step 37, the timer 5 provided in the selected area of the RAM is turned on. The timer 5 counts $N_5$ drum clocks and the duration of the timer 5 corresponds to the stop time period of the first feed station when the multi-feed is detected. In a step 38, the timer 5 is turned off, and in steps 39 and 40 the first feed station is turned on before the microswitch RHP for controlling the register roll is turned on. When the microswitch RHP is turned on, a drive signal is issued, in a step 41, from the output port $F_2$ through the driver $DR_2$ to turn on the clutch REG for driving the register roll, and the register roll 37 starts to operate. In a step 42, the optical system returns to the home position and the microswitch OHP is turned on. Then the sequence goes to steps 13 and 14. When the timer 4 is again turned on and then turned off, the stop condition is checked in a step 15. If the stop condition is detected, the sequence goes to a step 16 and the stop flag is set. If the stop condition is not detected, the sequence goes to a step 17. In the timing chart shown in FIG. 19, the stop condition does not exist and hence the sequence goes to the step 17 where the set status of the stop flag is checked. In the present example, since it is not in the set status, the sequence goes to a step 18 where a dri signal is issued from the output port $F_1$ to turn on the clutch PC for driving the paper feed roll. Thus, the paper feed roll 30 (or 31) is driven to feed the paper. In a step 19, the timer 2 is again turned on. In steps 20 and 21, when the microswitch RHP is turned on, the register roll 37 is driven for a predetermined time period to feed the paper to the transfer station. In a step 22, when the timer 2 is turned off, the process goes to a step 23 where the multi-feed is checked. If the multi-feed is checked, the multi-feed flag is set in the selected area of the RAM. If the multi-feed condition is not detected, the sequence goes to a step 25. In the step 25, when the microswitch OHP is turned on, the set status of the multi-feed flag is checked in a step 26. If it is in the set status, the sequence goes to a step 27 and the multi-feed flag is reset and then the sequence goes to a step 32. In the example of FIG. 19, the multi-feed is not detected at this time and the sequence goes to a step 28 where the set status of the stop flag is checked. Since it is not set at this time, the sequence returns to the step 13 and the steps 13 and 14 are carried out. In the step 15, the stop condition is checked. In the present example, the stop condition is detected at this time and the stop flag is set in the step 16. Then, the sequence goes from the step 17 to the step 19 and the paper feed roll 37 is not driven. The steps 19 to 26 are carried out in the same manner as described above, and the sequence goes to the steps 28 and 29 where the clutch OP for driving the optical system is turned off to stop the optical system.

In the present embodiment, the number of copies is counted by counting the number of the paper feed operations, and the content of the copy counter is incremented by one when the multi-feed is detected.

As described above, in the present embodiment, when the multi-feed is detected, the multi-fed papers are separated from each other at the first feed station and after the first paper has been fed to the second feed station, the first feed station is stopped when the remaining paper is detected between the first feed station and the second feed station. Therefore, the stop position of the remaining paper is well defined so that it is readily synchronized with the next paper feed timing. Thus, even when the multi-feed occurs, the copy sequence can be continued without interruption.

Alternatively, when the multi-feed is detected, only one paper may be fed by the multi-feed separation roll to form the image thereon and the remaining paper may be collected to a predetermined position. Referring to FIG. 1-1, a control sequence in which the second paper separated is left at the feed station is explained. In FIG. 1-1, numeral 36 denotes the multi-feed separation roll and numerals 32 and 33 denote the conventional feed rolls. The multi-feed is detected by a mechanism shown in FIGS. 5 and 6.

Figure 22:
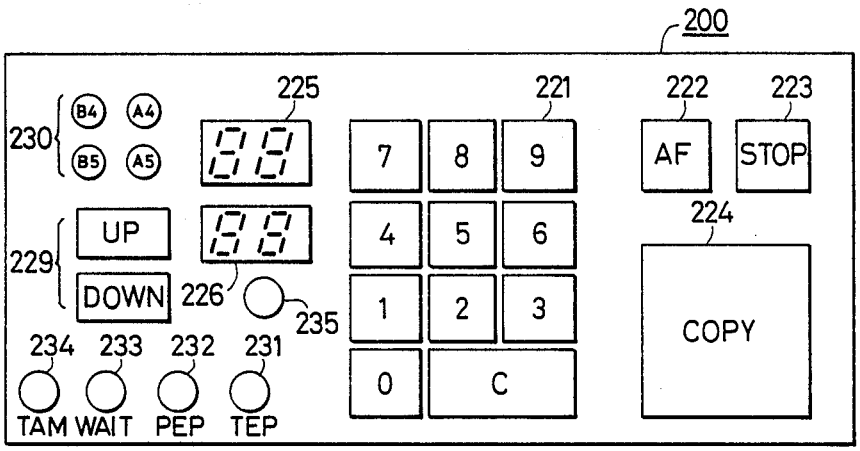
FIG. 22 is an elevational view of a control unit for the copying machine.

FIG. 22 shows a control unit 200 of the copying machine. Numeral 221 denotes a key pad for setting the number of copies desired. By depressing selected numeric keys 0–9, a desired number of copies, 99 at maximum, is set to a display 225. A clear key C is used to clear the content of the display 225. Numeral 222 denotes a mode key which is used when an auto feeder 51 is to be used. By depressing the key 222, the auto feeder 51 is enabled. Numeral 223 denotes a stop key for stopping the machine before the count of the copy counter does not reach the preset count. When the key 223 is depressed, the copy cycle is terminated after the currently executed copy operation has been completed. Numeral 224 denotes a start key for starting the copy operation. Numerals 225 and 226 denote seven-segment displays constructed or light emitting diodes or liquid crystal devices. They are used to display the preset number and the copy count, respectively. Numeral 229 denotes a key for selecting a paper cassette 28 or a paper deck 29, numeral 230 denotes a display for displaying the size of the papers in the cassette selected by the key 229, numeral 231 denotes a display which is turned on when toner in a developer 16 has been exhausted, numeral 232 denotes a display which is turned on when the papers in the selected cassette have been exhausted, numeral 233 denotes a display which is turned on when the paper is jammed, and numeral 234 denotes a display which is turned on when the multi-feed of the papers is detected.

FIG. 7-5 shows a block diagram of the control unit in accordance with the present embodiment. Connected to the input port $S_4$ is a multi-feed detection device as shown in FIGS. 5 and 6. Connected to the output port $F_6$ is a lamp LA which is turned on when a multi-feed is detected. The other constructions are identical to those of FIG. 7-1.

Figure 20A:
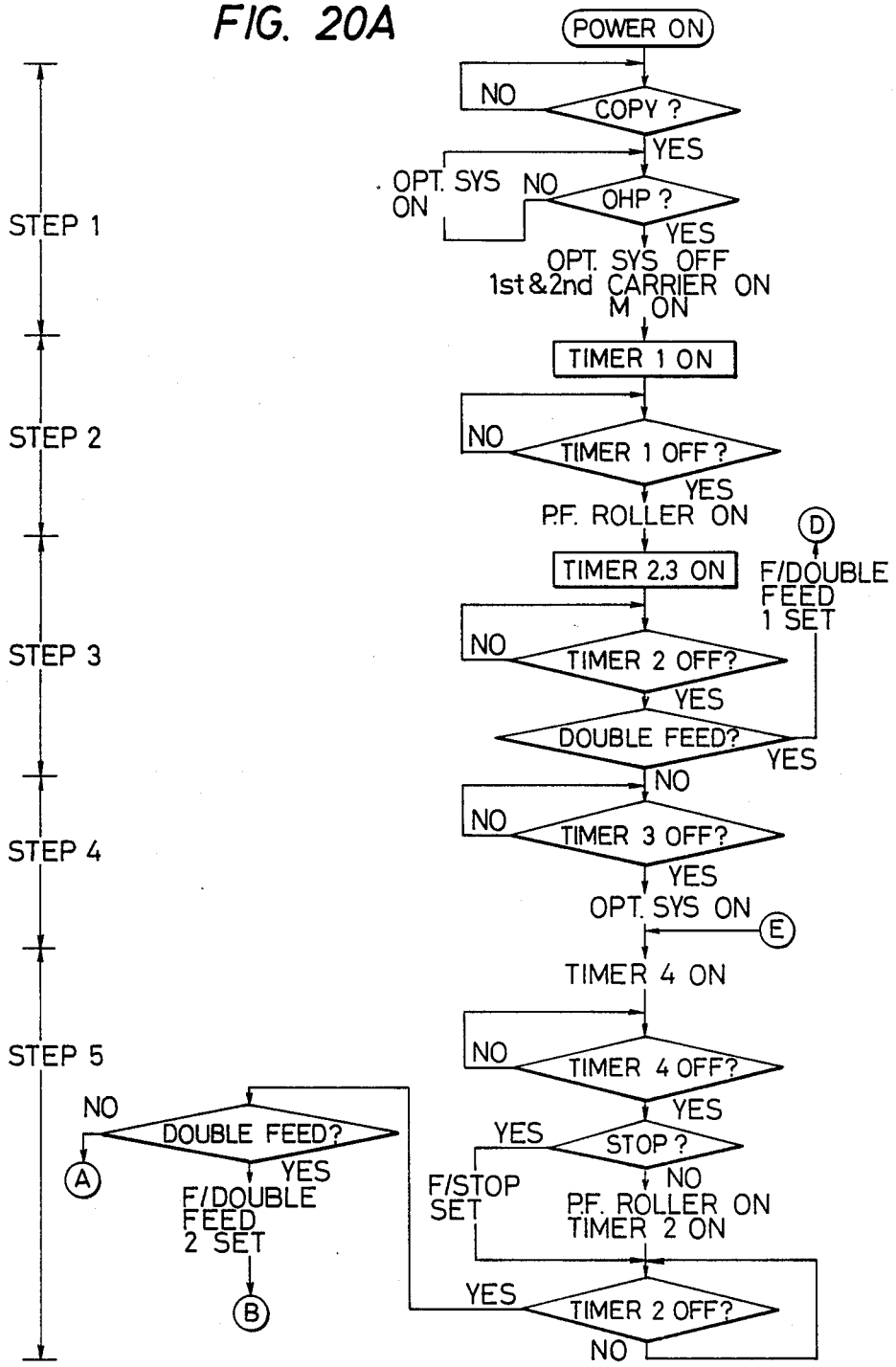
FIGS. 20A and 20B, shows a control flowchart for another embodiment of the invention.
Figure 20B:
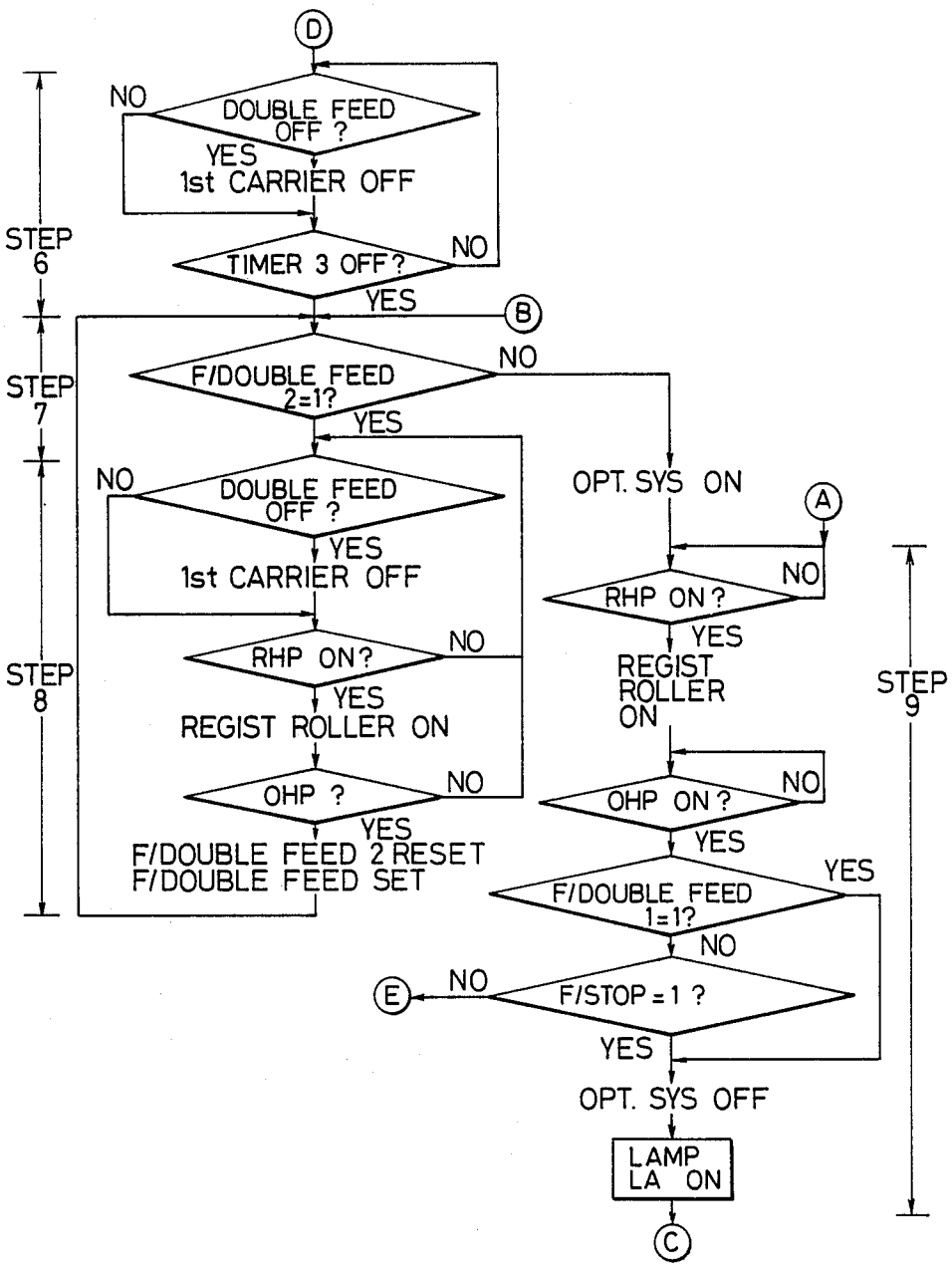
Figure 21:
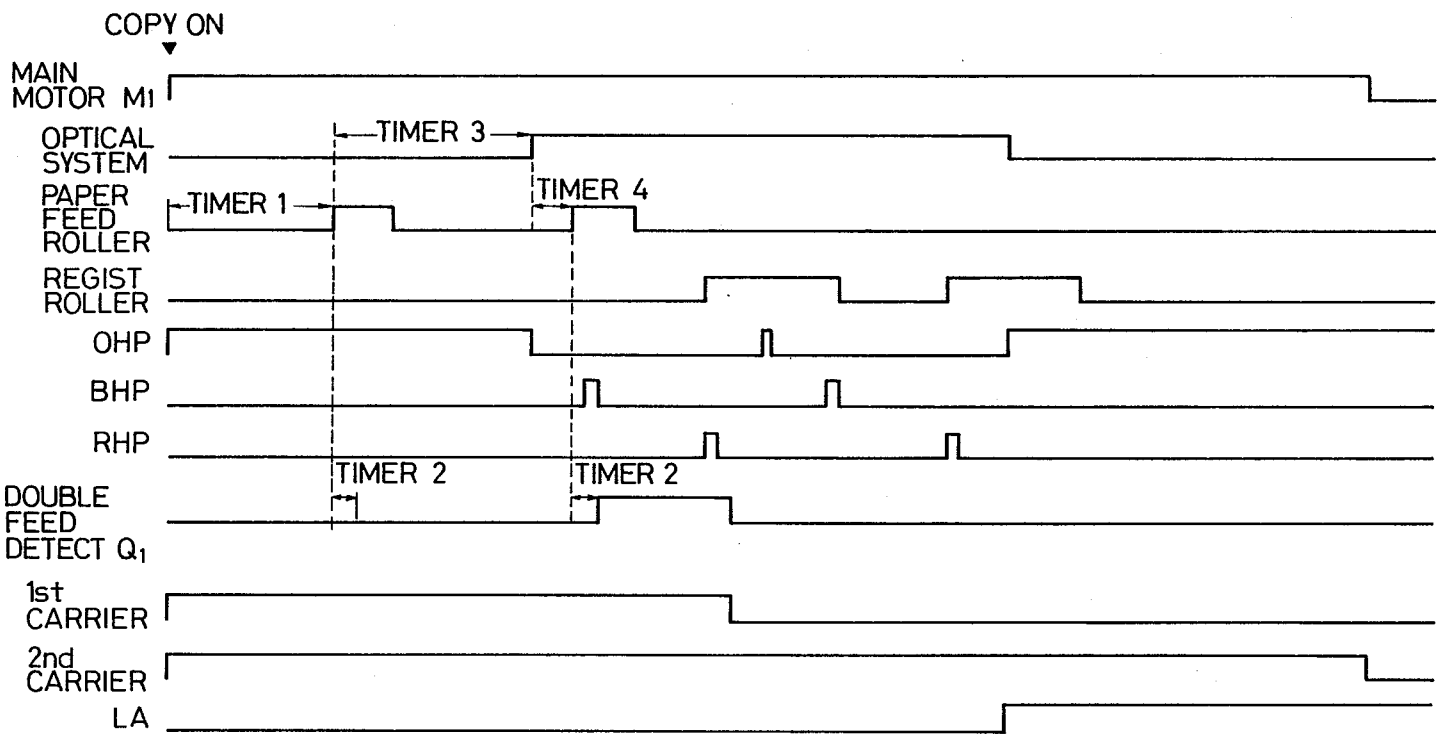
FIG. 21 shows a timing chart therefor.

FIG. 20 shows a control flow chart in accordance with the present embodiment and FIG. 21 shows a timing chart therefor. In the timing chart shown in FIG. 21, the multi-feed occurs in the second run of paper feeding. The operation is now explained with reference to FIGS. 20 and 21.

In a step 1, the number of copies, the size of copies and the density of copies are set. When the copy key COPY is depressed, the input signals are applied to the input port $K_0$ and the input data are loaded to the accumulator, not shown, of the microcomputer CPU and then stored in the selected area of the RAM, not shown. When the sensor OHP is turned on to indicate that the optical system is at the home position, a drive signal is issued from the output port $F_0$ through the driver $DR_0$ to drive the main motor $M_1$. At the same time, drive signals are issued from the output ports $F_4$ and $F_5$ through the drivers $DR_4$ and $DR_5$ to turn on the clutch FFC for driving the first feed station and the clutch SFC for driving the second feed station. Thus, the multi-feed separation roll 36 and the feed roll arranged on the feed path between the paper feed station and the ejection station are driven.

In a step 2, the timer provided in the selected area of the RAM is turned on to start the timer operation to count $N_1$ drum clocks applied to the interruption port IA. The duration of the timer 1 corresponds to a time period from the depression of the copy key to the turn-on of the paper feed roll. When the timer 1 is turned off after it has counted $N_1$ drum clocks, a drive signal is issued from the output port $F_1$ through the driver $DR_1$ to turn on the clutch PC for driving the paper feed roll. Thus, a first run of paper feed is carried out. The timers 2 and 3 provided in the selected areas of the RAM are turned on to start the timer operations to count $N_2$ and $N_3$ drum clocks, respectively. The duration of the timer 2 corresponds to atime period from the start of the paper feed to the arrival of the paper to the multi-feed separation roll 36. The duration of the timer 3 corresponds to a time period from the start of the paper feed to the turn-on of the optical system. When the timer 2 is turned off, the multi-feed in the first run of paper feed is checked, and if the multi-feed condition is detected, the multi-feed flag 1 is set in the selected area of the RAM and the sequence goes to a step 6. In the example of FIG. 21, the output of the multi-feed detection circuit $Q_1$ is "0" at this time. Therefore, the multi-feed is not detected and the sequence goes to a step 4, in which when the timer 3 is turned off a drive signal is issued from the output port $F_3$ through the driver $DR_3$ to turn on the clutch OP for driving the optical system. Thus, the optical system is driven to carry out the exposure scan. In the present embodiment, the exposure is carried out when the optical system returns from the back position to the home position.

In a step 5, the timer 4 provided in the selected area of the RAM is turned on to start the timer operation to count $N_4$ drum clocks. The duration of the timer 4 corresponds to a time period from the turning on of the optical system to the start of the next paper feed. When the timer 4 is turned off, the stop condition is checked. If the stop condition is detected by the completion of the preset number of copies, the depression of the stop key STOP or the jam, the stop flag is set in the selected area of the RAM. In the example shown in FIG. 21, the stop condition is not detected and a drive signal is issued from the output port $F_1$ through the driver $DR_1$ to turn on the clutch PC for driving the paper feed roll. Thus the paper feed roll 30 (or 31) is driven to carry out a second run of paper feed. The timer 2 is again turned on. When the timer 2 is turned off after it has counted $N_4$ drum counts, the multi-feed in the second run of paper feed is checked. In the example of FIG. 21, the output signal of the multi-feed detection circuit $Q_1$ is "1" at this time. This signal is applied to the input port $S_4$ and the multi-feed is detected. Thus, the multi-feed flag 2 is set and the sequence goes to a step 7.

In the step 7, the multi-feed flag 2 is checked. If it is set, a drive signal is issued from the output port $F_3$ to turn on the clutch OP for driving the optical system and the sequence goes to a step 9. In the example of FIG. 21, since the multi-feed flag 2 is not in the set status, the sequence goes to a step 8.

In the step 8, before the output signal of the multi-feed detection circuit $Q_1$ changes to "0", the timing sensor RHP is turned on to change the input signal to the input port $S_3$ to "1". Thus, a drive signal is issued from the output port $F_2$ through the driver $DR_2$ to turn on the clutch REG for driving the register roll. Thus, the register roll 37 is driven for a predetermined time period. As a result, the first paper is fed to the transfer station. When the output signal of the multi-feed detection circuit $Q_1$ changes to "0", the clutch FFC for driving the first feed station is turned off to stop the multi-feed separation roll 36 and other feed rolls. As a result, that paper of the multi-fed papers which was separated and fed later is stopped before the multi-feed separation roll 36. When the optical system returns to the home position and the sensor OHP is turned on to change the input signal to the input port $S_1$ to "1", the multi-feed flag 2 is reset and the multi-feed flag 1 is set. The sequence then returns to the step 7.

Since the multi-feed flag is in the reset status at this time and the optical system is on, the sequence goes to the step 8 where it waits until the timing sensor RHP is turned on, when the register roll 37 is turned on so that the paper separated by the multi-feed separation roll pair 36 and 36' and fed first is fed to the transfer station. The remaining paper stops upstream of the multi-feed separation roll pair 36 and 36'. When the optical system returns to the home position and the sensor OHP is turned on, the multi-feed flag 1 is checked. In the example of FIG. 21, the multi-feed flag 1 is set. Thus, the clutch OP for driving the optical system is turned off to stop the optical system, and a drive signal is issued from the output port $F_5$ through the driver $DR_5$ to turn on the lamp LA. Thus, the display 235 (FIG. 22) is turned on to indicate the occurrence of the multi-feed.

The lamp LA may be flashed when a multi-feed is detected.

In the present embodiment, the number of copies is counted by counting the number of the paper feed operations.

As described above, in accordance with the present embodiment, one of the multi-fed papers is separated and fed to the predetermined station while the remaining paper stops in the feed path. Accordingly, the multi-fed papers are collected at one location so that they can be readily removed.

Since a means for displaying the occurrence of the multi-feed is provided, it can provide an alarm to an operator.

Alternatively, when the multi-feed is detected, the remaining separated papers may be collected in a container.

FIG. 1-5 shows a sectional view of a copying machine which operates in the manner described above.

When the multi-feed is detected, one of the multi-fed papers is separated by the multi-feed separation roll pair 36 and 36' and fed to the transfer station to form the image thereon. As will be described later, a plunger 100 is turned on to connect a feed path comprising guides 39 and 39' to a feed path comprising guides 101 and 101'. Thus, the remaining papers are guided by feed roll pair 102 and 102', guides 103 and 103' and feed roll pair 104 and 104' to a cassette 105. Numeral 32 and 33 denotes the conventional feed rolls. The like numerals to those shown in FIG. 1-1 designate like elements.

FIG. 7-6 shows a block diagram of one embodiment of the control unit. Connected to the output port $F_5$ is the plunger PL (100 in FIG. 1-5) for connecting guides 39 and 39' to the guides 101 and 101' when the multi-feed is detected. The other constructions are identical to those of FIG. 7-1.

Figure 23A:
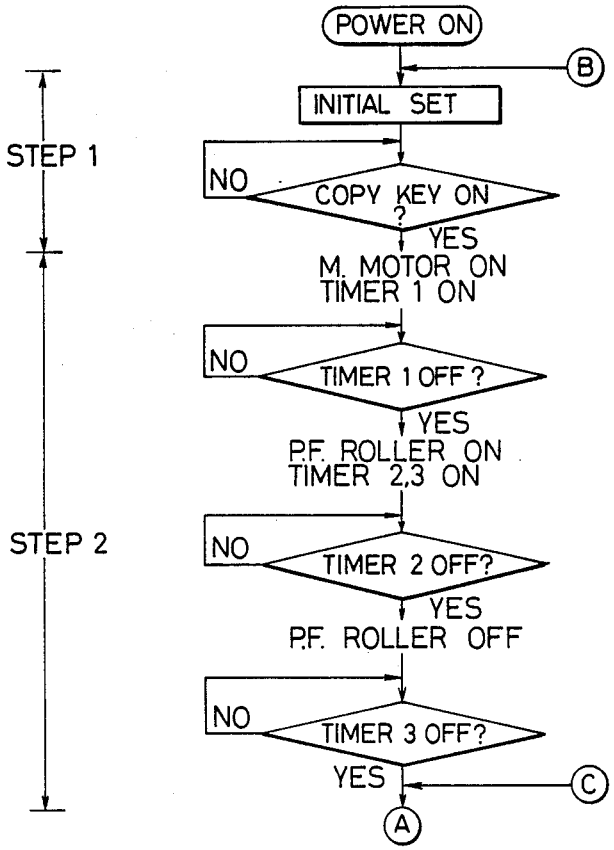
FIGS. 23A and 23B, shows a control flowchart for another embodiment of the invention.
Figure 23B:
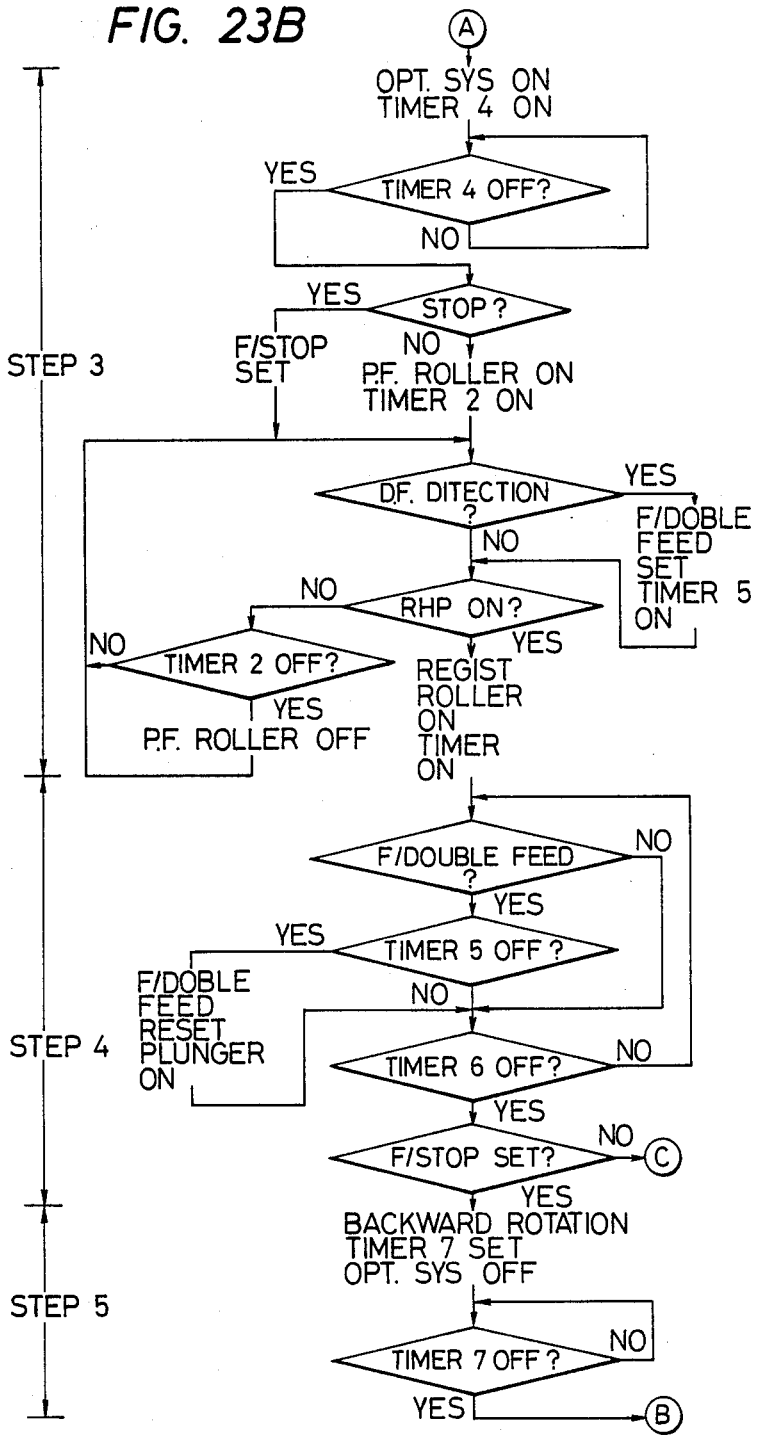
Figure 24:
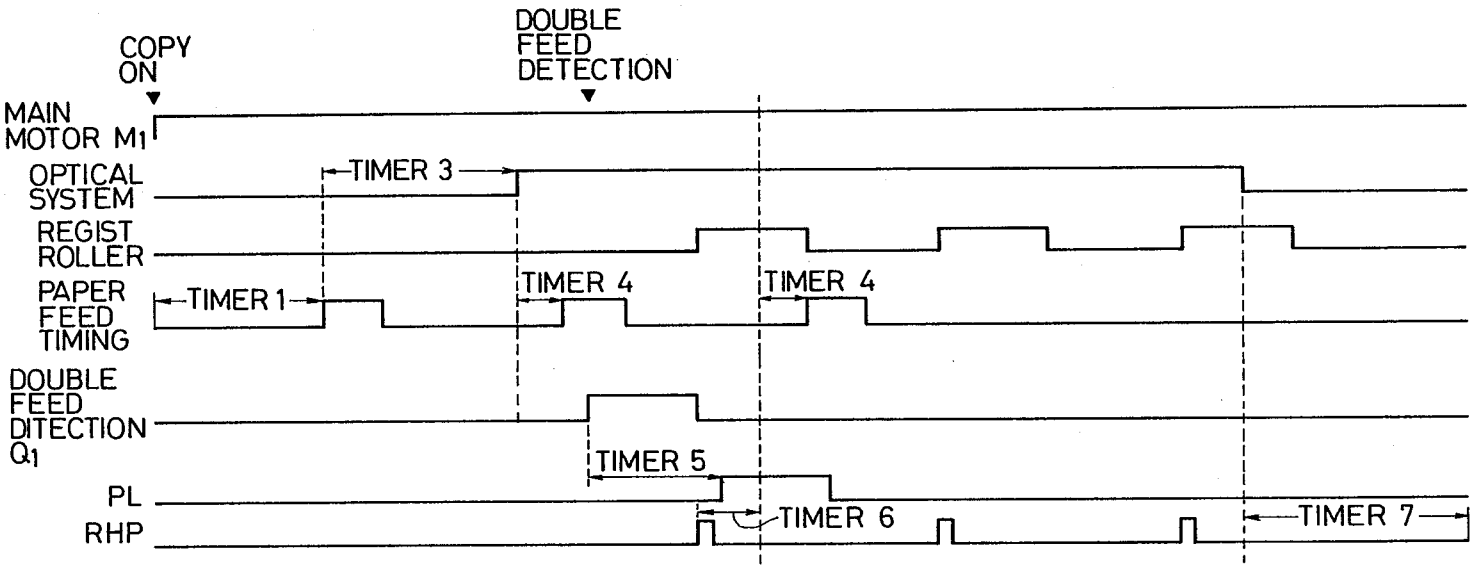
FIG. 24 shows a timing chart therefor.

FIG. 23 shows a control flow chart and FIG. 24 shows a timing chart. The operation is now explained with reference to FIGS. 23 and 24.

In a step 1, the number of copies, the size of copies and the density of copies are set. When the copy key COPY is depressed, the input signals are applied to the input port $K_0$ and the input data are loaded to the accumulator, not shown, of the microcomputer CPU and then stored in the selected area of the RAM, not shown.

In a step 2, a drive signal is issued from the output port $F_0$ through the driver $DR_0$ to drive the main motor $M_1$. At the same time, a drive signal is issued from the output port $F_4$ through the driver $DR_4$ to turn on the clutch FC for driving the feed station. Thus, the multi-feed separation roll 36 and the feed roll are driven. The timer 1 provided in the selected area of the RAM is turned on to start the timer operation to count $N_1$ drum clocks applied to the interruption port IA. The duration of the timer 1 corresponds to a time period from the depression of the copy key to the turn-on of the paper feed roll. When the timer 1 is turned off, a drive signal is issued from the output port $F_1$ through the driver $DR_1$ to turn on the clutch PC for driving the paper feed roll. As a result, a first run of paper feed is carried out. The timers 2 and 3 provided in the selected areas of the RAM are turned on to start the timer operations to count $N_2$ and $N_3$ drum clocks, respectively. The duration of the timer 2 corresponds to the operation period of the paper feed roll and the duration of the timer 3 corresponds to a time period from the end of the paper feed to the turn-on of the optical system. When the timer 2 is turned off, the clutch PC for driving the paper feed roll is turned off to stop the paper feed roll 30 (or 31).

When the timer 3 is turned off, a drive signal is issued, in a step 3, from the output port $F_3$ through the driver $DR_3$ to turn on the clutch OP for driving the optical system. As a result, the optical system is driven. The timer 4 provided at the selected area of the RAM is turned on to start the timer operation to count $N_4$ drum clocks. The duration of the timer 4 corresponds to a time period from the turning on of the optical system to the turning on of the paper feed roll. When the timer 4 is turned off, the presence or absence of a stop condition is checked. If the stop condition is present due to the completion of the preset number of copies, the depression of the stop key STOP or the jam, the stop condition is detected and the stop flag is set in the selected area of the RAM. In the timing chart shown in FIG. 24, the stop condition is not detected at this time. Thus, the clutch PC for driving the paper feed roll is turned on to carry out the second run of paper feeding. The timer 2 is turned on. Before the timer 2 is turned off, a multi-feed in the first run of paper feed is checked. In the present example, the output of the multi-feed detection circuit $Q_1$ is "H" level at this time. Thus, the multi-feed is detected and the multi-feed flag is set in the selected area of the RAM. The timer 5 provided in the selected area of the RAM is turned on. The duration of the timer 5 corresponds to a time period from the detection of the multi-feed to the turn-on of the plunger PL. The timer 2 is then turned off and the paper feed roll 30 (or 31) is stopped. Thereafter, when the microswitch RHP is turned on, a drive signal is issued from the output port $F_2$ through the driver $DR_2$ to turn on the clutch REG for driving the register roll. As a result, the regist roll 37 is driven to feed the first paper to the transfer station at a predetermined timing. The timer 6 provided in the selected area of the RAM is also turned on to start the timer operation to count $N_6$ drum clocks. The duration of the timer 6 corresponds to a time period from the turn-on of the microswitch RHP to the end of the scan of the optical system.

In a step 4, the multi-feed flag is checked. In the present example, it is in the set status at this time. Thus, when the timer 5 is turned off, a drive signal is issued from the output port $F_5$ through the driver $DR_5$ to turn on the plunger PL. The multi-feed flag is reset. As a result, the guides 39 and 39' are connected to the guides 101 and 101' so that the remaining papers separated by the multi-feed separation roll 36 are guided by the guides 101 and 101', the feed roll pair 102 and 102', the guides 103 and 103', the feed roll pair 104 and 104' into the cassette 105. When the timer 6 is turned off, the stop condition is checked. In the present example, the stop condition is not detected and the sequence returns to the step 3, where the optical system is turned on and the timer 4 is turned on. Then, a third run of paper feed is carried out in the same manner as the second run. In the present example, since the multi-feed does not occur in the second run of paper feed, the multi-feed flag and the timer 5 are not set. When the microswitch RHP is turned on, the register roll 37 is turned on to feed the second paper to the transfer station. Then the timer 6 is turned off in the step 4 and the stop condition is checked. Since the stop condition is not detected at this time, the sequence returns to the step 3 and the optical system and the timer 4 are turned on. When the timer 4 is turned off, the stop condition is detected at this time and the stop flag is set. Then, the presence or absence of the multi-feed is the third run of paper feed is checked. In the present example, since the multi-feed is not detected at this time, the multi-feed flag and the timer 5 are not set. When the microswitch RHP is turned on, the register roll 37 is turned on to feed the third paper to the transfer station. After the timer 6 has been turned on, the sequence goes to the step 4. When the timer 6 is turned off, the sequence goes to the step 5 because the stop flag is in the set state.

In the step 5, the clutch OP for driving the optical system is turned off to stop the optical system. The timer 7 provided in the selected area of the RAM to start the timer operation to count $N_7$ drum clocks. The duration of the timer 7 corresponds to a time period required post-rotation to erase ununiform potential distribution on the photosensitive drum 8 and stabilize it. When the timer 7 is turned off and the post-rotation terminates, the sequence goes back to the step 1.

In the present embodiment, the number of copies is counted by counting the number of times of the paper feed operations.

In the present embodiment, the multi-fed papers are collected into a separate cassette. Alternatively, they may be returned to a paper feed cassette or ejected from the machine.

As described above, according to the present invention, when the multi-feed is detected, one of the multi-feed papers is separated and fed to the transfer station and the other papers are fed by the conventional feed path and fed to the container such as cassette. Accordingly, even if the multi-feed occurs, the normal copy sequence can be continued. Further, since the papers are reused, no paper is wasted.

When the multi-feed is detected, the number of multi-fed papers may be displayed. For example, in the copying machine shown in FIG. 1-1, the rolls 32, 33 and 36 may be provided with the separation function for the multi-fed papers.

FIG. 7-7 shows a block diagram of an embodiment of the control unit which operates in the manner described above.

Applied to the input ports $S_3$ to $S_5$ are output signals of multi-feed detection devices $DS_{32}$, $DS_{33}$ and $DS_{36}$ constructed as shown in FIGS. 5 and 6, which correspond to the multi-feed separation rolls 32, 33 and 36. Connected to the output ports $F_2$ and $F_3$ are a clutch $DC_1$ for driving the first multi-feed separation roll 32 (or 33) and a clutch $DC_2$ for driving the second multi-feed separation roll 36. The I5 other constructions are identical to those of FIG. 7-1.

Figure 25:
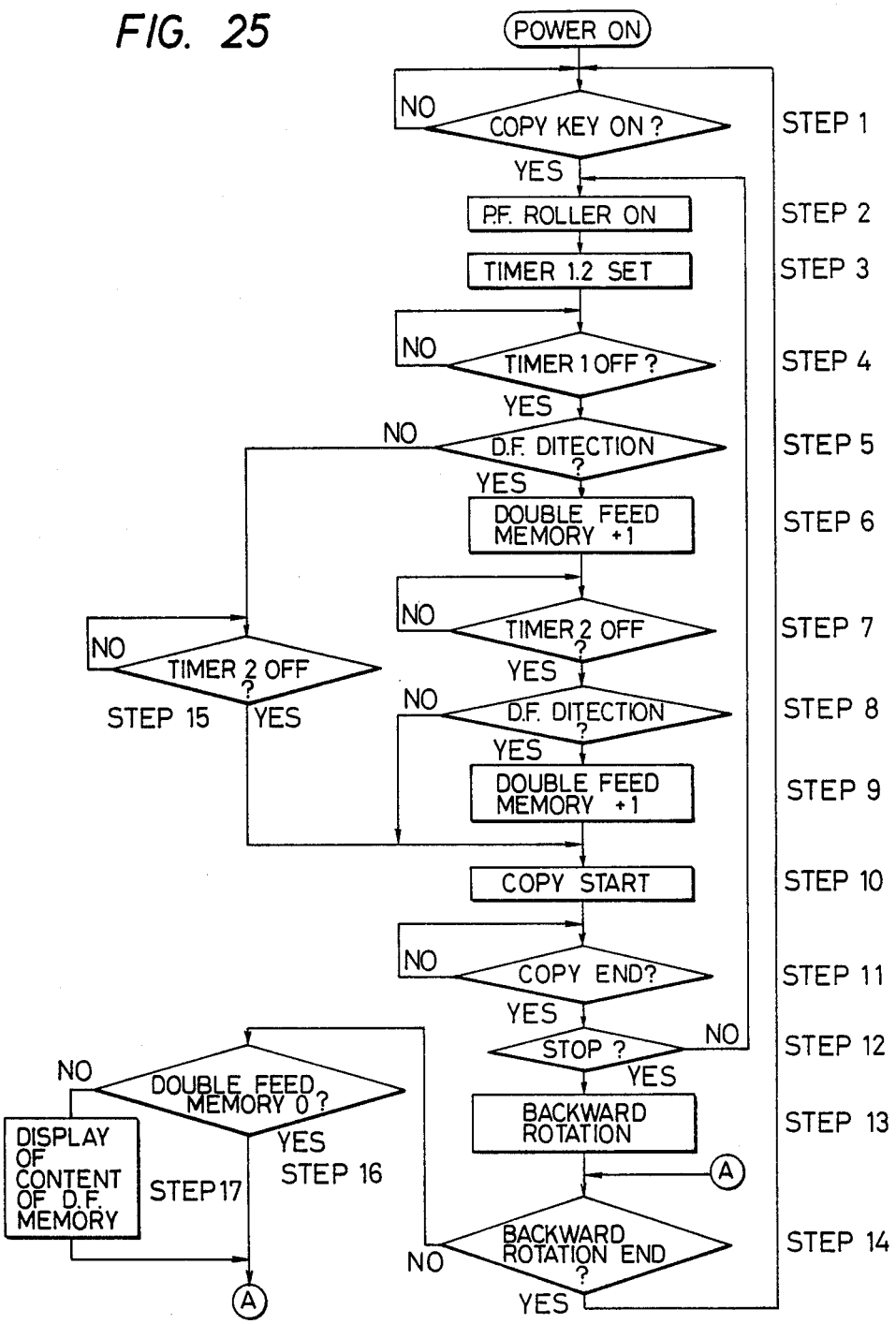
FIG. 25 shows a control flow chart for an alarm display.

FIG. 25 shows a control flow chart for the alarm display.

In a step 1, when the start of copy button COPY is depressed, the input signal is applied to the input port $K_0$ of the microcomputer CPU and the input data is loaded to the accumulator, not shown, of the microcomputer CPU and then stored in the selected area of the RAM, not shown. A drive signal is issued from the output port $F_0$ through the driver $DR_0$ to drive the main motor $M_1$. Drive signals are issued from the output ports $F_4$ and $F_6$ through the drivers $DR_4$ and $DR_6$, respectively, to turn on the clutch FC for driving the feed roll and the clutch OP for driving the optical system, respectively. In a step 2, when the optical system reaches the home position, the microswitch OHP is turned on. As a result, a drive signal is issued from the output port $F_1$ through the driver $DR_1$ to turn on the clutch PC for driving the paper feed roll. Thus, the paper is fed from the cassette 28 or the deck 29. In a step 3, the timer 1 and 2 are set in the selected areas of the RAM of the microcomputer CPU to start the timer operations to count $N_1$ and $N_2$ drum clocks ($N_1 < N_2$), respectively, applied to the interruption port IA. The duration of the timer 1 corresponds to a time period from the end of the paper feed to the arrival of the paper feed to the first multi-feed separation roll 32 (or 33), and the duration of the timer 2 corresponds to a time period from the end of the paper feed to the arrival of the paper to the second multi-feed separation roll 36. In a step 4, when the count of the drum clocks after the paper feed reaches $N_1$, the timer 1 is turned off and a drive signal is issued from the output port $F_2$ through the driver $DR_2$ to turn on the clutch $DC_1$ for driving the first multi-feed separation roll. The sequence then goes to a step 5 where the multi-feed is checked. It is checked if a pulse is being applied to the input port $S_3$ or $S_4$ of the microcomputer CPU from the multi-feed detection device $DS_{32}$ or $DS_{33}$, and if it is being applied, it is determined that the multi-feed has not occurred and the sequence goes to a step 15 where the sequence waits until the timer 2 is turned off, when the sequence goes to a step 10. On the other hand, if the pulse is not being applied to the input port $S_3$ or $S_4$, it is determined that the multi-feed has occurred and the sequence goes to a step 6 where one is added to the content of a multi-feed memory provided in a selected area of the RAM, not shown, of the microcomputer CPU. In a step 7, when the count of the drum clocks after the paper feed reaches $N_2$, a drive signal is issued from the outport $F_3$ through the driver $DR_3$ to turn on the clutch $DC_2$ for driving the second multi-feed separation roll. Then, the double-feed is again checked. It is checked if a pulse is being applied to the input port $S_5$ from the multi-feed detection device $DS_{36}$. If it is being applied, it is determined that the multi-feed has not occurred and the sequence goes to a step 10. If it is being applied, it is determined that the multi-feed has occurred and one is added to the content of the multi-feed memory, and the sequence goes to the step 10. In the steps 10 and 11, the copy operation is carried out. In a step 12, a stop condition is checked. If the content of the multi-feed memory is "2", the stop key 223 has been depressed or the preset number of copies have been reproduced, the stop condition is detected and the sequence goes to a step 13 where a post-rotation operation is carried out. If the stop condition is not detected, the sequence returns to the step 1. In the post-rotation operation, the sequence goes to a step 14, and before the post-rotation terminates it is checked, in a step 16, if the content of the multi-feed memory is "0". If it is not "0", the content is displayed, in a step 17, on the display 225 ($ST_2$, $ST_1$ in FIG. 7-7) which is provided to display the preset number of copies shown in FIG. 22. After the post-rotation has been completed, the sequence returns to the step 1.

The content of the multi-feed memory may be displayed by the display 226 ($CP_2$, $CP_1$ in FIG. 7-7) which is provided to display the number of copies reproduced shown in FIG. 22.

The display may be flashed.

When the number of multi-fed papers is two, the next paper feed operation may be stopped and the remaining one of the multi-fed papers may be fed at a predetermined timing to form the image thereon.

The multi-feed sensor may be constructed by a reflection type sensor.

As described above, in accordance with the present embodiment, the number of multi-fed papers separated by the multi-feed separation roll and remain unfed is displayed to alarm the multi-feed. By displaying it by the display which is provided to indicate the preset number of copies, no additional display is required and hence a cost reduction is achieved.

Alternatively, the number of times of the occurrence of the multi-feed may be counted and an alarm may be issued when the count reaches a predetermined number.

For example, in the copying machine shown in FIG. 1-1, the multi-feed detection device as shown in FIGS. 5 and 6 is provided for the multi-feed separation rolls 32 or 33, or a well-known detection device for detecting the multi-feed by transmitted light is provided between the multi-feed separation roll 32 and the cassette 28 or between the multi-feed roll 33 and the deck 29. The output of the detector is applied to a control unit as shown in FIG. 7-8.

Referring to FIG. 7-8, connected to the input ports $S_3$ and $S_4$ of the microcomputer CPU are the multi-feed sensors $DS_1$ and $DS_2$, respectively. The output port $F_6$ produces a signal to turn on a display 235 (DIS) of a console display as shown in FIG. 22. The other constructions of FIG. 7-8 are identical to those of FIG. 7-1.

Figure 26:
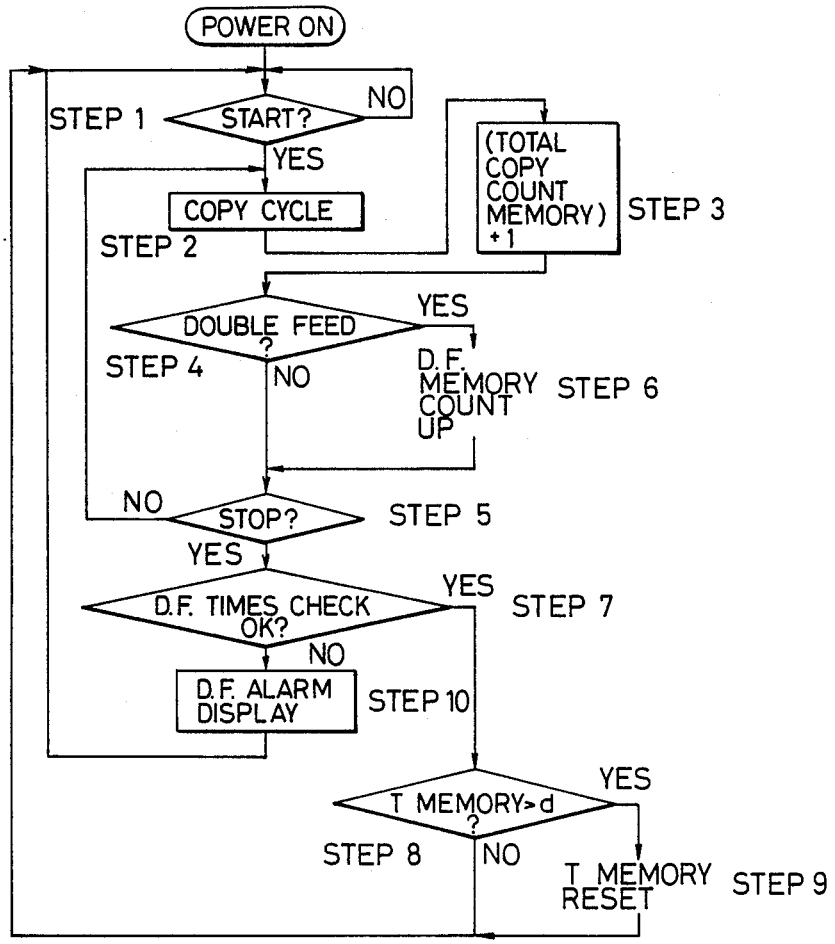
FIG. 26 shows a control flow chart for the copying machine.

The operation is now explained with reference to a control flow chart of FIG. 26.

In a step 1, when the start of copy button COPY is depressed, the input signal is applied to the input port $K_0$ and the input data is loaded to the accumulator, not shown, of the microcomputer CPU and then stored in the RAM, not shown. The sequence then goes to a step 2 or a copy cycle in which drive signals are issued from the output ports $F_0$–$F_5$ at predetermined timing to carry out the copying operation.

In a step 3, one is added to a content of a total copy count memory provided in a selected area of the RAM. In a step 4, a paper fed from a cassette 26-1 (or 26-2) is checked if a multi-feed has occurred or not. If the multi-feed is detected, the sequence goes to a step 6 where one is added to a content of a multi-feed memory provided in a selected area of the RAM and the sequence goes to a step 5. In the step 5, if the preset number of copies have been completed or the stop key 223 has been depressed, the stop condition is detected and the sequence goes to a step 7. If the stop condition is not detected, the sequence returns to the step 2.

In the step 7, the number of multi-feeds is checked. The content of the multi-feed memory is compared with a preset number, and if the content has reached the preset number, the sequence goes to a step 8 where a drive signal is issued from the output port $F_0$ through the driver $DR_6$ to the display DIS to display an alarm. On the other hand, if the number of multi-feeds has not reached the preset number, the sequence goes to a step 8 where it is checked if the content of the total copy count memory has reached a predetermined number $\alpha$. The number $\alpha$ is represented by $\alpha t_0 = t$ where t is a time period required to count the number of multi-feeds and $t_0$ is a time period required to produce one copy. Thus, the number $\alpha$ corresponds to the number of copies produced in the time period t. In the step 8, if the content of the total copy count memory is larger than $\alpha$, the content of the total copy count memory is reset in a step 9 and the sequence goes back to the step 1.

The display D1S may be flashed.

In accordance with the present embodiment, when more than the predetermined number of multi-feeds have occurred, it is displayed to alarm to an operator that appropriate measures such as adjustment of the paper feed roll or the spring pressure of the cassette are necessary. By counting the number of multi-feeds within the predetermined usage period, the alarm can be rapidly issued.

Another method for detecting the multi-feed is now explained. In the copying machine shown in FIG. 1-3, the rolls 32 and 33 are provided with a multi-feed separation function while the roll 36 is a conventional feed roll. The paper feed timing from the cassette 28 or the deck 29 is controlled by the timing sensor 90. The paper feed speed of the roll 32 or 33 and that of the downstream paper feed means are different, the latter being faster than the former.

Figure 27:
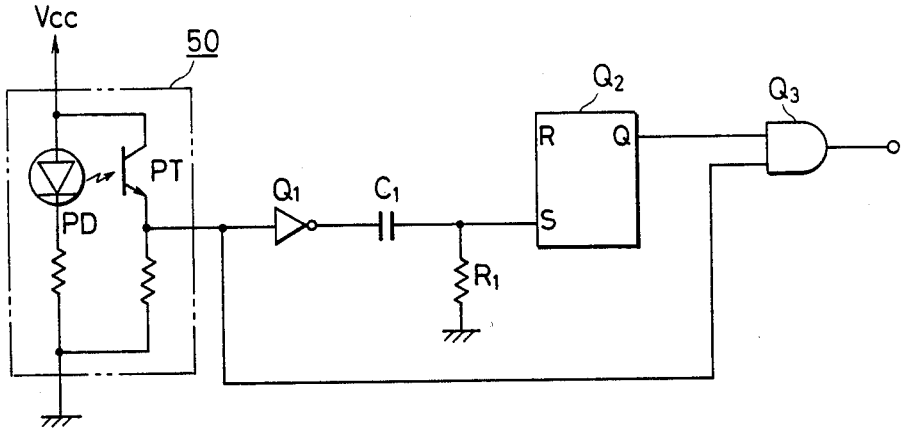
FIG. 27 shows a circuit diagram for detecting multi-feed.

FIG. 27 shows a circuit diagram for detecting the multi-feed and FIG. 7-9 shows a control circuit for controlling the operation of the copying machine.

Figure 28:
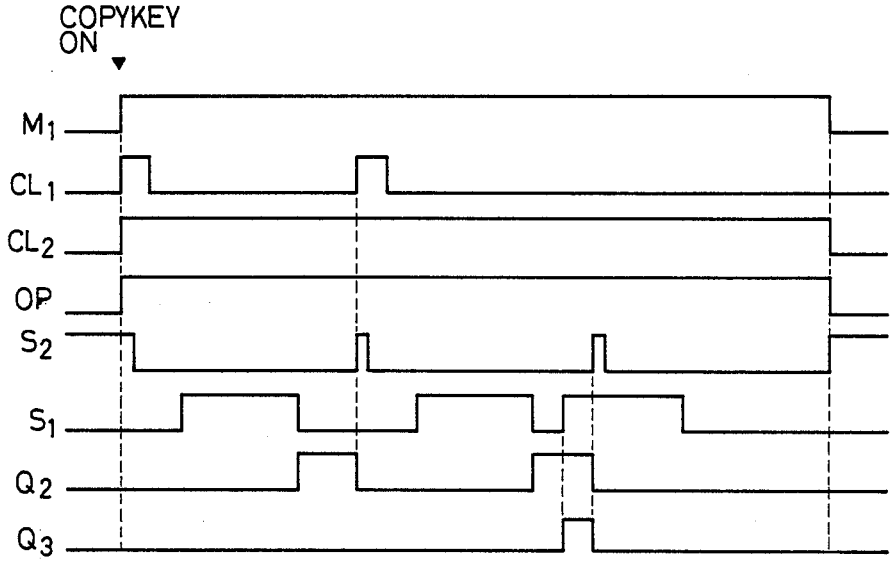
FIG. 28 shows a timing chart illustrating waveforms at various points in the circuits of FIGS. 27 and 7-9.

FIG. 28 shows a timing chart illustrating waveforms at various points in the circuits shown in FIGS. 27 and 7-9. In the present embodiment, three papers are fed and the multi-feed occurs in the second run of the paper feed. The operation is now explained with reference to the timing chart of FIG. 28.

When the copy key (not shown) in a display/control unit DIS is depressed, drive signals are issued from the CPU 100 through the drivers $DR_1$, $DR_3$ and $DR_4$ to the main motor $M_1$, the multi-feed separation roll, the clutch $CL_2$ for driving the feed roll and the clutch OP for driving the optical system, respectively. As a paper feed signal is applied to the CPU 100 from an optical system paper feed sensor 60, a drive signal is applied through the driver $DR_2$ to the clutch $CL_2$ for driving the paper feed roll to drive the paper feed roll 30 (or 31). When the sensor 150 senses a leading edge of a first fed paper, it produces an "H" level signal, and when it senses a rear edge of the paper, it produces an "L" level signal. The output signal of the sensor 150 is inverted by a inverter $Q_1$, an output of which is then supplied to a differentiation circuit. Thus, when the sensor 150 senses the rear edge of the paper, the differentiation circuit produces a positive trigger signal, which sets a monostable multivibrator $Q_2$ an output signal of which assumes "H" level for a predetermined time period. The monostable multivibrator $Q_2$ produces the "H" level signal for a time period from the detection of the rear edge of the paper by the sensor 150 to the generation of the next paper feed signal by the paper feed timing sensor 90. However, since the output signal of the sensor 150 is "L" level at this time, an output signal of an AND gate $Q_3$ is "L" level. Then, a second run of paper feed is carried out. It is assumed that the multi-feed occurs this time. The multi-fed papers are separated from each other by the separation roll pair 32 and 32' (or 33 and 33') and the second paper is detected by the sensor 150. The signal waveform at this time is identical to that for the first paper. The third paper reaches the sensor 150 earlier than a paper which would be normally fed from the cassette, and it is sensed by the sensor 150. Since the output signal of the monostable multivibrator $Q_2$ is "H" level at this time, the AND gate $Q_3$ produces the "H" level signal to the CPU 100 so that the multi-feed is detected. As a result, when the third paper feed signal is produced by the paper feed timing sensor 90, the CPU 100 controls to prevent the turn-on of the paper feed roll 30 (or 31).

In FIG. 27, the monostable multivibrator $Q_2$ may be replaced by a flip-flop, which is reset by the output signal of the paper feed timing sensor 90.

When the multi-feed occurs in the last run of paper feed, the remaining papers may be left in the feed path and they may be fed in the next copy cycle to transfer the image thereto. Alternatively, the feed means may be continuously operated after the termination of the last image forming operation to eject the remaining papers.

As described above, in accordance with the present embodiment, the detection means is provided between the two feed stations having different feed speeds and the multi-feed is detected by monitoring a spacing between the two sequentially fed papers. Accordingly, the multi-feed can be detected for various thickness of papers with a simple construction.

Alternatively, as shown in FIG. 1-6, a paper sensor may be arranged between the separation roll 32 or 33 and the cassette 28 or the deck 29 and the output of the sensor may be checked in synchronism with the paper feed timing to check the multi-feed.

FIG. 7-10 shows an embodiment of a control unit of the copying machine shown in FIG. 1-5. Outputs from sensors 50-1 and 50-2 are supplied to terminals $S_3$ and $S_4$ of the CPU.

Figure 29:
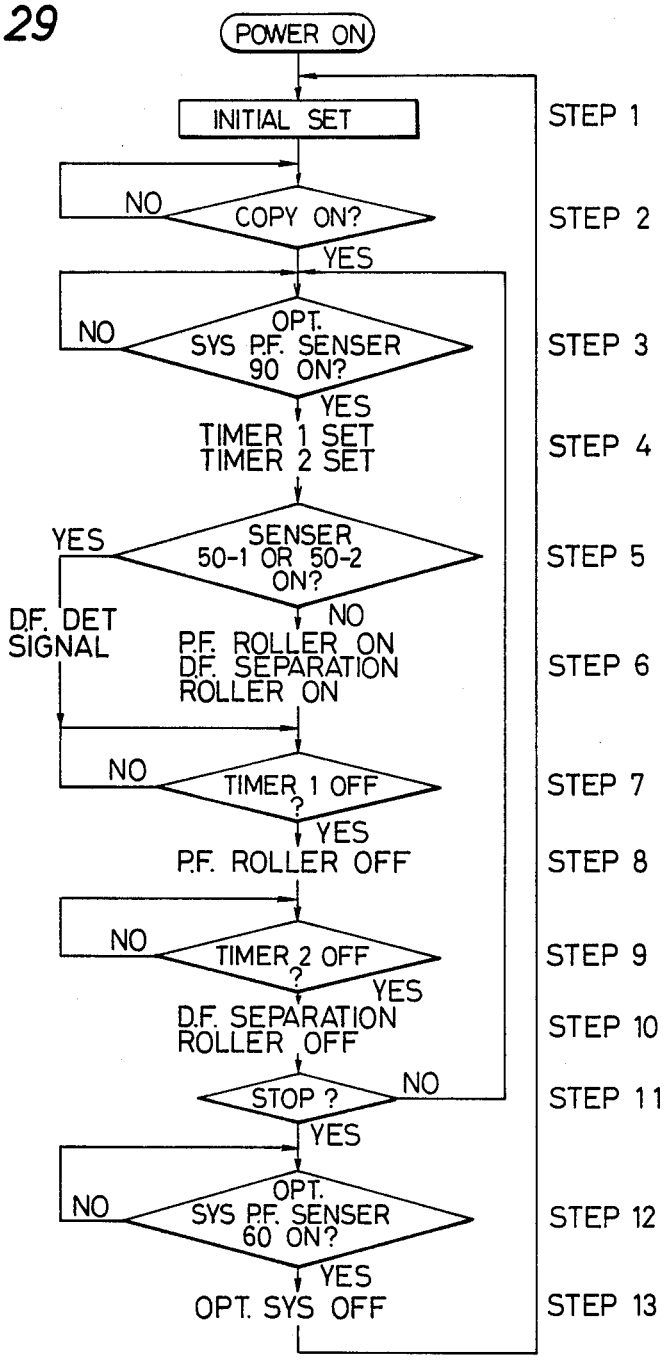
FIG. 29 shows a partial flow chart of a program loaded into a ROM of a CPU.
Figure 30:
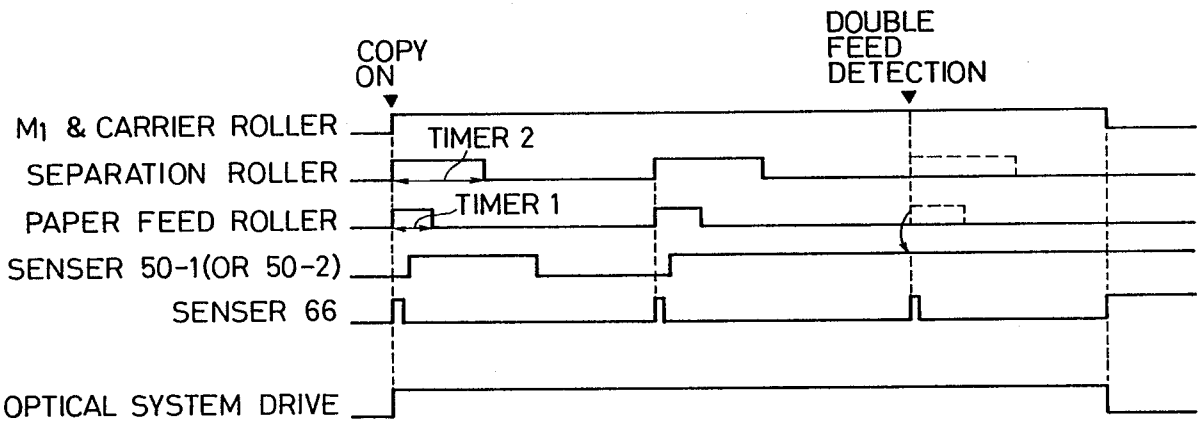
FIG. 30 shows a timing chart therefor.

FIG. 29 shows a partial flow chart of a program loaded in the ROM of the microcomputer CPU and FIG. 30 shows a timing chart. In the illustrated timing chart, three papers are fed and the multi-feed occurs in a second run of the paper feed. The operation is now explained with reference to FIGS. 29 and 30.

After the power on, the number of copies, the size of copies and the density of copies are set. When the copy key COPY is depressed, drive signals are issued from the output ports through the drivers $DR_1$ and $DR_4$ to turn on the main motor $M_1$ and the clutch FC for driving the feed roll (steps 1 and 2). When the optical system is at the home position and the paper feed timing sensor 60 is turned on, the timers 1 and 2 provided in the selected areas of the RAM are turned on to start the timer operations to count $N_1$ and $N_2$ drum clocks, respectively (steps 3 and 4). At this time, since the paper sensor 250-1 (or 250-2) is off, drive signals are issued from the output ports of the microcomputer CPU through the drivers $DR_2$ and $DR_3$ so that the clutch PC for driving the paper feed roll and the clutch DC for driving the multi-feed separation roll are turned on for the on-period of the timers 1 and 2, respectively. As a result, the paper feed roll 30 (or 31) and the multi-feed separation roll 32 (or 33) are driven (steps 5 and 6). When the timer 1 is turned off after it has counted $N_1$ drum clocks, the paper feed roll 30 (or 31) stops (steps 7 and 8). When the timer 2 is turned off after it has counted $N_2$ drum clocks, the multi-feed separation roll 32 (or 33) stops (steps 9 and 10). Then, the presence or absence of the stop signal due to the abnormal paper feed condition such as jam or multi-feed or the completion of the preset number of copies is checked (step 11). The stop signal is not detected in the illustrated example. Then, when the paper feed timing sensor 90 is turned on to start a second run of paper feed, the timers 1 and 2 are turned on and the above sequence is repeated (steps 3–11). In the timing chart of FIG. 30, the multi-feed occurs in the second run of paper feed. Then, the paper feed timing sensor 90 is turned on to start a third run of paper feed and the timers 1 and 2 are turned on (steps 3 and 4). Since the paper sensor 250-1 (or 250-2) is on at this time, the multi-feed is detected and the multi-feed detection signal is issued (steps 5 and 14). As a result, the paper feed roll 30 (or 31) and the multi-feed separation roll 32 (or 33) are not driven, and the paper is not fed and the multi-fed papers are not fed. The timers 1 and 2 are then turned off (steps 7–10). Since the multi-feed has been detected, the stop signal is detected at this time (step 11). As the optical system returns to the home position, the optical system stops and the main motor and the feed roll also stop (steps 12 and 13).

The feed roll may be rotated to feed the multi-fed paper at an appropriate timing to form the image on the multi-fed paper.

Alternatively, means which contribute to the formation of the image such as the charger may be disabled and the separation roll and the feed roll may be driven to feed the multi-fed paper out of the machine.

As described above, in accordance with the present embodiment, the paper sensor is arranged at such a position that the multi-fed paper stays thereat at the next paper feed timing and the presence or absence of the paper is detected at the next paper feed timing. Accordingly, the multi-feed for various sizes of papers and the jam can be detected with a simple construction.

By inhibiting the next paper feed after the multi-feed has been detected, in response to the detection output, a wasteful paper feed is prevented.

What I claim is:

1. An image forming apparatus comprising:

a container for storing recording media;

a plurality of processing means for forming images on recording media fed from said container;

detection means for detecting a multi-feed of the recording media fed from said container;

separation means for separating the multi-fed recording media one from others; and control means for controlling said processing means, in response to the detection of a multi-feed by said detection means, to form an image on one of the multi-fed recording media separated by said separation means and to disable at least one of said plurality of processing means to prevent the formation of an image on the other ones of the multi-fed recording media.

2. An image forming apparatus according to claim 1 wherein said processing means include blank exposure means for inhibiting the deposition of developing material, said blank exposure means being activated during the processing time to said other ones of the multi-fed recording media.

3. An image forming apparatus according to claim 2 wherein said processing means include original exposure means for exposing an original image, and said control means controls said original exposure means to expose the original image during the processing time to said other ones of the multi-fed recording media.

4. An image forming apparatus according to claim 2 or 3 wherein said control means inhibits the first feed of the recording medium from said container after the detection of the multi-feed.

5. An image forming apparatus according to claim 1 wherein said processing means include a charge for charging a photosensitive member, and said control means disables said charger during the processing time to said other ones of the multi-fed recording media.

6. An image forming apparatus comprising:

a container for storing sheets of recording media;

image forming means for forming images on said recording media fed from said container;

feed means for feeding said sheets from said container to a predetermined station, said feed means including a feed path extending from said container to said predetermined station and separation means for separating multi-fed sheets from each other;

a detection means for detecting multi-fed sheets at a predetermined position along said feed path; and control means, responsive to the detection of multi-fed sheets by said detection means, for feeding one of the multi-fed sheets separated by said separation means to said image forming means, and collecting the remainder of the multi-fed sheets at a specified area.

7. An image forming apparatus according to claim 6 wherein said specified area is along said feed path.

8. An image forming apparatus according to claim 6 wherein said specified area is a multi-fed sheet container located outside said feed path.

9. An image forming apparatus according to claim 6 further comprising means for displaying a multi-feed of recording media.

10. An image forming apparatus comprising:

a container for storing recording media;

a plurality of processing means for forming images on recording media fed from said container;

detection means for detecting a multi-feed of the recordng media fed from said container;

separation means for separating the multi-fed recording media one from others; and control means for controlling said processing means, in response to the detection of a multi-feed by said detection means, to form an image on one of the multi-fed recording media separated by said separation means and form no image on the other ones of the multi-fed recording media, wherein said processing means includes exposure means for exposing the image while said exposure means is reciprocated and said control means inhibits the reciprocation of said exposure means for said other ones of the multi-fed recording media.

11. An image forming apparatus comprising:

a container for storing recording media;

a plurality of processing means for forming images on recording media fed from said container;

detection means for detecting a multi-feed of the recording media fed from said container;

separation means for separating the multi-fed recording media one from others; and control means for controlling said processing means, in response to the detection of a multi-feed by said detection means, to form an image on one of the multi-fed recording media separated by said separation means and form no image on the other ones of the multi-fed recording media, wherein said processing means includes exposure means for exposing the image while said exposure means is reciprocated and said control means inhibits the reciprocation of said exposure means for said other ones of the multi-fed recording media and delays a feed timing of recording media from said container after the detection of a multi-feed for a predetermined time period.

* * * * *

UNITED STATES PATENT AND TRADEMARK OFFICE

CERTIFICATE OF CORRECTION

PATENT NO. : 4,763,162 Sheet 1 of 8

DATED : August 9, 1988

INVENTOR(S) : TOSHIAKI YAGASAKI

It is certified that error appears in the above-identified patent and that said Letters Patent is hereby corrected as shown below:

On the Title Page,

Item [56], "and Scinto" should read --& Scinto--.

In the Drawings:

Fig. 7-8, "SENSER" should read --SENSOR--; and "DITECTION" should read --DETECTION--.

Fig. 7-9, "SENSER" should read --SENSOR-- (all occurrences);

Fig. 7-10, "SENSER" should read --SENSOR--.

Figure 10A:
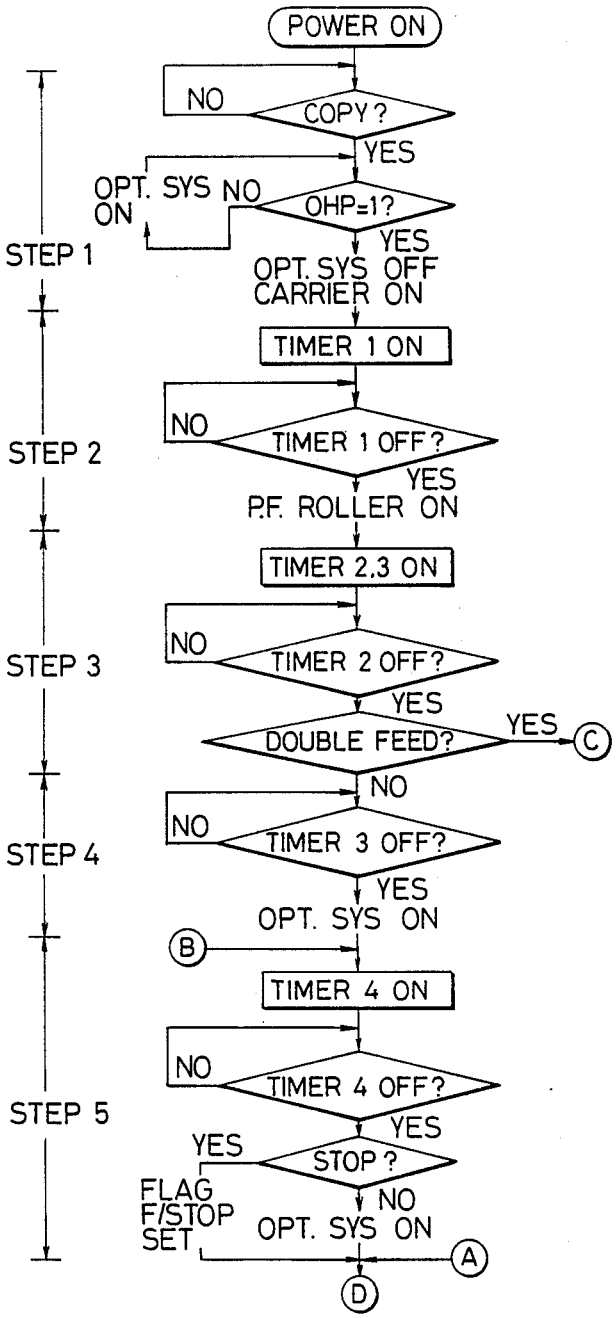
FIGS. 10A and 10B, shows a control flowchart for another embodiment of the invention.
Figure 10B:
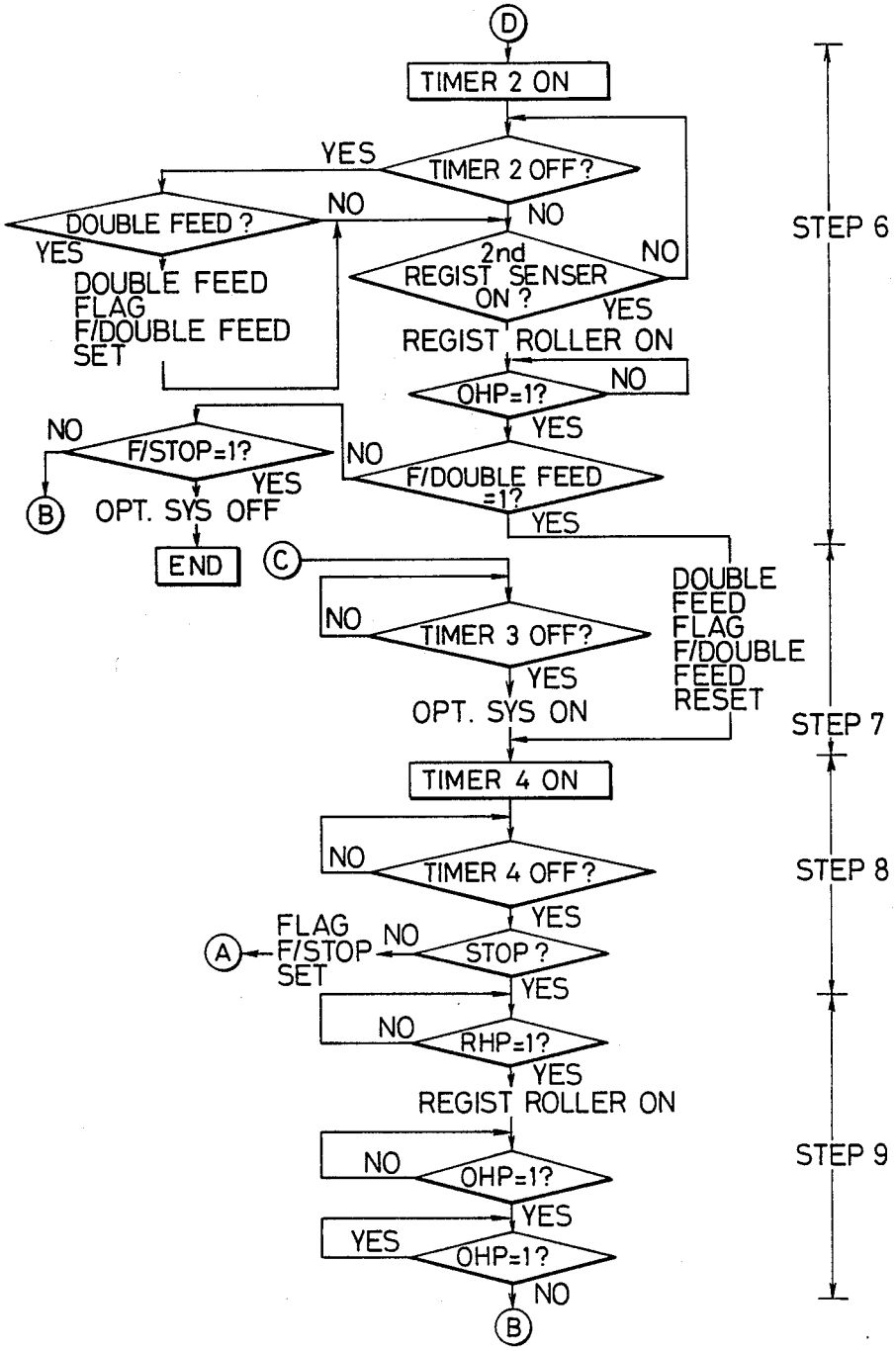

Fig. 10B, "REGIST SENSER" should read --REGIST SENSOR--

Fig. 12B, "REGIST SENSER" should read --REGIST SENSOR--

Fig. 13, "SENSER Rs" should read --SENSOR Rs--.

Fig. 14A, "FLAGE" should read --FLAG-- (All occurrences).

Fig. 15, "SENSOR" should read --SENSOR-- (Both occurrences.

Figure 16B:
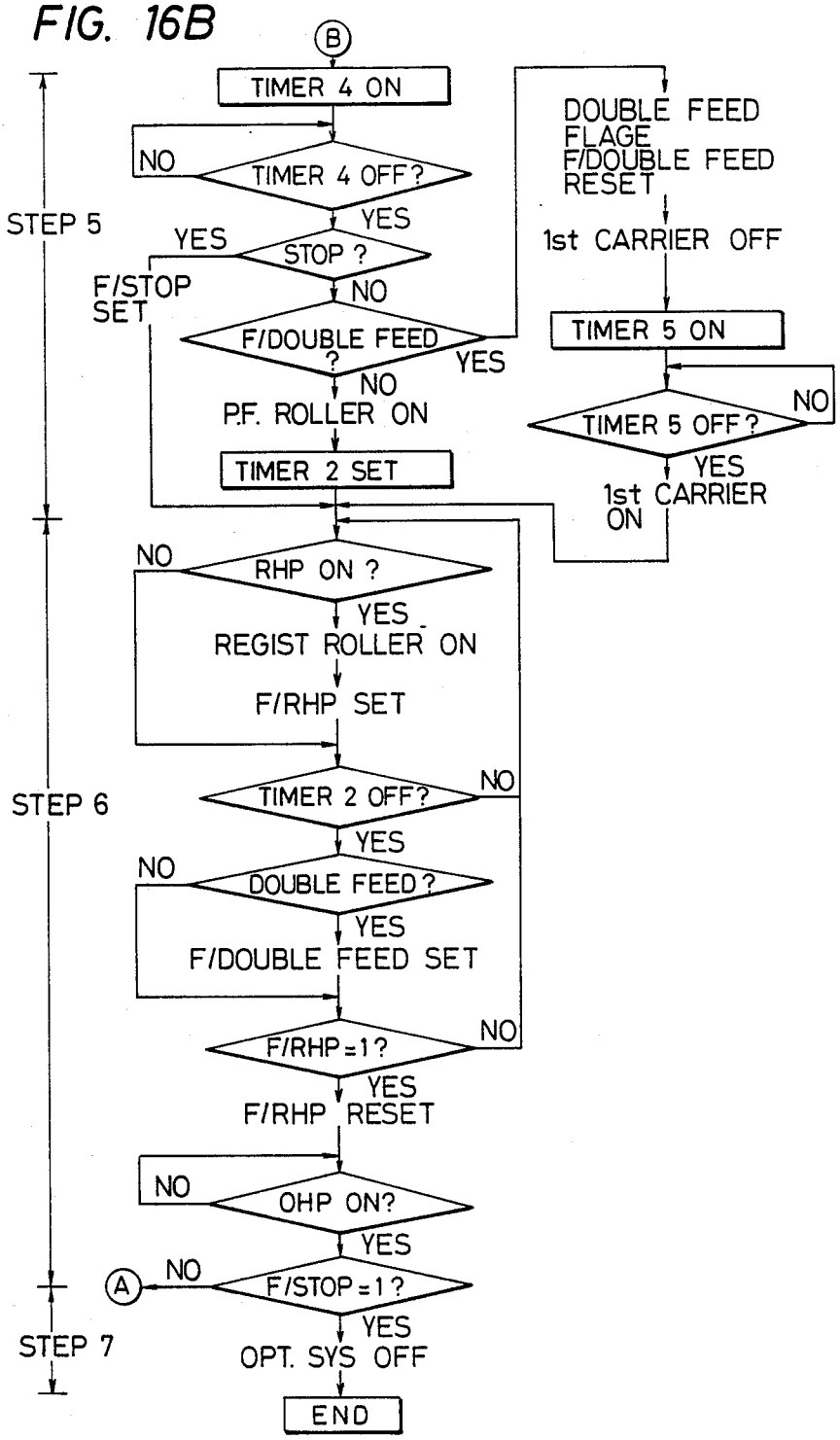
Figure 17:
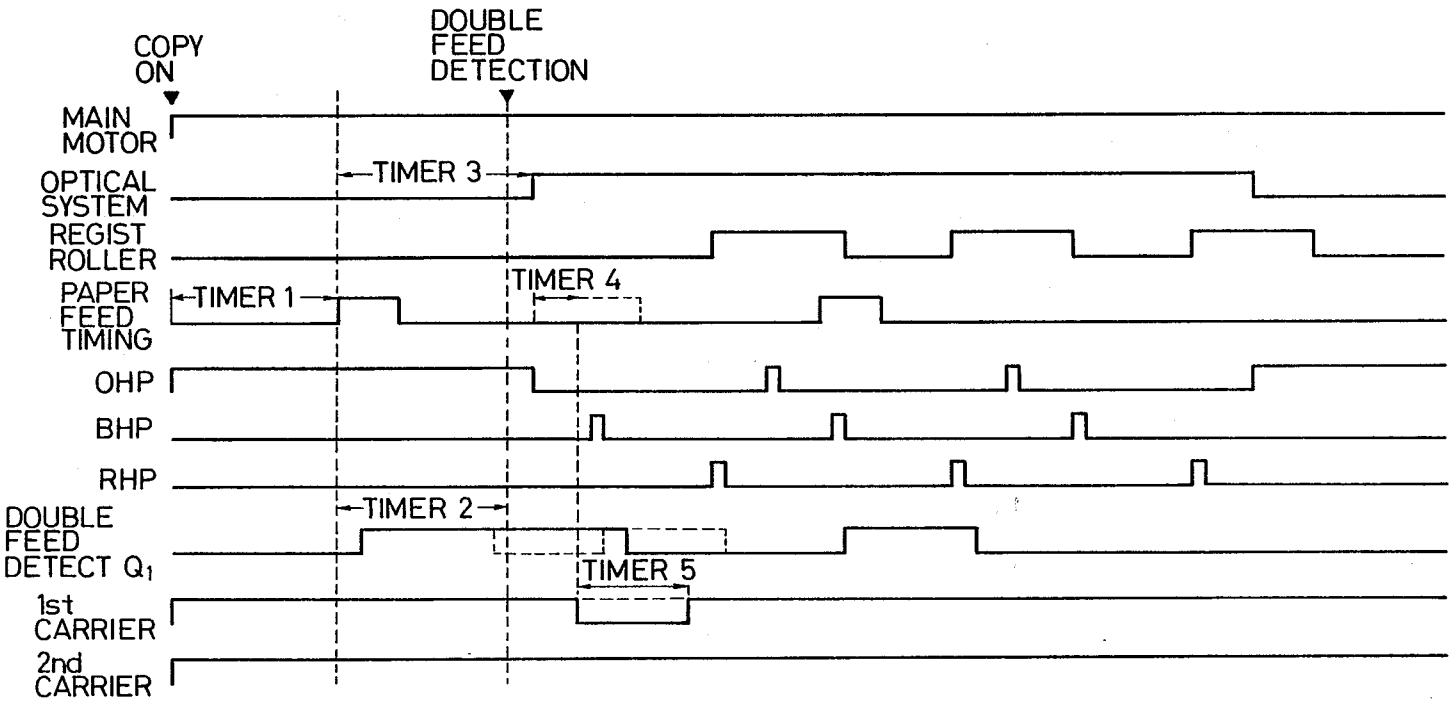
FIG. 17 shows a timing chart therefor.

Fig. 16B, "FLAGE" should read --FLAG--.

Figure 18B:
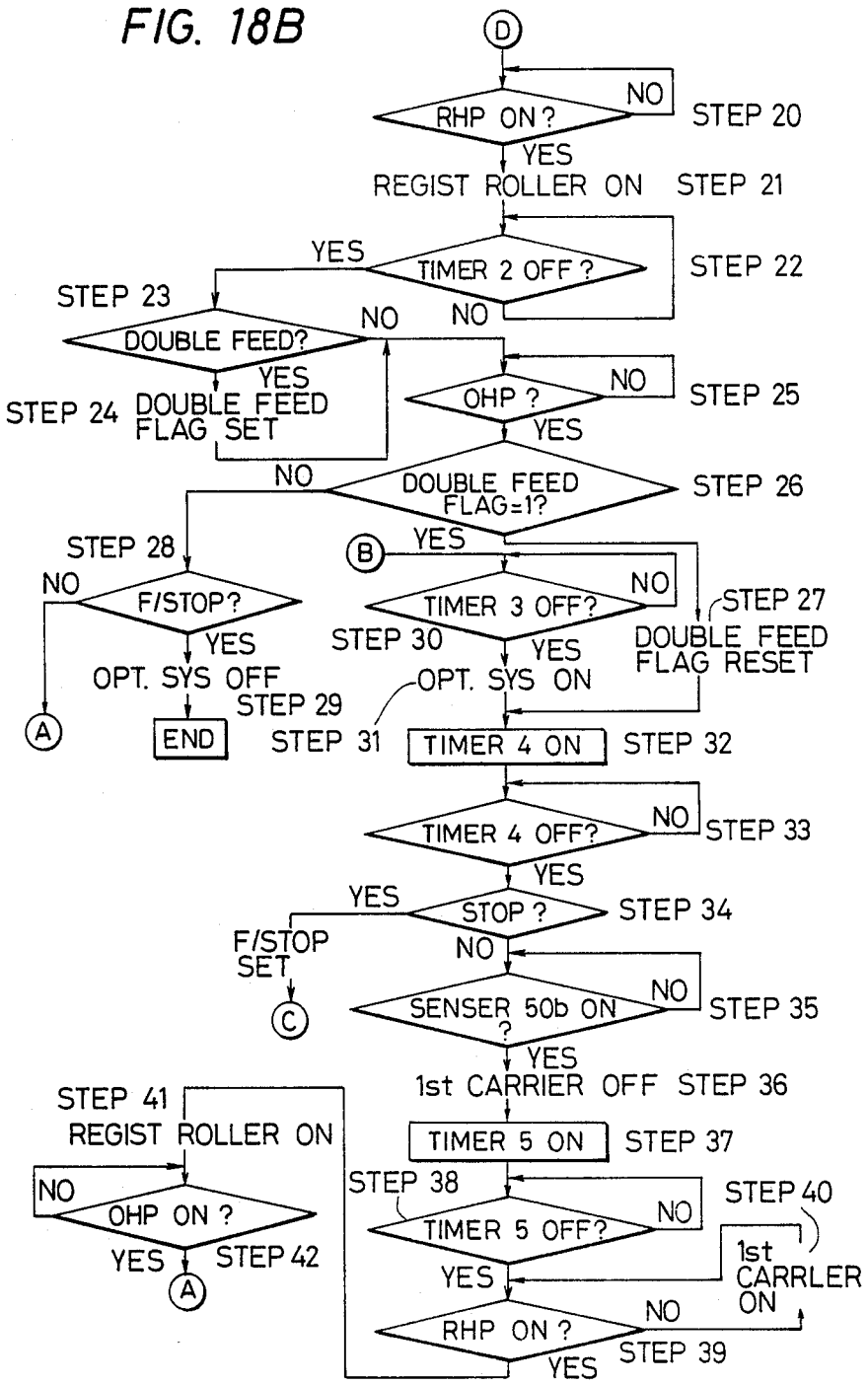

Fig. 18B, "SENSER" should read --SENSOR--; "CARRLER" should read --CARRIER--

Figure 19:
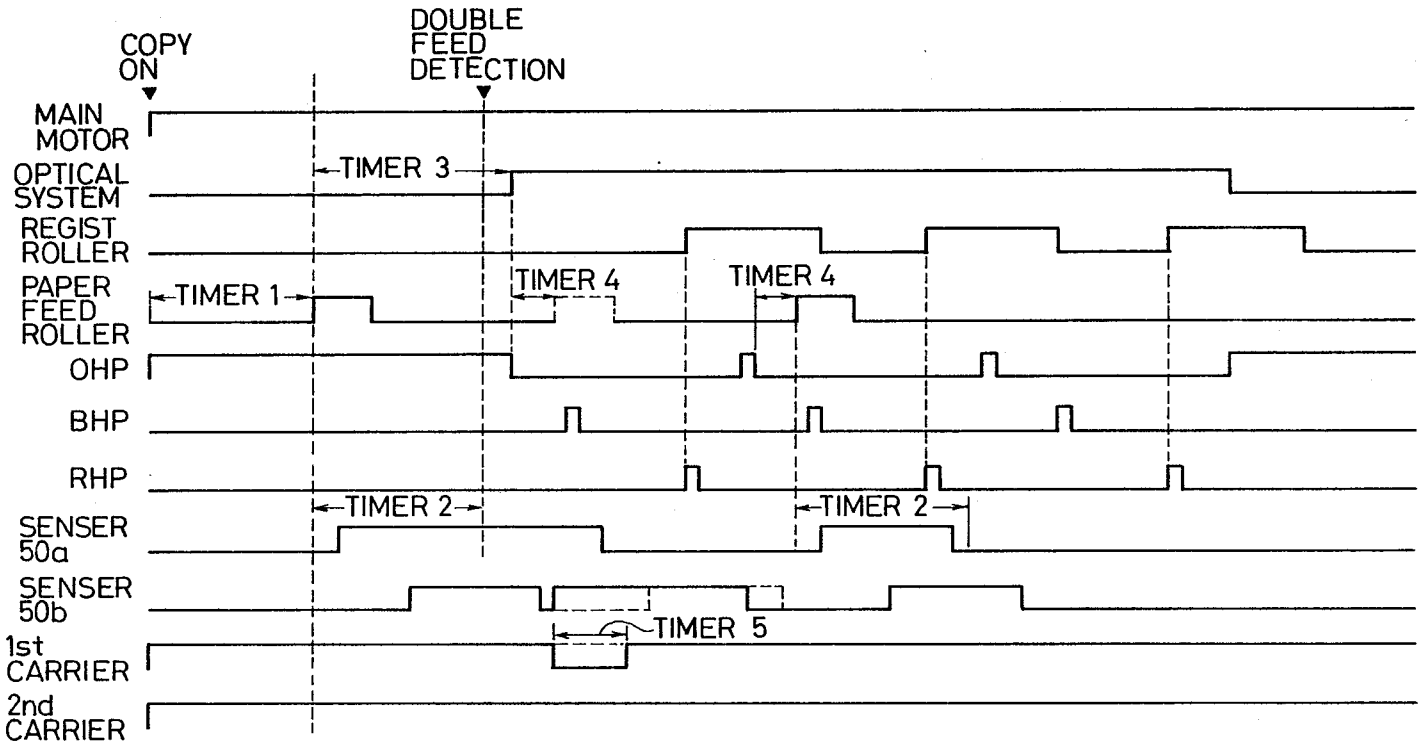
FIG. 19 shows a timing chart therefor.

Fig. 19, "SENSER" should read --SENSOR-- (each occurrence).

UNITED STATES PATENT AND TRADEMARK OFFICE

CERTIFICATE OF CORRECTION

PATENT NO. : 4,763,162 Sheet 2 of 8

DATED : August 9, 1988

INVENTOR(S) : TOSHIAKI YAGASAKI

It is certified that error appears in the above-identified patent and that said Letters Patent is hereby corrected as shown below:

Fig. 23B, "DITECTION" should read --DETECTION--; and "F/DOBLE" should read --F/DOUBLE--.

Fig. 24, "DITECTION" should read --DETECTION--.

Fig. 25, "DITECTION" should read --DETECTION-- (both occurrences).

Fig. 29, "SENSER" should read --SENSOR-- (all occurrences).

Fig. 30, "SENSER" should read --SENSOR-- (both occurrences).

Column 2, line 1, "other" should read --another--.

Column 3, line 30, "charges" should read --chargers.

Column 4, line 22, "accomodating" should read --accommodating--;

line 49, "ready to" should read --ready for--;

line 53, "toners" should read --toner--.

Column 5, line 38, "clamped" should read --is clamped--.

UNITED STATES PATENT AND TRADEMARK OFFICE

CERTIFICATE OF CORRECTION

PATENT NO. : 4,763,162 Sheet 3 of 8

DATED : August 9, 1988

INVENTOR(S) : TOSHIAKI YAGASAKI

It is certified that error appears in the above-identified patent and that said Letters Patent is hereby corrected as shown below:

Column 6, line 21, "$F_1$, $F_2$ >> $F_3$ Thus" should read --$F_1$, $F_2$ >> $F_3$. Thus--;

line 58, "light emitting" should read --light-emitting--;

line 61, "tenth" should read --tens--;

line 65, "tenth" should read --tens--.

Column 7, line 18, "regist" should read --register--.

Column 8, line 3, "are" should read --is--;

line 8, "to" should read --on--;

line 36, "the copy key" should be deleted; same line, "feed" should read --feed roll--;

line 50, "of" should be deleted;

line 59, "Z0" should be deleted.

Column 9, line 6, "step 3" should read --step 3,--;

line 15, "hs" should read --is--;

line 41, "until," should read --until--.

UNITED STATES PATENT AND TRADEMARK OFFICE

CERTIFICATE OF CORRECTION

PATENT NO. : 4,763,162

DATED : August 9, 1988

INVENTOR(S) : TOSHIAKI YAGASAKI

It is certified that error appears in the above-identified patent and that said Letters Patent is hereby corrected as shown below:

Column 10, line 28, "toners" should read --toner--;

line 33, "in the" should read --in a device such as the--;

line 61, "feed is" should read --feed operation is--;

line 68, "timer" should read --time--.

Column 11, line 40, "resist" should read --register--;

line 66, "timing," should read --timing--.

Column 12, line 1, "roll 37" should read --register roll 37--;

line 25, "is," should read --is--;

line 32, "blank:" should read --blank--;

line 36, "optical operation of the system" should read --operation of the optical system--;

line 60, "roller" should read --roll--.

Column 13, line 1, "tne" should read --the--;

line 15, "clutch" should read --clutch for--.

UNITED STATES PATENT AND TRADEMARK OFFICE

CERTIFICATE OF CORRECTION

PATENT NO. : 4,763,162 Sheet 5 of 8

DATED : August 9, 1988

INVENTOR(S) : TOSHIAKI YAGASAKI

It is certified that error appears in the above-identified patent and that said Letters Patent is hereby corrected as shown below:

Column 14, line 33, "checked" (second occurrence) should read --detected--.

Column 16, line 26, "the" (second occurrence) should be deleted.

Column 18, line 35, "timer time measured by 1" should read --time measured by timer 1--.

Column 19, line 37, "returned the" should read --returned to the--;

line 47, "(or 1)" should read --(or 31)--;

line 60, "one" should read --one,--.

Column 20, line 14, "provide a" should read --provides a--.

Column 21, line 63, "dri" should read --drive--.

Column 22, line 4, "checked" (second occurrence) should read --detected--;

line 60, "does not reach" should read --reaches--;

line 65, "or" (first occurrence) should read --of--.

UNITED STATES PATENT AND TRADEMARK OFFICE

CERTIFICATE OF CORRECTION

PATENT NO. : 4,763,162 Sheet 6 of 8

DATED : August 9, 1988

INVENTOR(S) : TOSHIAKI YAGASAKI

It is certified that error appears in the above-identified patent and that said Letters Patent is hereby corrected as shown below:

Column 23, line 9, "the" first occurrence) should read --a--;

line 41, "timer" should read --timer 1--;

line 54, "atime" should read --a time--;

line 55, "to" (second occurrence) should read --at--.

Column 25, line 28, "denotes" should read --denote--;

line 38, "timing chart." should read --timing chart therefor.--.

Column 26, line 34, "regist roll 37" should read --register roll 37--.

Column 27, line 1, "is" (first occurrence) should read --in--;

line 12, "RAM to" should read --RAM is turned on to--;

line 15, "required" should read --required for--;

line 49, "I5" should be deleted.

UNITED STATES PATENT AND TRADEMARK OFFICE

CERTIFICATE OF CORRECTION

PATENT NO. : 4,763,162 Sheet 7 of 8

DATED : August 9, 1988

INVENTOR(S) : TOSHIAKI YAGASAKI

It is certified that error appears in the above-identified patent and that said Letters Patent is hereby corrected as shown below:

Column 28, line 2, "timer 1 and 2" should read --timers 1 and 2--;

line 8, "to" should read --at--;

line 11, "to" should read --at--;

line 31, "outport $F_3$" should read --output port $F_3$--.

Column 29, line 3, "remain" should read --remaining--.

Column 31, line 15, "thickness" should read --thicknesses--;

line 28, "timing chart." should read --timing chart therefor.--.

UNITED STATES PATENT AND TRADEMARK OFFICE

CERTIFICATE OF CORRECTION

PATENT NO. : 4,763,162 Sheet 8 of 8

DATED : August 9, 1988

INVENTOR(S) : TOSHIAKI YAGASAKI

It is certified that error appears in the above-identified patent and that said Letters Patent is hereby corrected as shown below:

Column 32, line 63, "charge" should read --charger--.

Signed and Sealed this

Seventh Day of March, 1989

*Attest:*

DONALD J. QUIGG

*Attesting Officer*

*Commissioner of Patents and Trademarks*